US008122735B2

(12) United States Patent
Sakitani et al.

(10) Patent No.: US 8,122,735 B2
(45) Date of Patent: Feb. 28, 2012

(54) REFRIGERATING APPARATUS

(75) Inventors: Katsumi Sakitani, Osaka (JP); Tetsuya Okamoto, Osaka (JP); Masakazu Okamoto, Osaka (JP); Eiji Kumakura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 659 days.

(21) Appl. No.: 12/226,433

(22) PCT Filed: Apr. 16, 2007

(86) PCT No.: PCT/JP2007/058288

§ 371 (c)(1),
(2), (4) Date: Oct. 17, 2008

(87) PCT Pub. No.: WO2007/123088

PCT Pub. Date: Nov. 1, 2007

(65) Prior Publication Data

US 2009/0071187 A1 Mar. 19, 2009

(30) Foreign Application Priority Data

Apr. 20, 2006 (JP) ..... 2006-116694

(51) Int. Cl.
*F25B 43/02* (2006.01)

(52) U.S. Cl. ..... 62/468; 62/192; 62/498; 62/500

(58) Field of Classification Search ..... 62/468, 62/192, 498, 500; 418/55.6
See application file for complete search history.

(56) References Cited

U.S. PATENT DOCUMENTS 7,674,097 B2 * 3/2010 Okamoto et al. ..... 418/3
2006/0153723 A1 7/2006 Kurita et al.
2008/0232992 A1 9/2008 Okamoto et al.

FOREIGN PATENT DOCUMENTS

| | | | |
|---|---|---|---|
| JP | 2000-241033 | A | 9/2000 |
| JP | 2001-141315 | A | 5/2001 |
| JP | 2003-240366 | A | 8/2003 |
| JP | 2004-257303 | A | 9/2004 |
| JP | 2004-325019 | A | 11/2004 |
| JP | 2005-2832 | A | 1/2005 |
| JP | 2005-299632 | A | 10/2005 |
| JP | 2007-24439 | A | 2/2007 |
| JP | 2007-113815 | A | 5/2007 |

* cited by examiner

*Primary Examiner* — Melvin Jones
(74) *Attorney, Agent, or Firm* — Birch, Stewart, Kolasch & Birch, LLP

(57) ABSTRACT

A refrigerant circuit (11) of an air conditioner (10) includes a compressor (20) and an expander (30). In the compressor (20), refrigerator oil is supplied from an oil reservoir (27) to a compression mechanism (21). In the expander (30), the refrigerator oil is supplied from an oil reservoir (37) to an expansion mechanism (31). The inner pressures of the compressor casing (24) and the expander casing (34) are the high pressure and the low pressure of the refrigeration cycle, respectively. An oil adjusting valve (52) is provided in an oil pipe (42) connecting the compressor casing (24) and the expander casing (34). The oil amount adjusting valve (52) is operated on the basis of an output signal of an oil level sensor (51). When the oil amount adjusting valve (52) is opened, the refrigerator oil flows from the oil reservoir (27) in the compressor casing (24) toward the oil reservoir (37) in the expander casing (34) through the oil pipe (42).

18 Claims, 39 Drawing Sheets

REFRIGERATING APPARATUS

TECHNICAL FIELD

The present invention relates to lubricant oil supply to a compressor and an expander in a refrigerating apparatus.

BACKGROUND ART

Conventionally, refrigerating apparatuses performing a refrigeration cycle by circulating refrigerant in a refrigerant circuit have been known and are widely used in air conditioners and the like. For example, Patent Document 1 discloses a refrigerating apparatus including a compressor for compressing refrigerant and an expander for expanding the refrigerant to recover motive power. Specifically, in a refrigerating apparatus shown in FIG. 1 in Patent Document 1, the expander is connected to the compressor through a single shaft so that the motive power obtained in the expander is utilized for driving the compressor. In another refrigerating apparatus shown in FIG. 6 in Patent Document 1, a motor and a generator are connected to the compressor and the expander, respectively, so that the compressor is driven by the motor to compress the refrigerant while the generator is driven by the expander to generate motive power.

A fluid machinery in which an expander and a compressor are connected to each other through a single shaft is disclosed in Patent Document 2, for example. In the fluid machinery disclosed in this patent document, a compression mechanism as a compressor, an expansion mechanism as an expander, and a shaft connecting them are housed in a single casing. Further, in this fluid machinery, an oil supply path is formed inside the shaft to supply lubricant oil reserved in the bottom of the casing to the compression mechanism and the expansion mechanism through the oil supply path.

Patent Document 3 discloses a generally-called hermetic compressor in which a compression mechanism and a motor are housed in a single casing. In the hermetic compressor, an oil supply path is formed in a drive shaft of a compression mechanism so that lubricant oil reserved in the bottom of the casing is supplied to the compression mechanism through the oil supply path. The refrigerating apparatus shown in FIG. 6 in Patent Document 1 may use a hermetic compressor of this kind.

Patent Document 1: Japanese Unexamined Patent Application Publication No. 2000-241033

Patent Document 2: Japanese Unexamined Patent Application Publication No. 2005-299632

Patent Document 3: Japanese Unexamined Patent Application Publication No. 2005-002832

SUMMARY OF THE INVENTION

Problems that the Invention is to Solve

As described above, a generally-known compressor provided in a refrigerant circuit has a construction in which a compression mechanism is housed in a casing so that lubricant oil reserved in the casing is supplied to the compression mechanism. As to an expander, it may have a similar construction in which an expansion mechanism is housed in a casing so that lubricant oil reserved in the casing is supplied to the expansion mechanism.

In the refrigerating apparatus shown in FIG. 6 in Patent Document 1, the compressor and the expander each including a separate casing may be provided in the refrigerant circuit so that the compression mechanism is lubricated by the lubricant oil in the casing of the compressor while the expansion mechanism is lubricated by the lubricant oil in the casing of the expander. In the refrigerating apparatus in this construction, however, the lubricant oil may be distributed unevenly to one of the compressor and the expander to cause a trouble, such as seizing and the like.

This problem will be described. During the operation of the compressor, part of the lubricant oil supplied to the compression mechanism is discharged from the compressor together with the refrigerant. As well, during the operation of the expander, part of the lubricant oil supplied to the expansion mechanism flows out from the expander together with the refrigerant. Namely, in the refrigerant circuit of the refrigerating apparatus including both the compressor and the expander, the lubricant oil flowing out from the casing of the compressor and the lubricant oil flowing out from the casing of the expander are circulated together with the refrigerant. If the lubricant oil of which amount corresponds to the amount thereof flowing out from the compressor can be returned to the casing of the compressor while the lubricant oil of which amount corresponds to the amount thereof flowing out from the expander can be returned to the casing of the expander, a given amount of the lubricant oil is secured in each of the casings of the compressor and the expander.

It is rather difficult, however, to set accurately the ratio between the amount of the lubricant oil returned to the compressor and that returned to the expander in the total amount of the lubricant oil circulating in the refrigerant circuit. In other words, it is practically impossible to return to the compressor the lubricant oil of which amount corresponds to the amount thereof flowing out from the compressor and to return to the expander the lubricant oil of which amount corresponds to the amount thereof flowing out from the expander. For this reason, the lubricant oil is unevenly distributed to one of the compressor and the expander in the operation of the refrigerating apparatus, and consequently, a trouble, such as seizing and the like may be caused in one of them in which the amount of the lubricant oil in the casing is less.

The present invention has been made in view of the foregoing and has its object of ensuring the reliability of a refrigerating apparatus including a refrigerant circuit in which a compressor and an expander are housed in separate casings.

Means for Solving the Problems

A first aspect of the present invention is directed to a refrigerating apparatus including a refrigerant circuit (11) to which a compressor (20) and an expander (30) are connected and performing a refrigeration cycle by circulating refrigerant in the refrigerant circuit (11). The refrigerating apparatus including a refrigerant circuit (11) to which a compressor (20) and an expander includes: in the compressor (20), a compression mechanism (21) for sucking and compressing the refrigerant; a compressor casing (24) for housing the compression mechanism (21); and an oil supply mechanism (22) for supplying lubricant oil from an oil reservoir (27) in the compressor casing (24) to the compression mechanism (21); in the expander (30), an expansion mechanism (31) for expanding the refrigerant flowing therein to generate motive power; an expander casing (34) for housing the expansion mechanism (31); and an oil supply mechanism (32) for supplying the lubricant oil from an oil reservoir (37) in the expander (34) to the expansion mechanism (31), one of the compressor casing (24) and the expander casing (34) being at high pressure of the refrigeration cycle while the other being at low pressure of the refrigeration cycle; an oil distribution path (42) which connects the compressor casing (34) and the expander casing (34)

for allowing the lubricant oil to flow between the oil reservoir (27) in the compressor casing (24) and the oil reservoir (37) in the expander casing (34); and adjusting means (50) for adjusting a flow state of the lubricant oil in the oil distribution path (42).

In the first aspect, the refrigerant is circulated while repeating the processes of compression, condensation, expansion, and evaporation sequentially in the refrigerant circuit (11). During the operation of the compressor (20), the oil supply mechanism (22) supplies the lubricant oil from the oil reservoir (27) in the compressor casing (24) to the compression mechanism (21), and part of the lubricant oil supplied to the compression mechanism (21) is discharged from the compressor (20) together with the refrigerant compressed in the compression mechanism (21). During the operation of the expander (30), the oil supply mechanism (32) supplies the lubricant oil from the oil reservoir (37) in the expander casing (34) to the expansion mechanism (31), and part of the lubricant oil supplied to the expansion mechanism (31) is sent out from the expander (30) together with the refrigerant expanded in the expansion mechanism (31). The lubricant oil flowing out from the compressor (20) and the expander (30) is circulated in the refrigerant circuit (11) together with the refrigerant and is returned to the compressor (20) or the expander (30).

In the first aspect, the oil reservoir (27) in the compressor casing (24) and the oil reservoir (37) in the expander casing (34) communicate with each other through the oil distribution path (42). Since there is pressure difference between the internal space of the compressor casing (24) and the internal space of the expander casing (34), the lubricant oil flows through the oil distribution path (42) from one of the oil reservoir (27) in the compressor casing (24) and the oil reservoir (37) in the expander casing (34) to the other. The flowing state of the lubricant oil flowing in the oil distribution path (42) is adjusted by the adjusting means (50).

Referring to a second aspect of the present invention, in the first aspect, the adjusting means (50) includes: an oil level detector (51) for detecting an oil level in the oil reservoir (27) in the compressor casing (24) or an oil level in the oil reservoir (37) in the expander casing (34); and a control valve (52) which is provided in the oil distribution path (42) and of which opening is controlled on the basis of an output signal of the oil level detector (51).

In the second aspect, the adjusting means (50) includes the oil level detector (51) and the control valve (52). The reserved amount of the lubricant oil in the compressor casing (24) correlates to the oil level in the oil reservoir (27) in the compressor casing (24). As well, the reserved amount of the lubricant oil in the expander casing (34) correlates to the oil level in the oil reservoir (37) in the expander casing (34). When information on the oil level of one of the oil reservoirs (27) in the compressor casing (24) and the oil reservoir (37) in the expander casing (34) is acquired, whether the lubricant oil is excessive or deficient in the compressor (20) and the expander (30) can be judged on the basis of the information. In view of this, in this aspect, the oil level of the lubricant oil in one of the oil reservoir (27) in the compressor casing (24) and the oil reservoir (37) in the expander casing (34) is detected by the oil level detector (51) to control the opening of the control valve (52) according to the output signal of the oil level detector (51), thereby controlling the flow rate of the lubricant oil in the oil distribution path (42).

Referring to a third aspect of the present invention, in the first aspect, the compression mechanism (21) compresses the refrigerant sucked directly from outside of the compressor casing (24) and discharge it into the compressor casing (24), and the refrigerant circuit (11) includes a low-pressure side communication path (80) for allowing a pipe connected to a suction side of the compressor (20) and an internal space of the expander casing (34) to communicate with each other.

Referring to a fourth aspect of the present invention, in the first aspect, the compression mechanism (21) compresses the refrigerant sucked directly from outside of the compressor casing (24) and discharge it into the compressor casing (24), and the refrigerant circuit (11) includes: a low-pressure side introduction path (81) for introducing part or all of low-pressure refrigerant flowing toward a suction side of the compressor (20) into an internal space of the expander casing (34); and a low-pressure side leading path (82) for supplying the low-pressure refrigerant to the compressor (20) by leading the low-pressure refrigerant from the internal space of the expander casing (34).

In the third and fourth aspects, the compression mechanism (21) directly sucks the refrigerant flowing into the compressor (20). The compression mechanism (21) compresses the thus sucked refrigerant and discharged it into the compressor casing (24). Namely, the refrigerant compressed in the compression mechanism (21) is once discharged into the internal space of the compressor casing (24) and is then sent outside the compressor casing (24). The inner pressure of the compressor casing (24) is almost equal to the pressure of the refrigerant discharged from the compression mechanism (21), that is, the high pressure of the refrigeration cycle.

In the third aspect, the internal space of the expander casing (34) communicates with the pipe connected to the suction side of the compressor (20) through the low-pressure side communication path (80). In the fourth aspect, the low-pressure refrigerant flowing toward the suction side of the compressor (20) flows into the internal space of the expander casing (34) through the low-pressure side introduction path (81) and is then sucked into the compressor (20) through the low-pressure side leading path (82). Accordingly, in these aspects, the inner pressure of the expander casing (34) is almost equal to the pressure of the refrigerant sucked into the compressor (20), that is, the low pressure of the refrigeration cycle.

Thus, in the third and fourth aspects, the inner pressure of the compressor casing (24) is higher than that of the expander casing (34). Accordingly, the lubricant oil flows through the oil distribution path (42) from the oil reservoir (27) in the compressor casing (24) toward the oil reservoir (37) in the expander casing (34).

Referring to a fifth aspect of the present invention, in the fourth aspect, a generator (33) driven by the expansion mechanism (31) is housed in the expander casing (34) to partition the internal space of the expander casing (34), one of spaces partitioned by the generator (33) being connected to the low-pressure side introduction path (81) while the other one of the spaces being connected to the low-pressure side leading path (82) in the internal space of the expander casing (34).

In the fifth aspect, the generator (33) is housed in the internal space of the expander casing (34). The power recovered from the refrigerant in the expansion mechanism (31) is utilized for driving the generator (33). Namely, the power recovered from the refrigerant is converted to the motive power in the generator (33). The low-pressure refrigerant flowing in the expander casing (34) through the low-pressure side introduction path (81) passes through, for example, a slit formed in the generator (33) itself, a slit between the generator (33) and the expander casing (34), and the like and flows then into the low-pressure side leading path (82). The lubricant oil flowing in the expander casing (34) together with the low-pressure refrigerant is separated from the refrigerant when passing through the generator (33) and flows then into the oil reservoir (37) in the expander casing (34).

Referring to a sixth aspect of the present invention, in the fifth aspect, the generator (33) partitions transversely the internal space of the expander casing (34), a space under the generator (33) being connected to the low-pressure side introduction path (81) while a space above the generator (33) being connected to the low-pressure side leading path (82) in the internal space of the expander casing (34).

In the sixth aspect, the low-pressure refrigerant flowing into the expander casing (34) from the low-pressure side introduction path (81) passes through the generator (33) from below upward. While, the lubricant oil separated from the refrigerant when passing through the generator (33) drops from above downward due to the force of gravity.

Referring to a seventh aspect of the present invention, in the third or fourth aspect, the refrigerant circuit (11) includes: an oil separator (70) arranged on an outflow side of the expander (30) for separating the refrigerant and the lubricant oil from each other; and an oil return path (71) for supplying the lubricant oil from the oil separator (70) to the compressor casing (24).

In the seventh aspect, the lubricant oil flowing in the refrigerant circuit (11) together with the refrigerant is separated from the refrigerant by the oil separator (70) arranged downstream of the expander (30). The lubricant oil separated from the refrigerant in the oil separator (70) is sent inside the compressor casing (24) through the oil return path (71). Part of the lubricant oil in the compressor casing (24) is supplied into the expander casing (34) through the oil distribution path (42). Namely, each lubricant oil flowing out from the expander (30) and the compressor (20) in the refrigerant circuit (11) is once returned to the compressor casing (24) and is then distributed from the oil reservoir (27) in the compressor casing (24) to the expander (30).

Referring to an eighth aspect of the present invention, in the third or fourth aspect, the refrigerant circuit (11) includes: an oil separator (70) arranged on an outflow side of the expander (30) for separating the refrigerant and the lubricant oil from each other; and an oil return path (72) for supplying the lubricant oil from the oil separator (70) to the expander casing (34).

In the eighth aspect, the lubricant oil flowing in the refrigerant circuit (11) together with the refrigerant is separated from the refrigerant by the oil separator (70) arranged downstream of the expander (30). The lubricant oil separated from the refrigerant in the oil separator (70) is sent inside the expander casing (34) through the oil return path (72). Namely, both the lubricant oil reserved in the compressor casing (24) and the lubricant oil separated from refrigerant in the oil separator (70) are supplied to the oil reservoir (37) in the expander casing (34).

Referring to a ninth aspect of the present invention, the refrigerating apparatus in the third or fourth aspect further includes an oil cooling heat exchanger (90) for cooling by heat exchanging the lubricant oil flowing in the oil distribution path (42) with the low-pressure refrigerant sucked to the compressor (20).

In the ninth aspect, the lubricant oil flowing in the oil distribution path (42) is heat exchanged with the low-pressure refrigerant before being sucked into the compressor (20). The internal space of the compressor casing (24) is filled with the high-temperature and high-pressure refrigerant discharged from the compression mechanism (21). Accordingly, the lubricant oil reserved in the compressor casing (24) is comparatively high temperature (for example, approximately, 80° C.). On the other hand, the low-pressure refrigerant to be sucked into the compressor (20) is comparatively low temperature (for example, approximately 5° C.). The lubricant oil flowing from the oil reservoir (27) in the compressor casing (24) to the oil distribution path (42) is heat exchanged with the low-pressure refrigerant when passing through the oil cooling heat exchanger (90) to thus be cooled and flows then into the oil reservoir (37) in the expander casing (34).

Referring to a tenth aspect of the present invention, in the first aspect, the compression mechanism (21) compresses the refrigerant sucked from the compressor casing (24) and discharge it directly outside the compressor casing (24), and the refrigerant circuit (11) includes: a high-pressure side communication path (85) for allowing a pipe connected to a discharge side of the compressor (20) and an internal space of the expander casing (34) to communicate with each other; an oil separator (60) arranged on the discharge side of the compressor (20) for separating the refrigerant and the lubricant oil from each other; and an oil return path (62) for supplying the lubricant oil from the oil separator (60) to the expander casing (34).

Referring to an eleventh aspect of the present invention, in the first aspect, the compression mechanism (21) compresses the refrigerant sucked from the compressor casing (24) and discharge it directly outside the compressor casing (24), and the refrigerant circuit (11) includes: a high-pressure side introduction path (86) for introducing part or all of high-pressure refrigerant discharged from the compressor (20) into an internal space of the expander casing (34); and a high-pressure side leading path (87) for leading the high-pressure refrigerant from the internal space of the expander casing (34).

In the tenth and eleventh aspects, the low-pressure refrigerant flowing toward the compressor (20) once flows into the internal space of the compressor casing (24) and is then sucked into the compression mechanism (21). The compression mechanism (21) compresses the thus sucked refrigerant and directly discharges it outside the compressor casing (24). The inner pressure of the compressor casing (24) is almost equal to the pressure of the refrigerant that the compression mechanism (21) sucks, that is, the low pressure of the refrigeration cycle.

In the tenth aspect, the internal space of the expander casing (34) communicates with the pipe connected to the discharge side of the compressor (20) through the high-pressure side communication path (85). In the eleventh aspect, the high-pressure refrigerant discharged from the compressor (20) flows into the internal space of the expander casing (34) through the high-pressure side introduction path (86) and flows then out from the expander casing (34) through the high-pressure side leading path (87). Accordingly, in these aspects, the inner pressure of the expansion casing (34) is almost equal to the pressure of the refrigerant discharged from the compressor (20), that is, the high pressure of the refrigeration cycle.

Thus, in the tenth and eleventh aspects, the inner pressure of the expander casing (24) is higher than that of the compressor casing (24). Accordingly, the lubricant oil flows through the oil distribution path (42) from the oil reservoir (37) in the expander casing (34) to the oil reservoir (27) in the compressor casing (24).

In the tenth aspect, the lubricant oil flowing in the refrigerant circuit (11) together with the refrigerant is separated from the refrigerant by the oil separator (60) arranged downstream of the compressor (20). The lubricant oil separated from the refrigerant in the oil separator (60) is sent inside the expander casing (34) through the oil return path (62). Part of the lubricant oil in the expander casing (34) is supplied into the compressor casing (24) through the oil distribution path (42). Namely, each lubricant oil flowing out from the expander (30) and the compressor (20) in the refrigerant circuit (11) is once returned to the expander casing (34) and is then distributed from the oil reservoir (37) in the expander casing (34) to the compressor (20).

Referring to a twelfth aspect of the present invention, in the eleventh aspect, a generator (33) driven by the expansion mechanism (31) is housed in the expander casing (34) to partition the internal space of the expander casing (34), one of spaces partitioned by the generator (33) being connected to the high-pressure side introduction path (86) while the other one of the spaces being connected to the high-pressure side leading path (87) in the internal space of the expander casing (34).

In the twelfth aspect, the generator (33) is housed in the internal space of the expander casing (34). The power recovered from the refrigerant in the expansion mechanism (31) is utilized for driving the generator (33). Namely, the power recovered from the refrigerant is converted to the motive power in the generator (33). The high-pressure refrigerant flowing in the expander casing (34) through the high-pressure side introduction path (86) passes through, for example, a slit formed in the generator (33) itself, a slit between the generator (33) and the expander casing (34), and the like and flows then into the high-pressure side leading path (87). The lubricant oil flowing in the expander casing (43) together with the high-pressure refrigerant is separated from the refrigerant when passing through the generator (33) and flows then into the oil reservoir (37) in the expander casing (34).

Referring to a thirteenth aspect of the present invention, in the twelfth aspect, the generator (33) partitions transversely the internal space of the expander casing (34), a space under the generator (33) being connected to the high-pressure side introduction path (86) while a space above the generator (33) being connected to the high-pressure side leading path (87) in the internal space of the expander casing (34).

In the thirteenth aspect, the high-pressure refrigerant flowing in the expander casing (34) from the high-pressure side introduction path (86) passes through the generator (33) from below upward. On the other hand, the lubricant oil separated from the refrigerant when passing through the generator (33) drops from above downward due to the force of gravity.

Referring to a fourteenth aspect of the present invention, in the third, fourth, or eleventh aspect, the refrigerant circuit (11) includes: an oil separator (60) arranged on a discharge side of the compressor (20) for separating the refrigerant and the lubricant oil from each other; and an oil return pipe (61) for supplying the lubricant oil from the oil separator (60) to the compressor casing (24).

Referring to a fifteenth aspect of the present invention, in the third, fourth, or eleventh aspect, the refrigerant circuit (11) includes: an oil separator (60) arranged on a discharge side of the compressor (20) for separating the refrigerant and the lubricant oil from each other; and an oil return pipe (62) for supplying the lubricant oil from the oil separator (60) to the expander casing (34).

In the fourteenth and fifteenth aspects, the lubricant oil flowing in the refrigerant circuit (11) together with the refrigerant is separated from the refrigerant by the oil separator (60) arranged downstream of the compressor (20). Namely, in these aspects, the lubricant oil discharged from the compressor (20) together with the refrigerant is separated from the refrigerant by the oil separator (60). In the fourteenth aspect, the lubricant oil separated from the refrigerant in the oil separator (60) is sent inside the compressor casing (24) through the oil return path (61). In the fifteenth aspect, the lubricant oil separated from the refrigerant in the oil separator (60) is sent inside the expander casing (34) through the oil return path (62).

Referring to a sixteenth aspect of the present invention, in the third, fourth, or eleventh aspect, the refrigerant circuit (11) includes: an oil separator (75) arranged on a suction side of the compressor (20) for separating the refrigerant and the lubricant oil from each other; and an oil return pipe (77) for supplying the lubricant oil from the oil separator (75) to the expander casing (24).

In the sixteenth aspect, the lubricant oil flowing in the refrigerant circuit (11) together with the refrigerant is separated from the refrigerant by the oil separator (75) arranged upstream of the compressor (20). The lubricant oil separated from the refrigerant in the oil separator (75) is sent inside the expander casing (34) through the oil return path (77).

Effects of the Invention

In the present invention, the compressor casing (24) and the expander casing (34) are connected to each other through the oil distribution path (42) with the inner pressure of the compressor casing (24) differentiated from that of the expander casing (34). Utilization of the oil distribution path (42) results in supply of the lubricant oil from one of the compressor casing (24) and the expander casing (34) of which inner pressure is higher to the other of which inner pressure is lower. Accordingly, even when the lubricant oil is unevenly present in one of the compressor (20) and the expander (30) in the operation of the refrigerating apparatus (10), the lubricant oil can be re-distributed to the compressor (20) or the expander (30). As a result, each reserved amount of the lubricant oil in the compressor casing (24) and the expander casing (34) can be secured to attain definite lubrication of the compression mechanism (21) and the expansion mechanism (31). Hence, in the present invention, damage of the compressor (20) and the expander (30) caused due to insufficient lubrication can be prevented to secure the reliability of the refrigerating apparatus (10).

In the second aspect of the present invention, the oil level detector (51) detects the oil level in the oil reservoir (27) in the compressor casing (24) or the oil reservoir (37) in the expander casing (34). This attains accurate detection of the reserved amount of the lubrication oil in the compressor (20) and the expander casing (30) to prevent further definitely damage of the compressor (20) and the expander (30) caused due to insufficient lubrication.

In the third aspect of the present invention, the expander casing (34) is connected through the low-pressure side communication path (80) to the pipe in which the low-pressure refrigerant flows toward the compressor (20) in the refrigerant circuit (11). In the fourth aspect of the present invention, the low-pressure refrigerant flowing toward the suction side of the compressor (20) passes through the internal space of the expander casing (34).

Herein, since a heat exchanger for heat absorption is provided downstream of the expander (30) in the refrigerant circuit (11), it is desirable for securing the absorption amount of the heat of the refrigerant in the heat exchanger to set the enthalpy of the refrigerant flowing out from the expander (30) low as far as possible. On the other hand, the temperature of the low-pressure refrigerant flowing toward the compressor (20) is not so high.

In the third aspect of the present invention, the expander casing (34) communicates with the pipe in which the low-pressure refrigerant flows toward the compressor (20) in the refrigerant circuit (11), so that the temperature in the compressor casing (24) is not so high. As well, in the fourth aspect of the present invention, the low-pressure refrigerant at comparatively low temperature passes through the internal space of the expander casing (34), so that the temperature in the expander casing (34) is not so high. Accordingly in these aspects, the amount of heat that invades the refrigerant expanded in the expansion mechanism (31) can be reduced to suppress the enthalpy of the refrigerant flowing out from the expander (31) low. As a result, the absorption amount of the heat of the refrigerant in the heat exchanger for heat absorption can be secured sufficiently.

In the fifth and sixth aspects of the present invention, part or all of the low-pressure refrigerant flowing toward the suction side of the compressor (20) is introduced into the internal space of the expander casing (34) and is then separated into the lubricant oil and the low-pressure refrigerant by utilizing the generator (33) provided there, so that the amount of the lubricant oil reserved in the expander casing (34) can be secured effortlessly.

Further in the fifth and sixth aspects of the present invention, the low-pressure refrigerant and the lubricant oil are separated from each other by the expander casing (34) to reduce the amount of the lubricant oil sucked in the compression mechanism (21) together with the refrigerant. Since the volume of the fluid that the compression mechanism (21) can suck in a single suction stroke is determined, decrease in amount of the lubricant oil to be sucked into the compression mechanism (21) together with the refrigerant increases the amount of the refrigerant to be sucked into the compression mechanism (21). Hence, in these aspects, the compressor (21) can exert its performance fully.

Further in the sixth aspect of the present invention, the low-pressure refrigerant flowing in the expander casing (34) passes through the generator (33) from below upward while the lubricant oil separated from the refrigerant when passing through the generator (33) drops from above downward. Namely, in the this aspect, the direction in which the low-pressure refrigerant flows is reverse to the direction in which the lubricant oil separated from the low-pressure refrigerant flows in the internal space of the expander casing (34). Accordingly, in this aspect, the amount of the lubricant oil can be reduced further definitely which flows again into the low-pressure side leading path (82) together with the low-pressure refrigerant out of the lubricant oil separated from the refrigerant.

In the seventh and eighth aspects of the present invention, the lubricant oil is collected in the oil separator (70) arranged downstream of the expander (30). Accordingly, the amount of the lubricant oil can be reduced which flows in a part of the refrigerant circuit (11) which ranges from the oil separator (70) to the suction side of the compressor (20). A heat exchanger for heat absorption is provided in the part of the refrigerant circuit (11) which ranges from the oil separator (70) to the compressor (20). Hence, in these aspects, the situation that the lubricant oil inhibits absorption of the heat of the refrigerant in the heat exchanger for heat absorption can be suppressed, thereby allowing the heat exchanger to exert its performance fully.

In the ninth aspect of the present invention, the lubricant oil in the compressor casing (24) is supplied to the oil reservoir (37) in the expander casing (34) after being cooled by the oil cooling heat exchanger (90). As described above, in the refrigerant circuit (11), it is desirable for securing the absorption amount of the heat of the refrigerant in the heat exchanger for heat absorption to set the enthalpy of the refrigerant flowing out from the expander (30) low as far as possible. In this aspect, since the lubricant oil in the compressor casing (24) flows into the expander casing (34) after being cooled, the amount of heat that invades the refrigerant expanded in the expansion mechanism (31) can be reduced to suppress the enthalpy of the refrigerant flowing out from the expander (30) low. Hence, in the present aspect, the absorption amount of the heat of the refrigerant in the heat exchanger for heat absorption can be secured sufficiently.

In the tenth, fourteenth, and fifteenth aspects of the present invention, the lubricant oil is collected in the oil separator (60) arranged downstream of the compressor (20). Accordingly, the amount of the lubricant can be reduced which flows in a part of the refrigerant circuit (11) which ranges from the oil separator (60) to the inflow side of the expander (30). A heat exchanger for heat radiation is provided in the part of the refrigerant circuit (11) which ranges from the oil separator (60) to the expander (30). Hence, in these aspects, the situation that the lubricant oil inhibits heat radiation of the refrigerant in the heat exchanger for heat radiation can be suppressed, thereby allowing the heat exchanger to exert its performance fully.

In the twelfth and thirteenth aspects of the present invention, part or all of the high-pressure refrigerant discharged from the compressor (20) is introduced into the internal space of the expander casing (34), and the lubricant oil and the high-pressure refrigerant are separated from each other by utilizing the generator (33) provided there. Accordingly, the lubricant oil discharged from the compressor (20) together with the high-pressure refrigerant can be collected in the expander casing (34), so that the amount of the lubricant oil reserved in the expander casing (34) can be secured effortlessly.

Further in the twelfth and thirteenth aspects of the present invention, the high-pressure refrigerant and the lubricant oil are separated from each other in the expander casing (34) to reduce the amount of the lubricant oil flowing out from the expander casing (34) together with the high-pressure refrigerant through the high-pressure side leading path (87). Hence, in these aspects, likewise in the tenth aspect, the situation that the lubricant oil inhibits the heat radiation of the refrigerant in the heat exchanger for heat radiation is suppressed to allow the heat exchanger to exert its performance fully.

Further, in the thirteenth aspect of the present invention, the high-pressure refrigerant flowing in the expander casing (34) passes through the generator (33) from below upward while the lubricant oil separated from the refrigerant when passing through the generator (33) drops from above downward. Namely, in this aspect, the direction in which the high-pressure refrigerant flows is reverse to the direction in which the lubricant oil separated from the high-pressure refrigerant flows in the internal space of the expander casing (34). Accordingly, in this aspect, the amount of part of the lubricant oil can be reduced further definitely which flows together with the high-pressure refrigerant again into the high-pressure side leading path (87) out of the lubricant oil separated from the high-pressure refrigerant.

In the sixteenth aspect of the present invention, the lubricant oil is collected in the oil separator (75) arranged upstream of the compressor (20) to reduce the amount of the lubricant oil sucked into the compression mechanism (21) together with the refrigerant. Hence, in the present aspect, likewise in the fifth and sixth aspects, the compressor (20) can exert its performance fully.

INDEX OF REFERENCE NUMERALS

Figure 1:
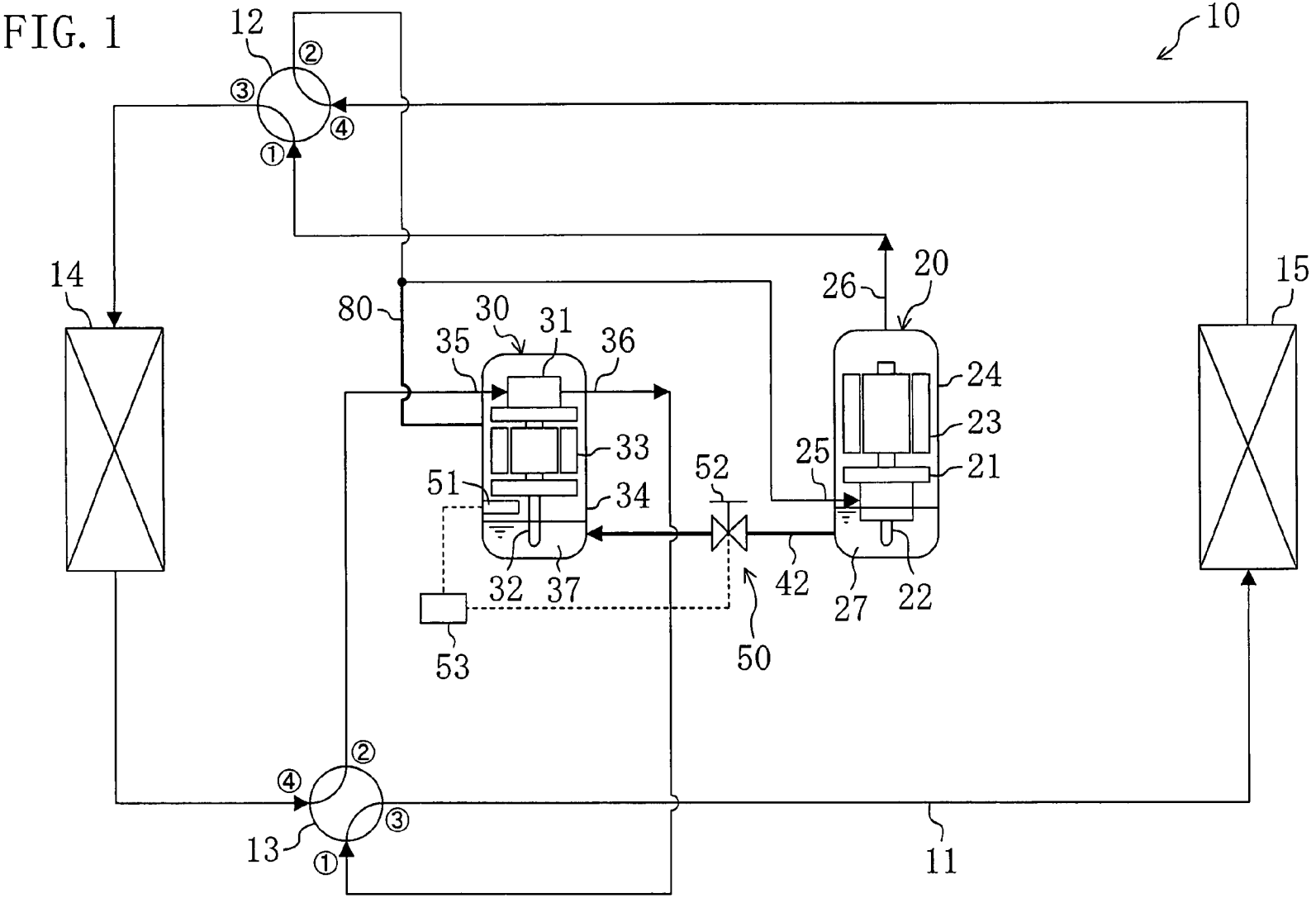
FIG. 1 is a refrigerant circuit diagram showing a construction of a refrigerant circuit and the flow of refrigerant in a cooling operation in accordance with Embodiment 1.

10 air conditioner (refrigerating apparatus)
11 refrigerant circuit
20 compressor
21 compression mechanism
22 drive shaft (oil supply mechanism)
24 compressor casing
27 oil reservoir
30 expander
31 expansion mechanism
32 output shaft (oil supply mechanism)
33 generator
34 expander casing
37 oil reservoir
42 oil pipe (oil distribution path)
50 adjusting means
51 oil level sensor (oil level detector)
52 oil amount adjusting valve (control valve)
60 oil separator
61 oil return pipe (oil return path)
62 oil return pipe (oil return path)
70 oil separator
71 oil return pipe (oil return path)
72 oil return pipe (oil return path)
75 oil separator
77 oil return pipe (oil return path)
80 low-pressure side communication pipe (low-pressure side communication path)

81 low-pressure side introduction pipe (low-pressure side introduction path)
82 low-pressure side leading pipe (low-pressure side leading path)
85 high-pressure side communication pipe (high-pressure side communication path)
86 high-pressure side introduction pipe (high-pressure side introduction path)
87 high-pressure side leading pipe (high-pressure side leading path)
90 oil cooling heat exchanger

BEST MODE FOR CARRYING OUT THE INVENTION

Embodiments of the present invention will be described below in detail with reference to the accompanying drawings.

Embodiment 1 of the Invention

Embodiment 1 of the present invention will be described. The present embodiment is directed to an air conditioner (10) composed of a refrigerating apparatus in accordance with the present invention.

Figure 2:
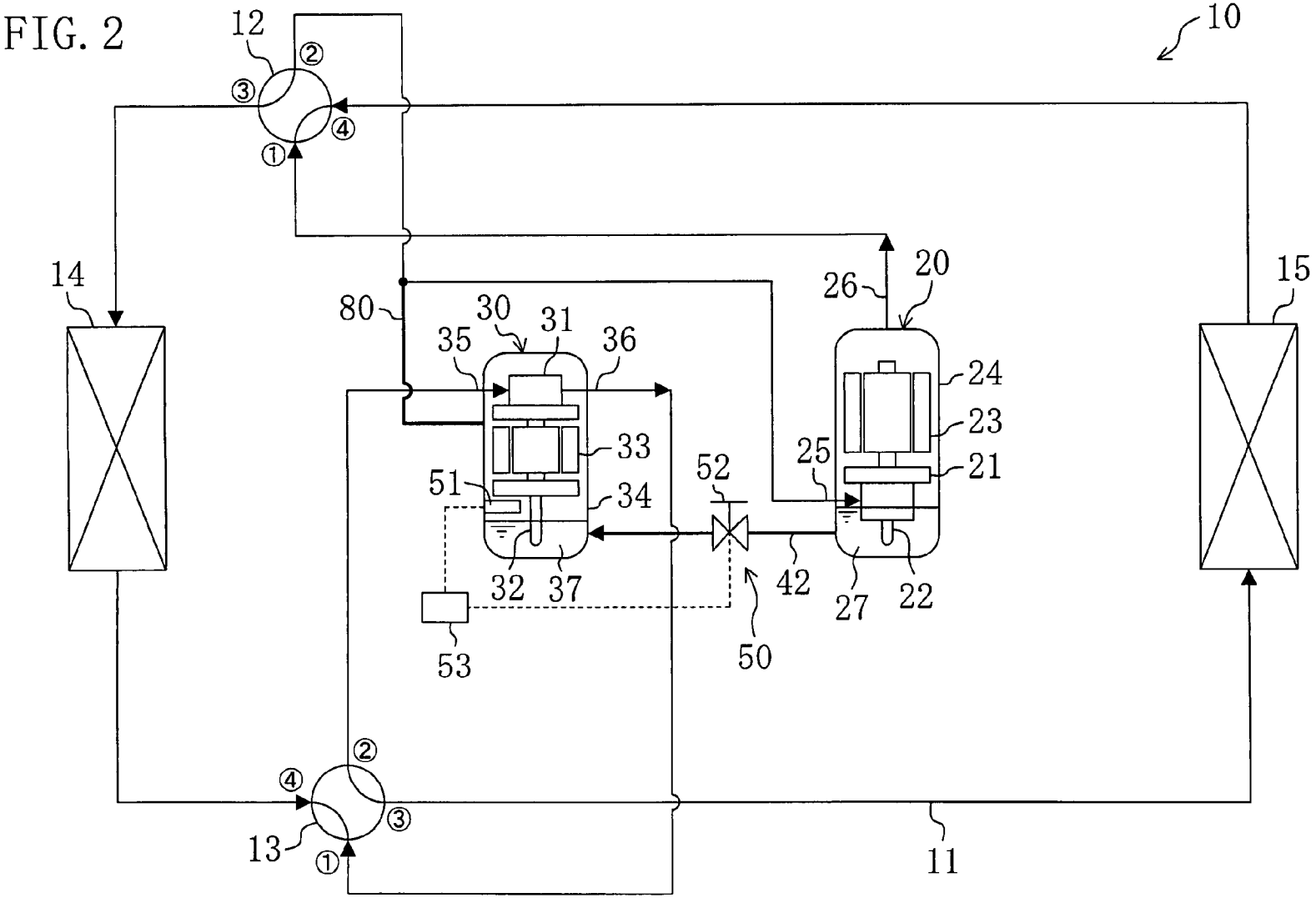
FIG. 2 is a refrigerant circuit diagram showing a construction of the refrigerant circuit and the flow of refrigerant in a heating operation in accordance with Embodiment 1.

As shown in FIG. 1 and FIG. 2, the air conditioner (10) of the present embodiment includes a refrigerant circuit (11). To the refrigerant circuit (11), there are connected a compressor (20), an expander (30), an outdoor heat exchanger (14), an indoor heat exchanger (15), a first four-wary switching valve (12), and a second four-way switching valve (13). Carbon dioxide ($CO_2$) is filled in the refrigerant circuit (11) as a refrigerant. The compressor (20) and the expander (30) are arranged at almost the same level.

A construction of the refrigerant circuit (11) will be described. The compressor (20) includes a discharge pipe (26) connected to the first port of the first four-way switching valve (12) and a suction pipe (25) connected to the second port of the first four-way switching valve (12). The expander (30) includes an outflow pipe (36) connected to the first port of the second four-way switching valve (13) and an inflow pipe (35) connected to the second port of the second four-way switching valve (13). The outdoor heat exchanger (14) is connected at one end thereof to the third port of the first four-way switching valve (12) while being connected at the other end thereof to the fourth port of the second four-way switching valve (13). The indoor heat exchanger (15) is connected at one end thereof to the third port of the second four-way switching valve (13) while being connected at the other end thereof to the fourth port of the first four-way switching valve (12).

In the refrigerant circuit (11), a low-pressure side communication pipe (80) is provided, which is connected at one end thereof to a pipe connecting the suction pipe (25) of the compressor (20) and the second port of the first four-way switching valve (80) and is connected at the other end thereof to the expander (30). The low-pressure side communication pipe (80) composes a low-pressure side communication path.

The outdoor heat exchanger (14) is an air heat exchanger for heat exchange between the refrigerant and outdoor air. The indoor heat exchanger (15) is an air heat exchanger for heat exchange between the refrigerant and indoor air. Each of the first four-way switching valve (12) and the second four-way switching valve (13) is switched between the state shown in FIG. 1 in which the first port and the third port communicate with each other while the second port and the fourth port communicate with each other and the state shown in FIG. 2 in which the first port and the fourth port communicate with each other while the second port and the third port communicate with each other.

Figure 3:
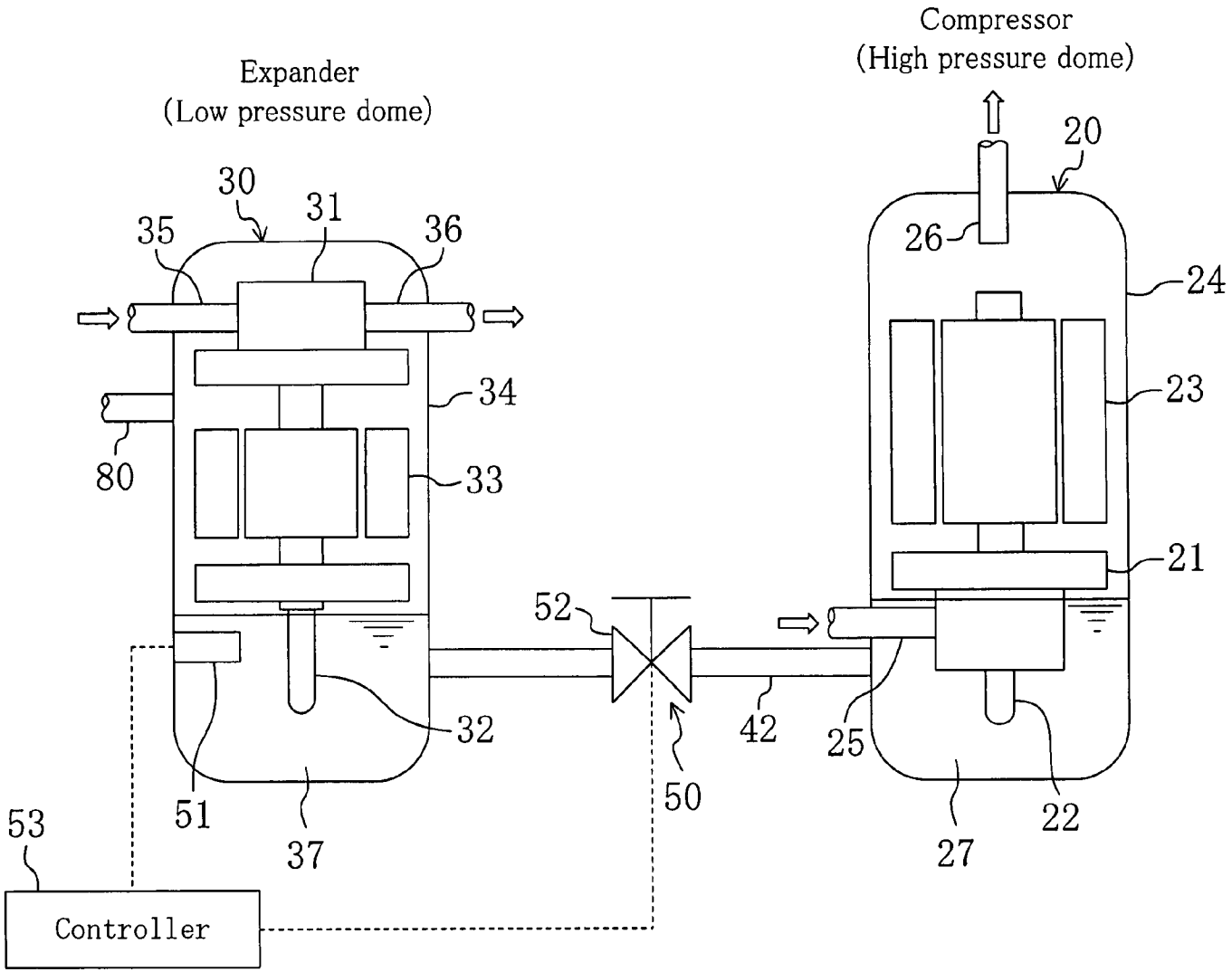
FIG. 3 is an enlarged view of a main part of the refrigerant circuit in accordance with Embodiment 1.

As also shown in FIG. 3, the compressor (20) is a generally-called hermetic compressor of high pressure dome type. The compressor (20) includes a vertically cylindrical compressor casing (24). Inside the compressor casing (24), there are housed a compression mechanism (21), a motor (23), and a drive shaft (22). The compression mechanism (21) is a generally-called rotary positive displacement fluid machinery. The motor (23) is arranged above the compression mechanism (21) in the compressor casing (24). The drive shaft (22) is arranged vertically to connect the compression mechanism (21) and the motor (23).

The suction pipe (25) and the discharge pipe (26) are provided at the compressor casing (24). The suction pipe (25) passes through the lower part of the compressor casing (24), and the terminal end thereof is connected directly to the compression mechanism (21). The discharge pipe (26) passes through the top of the compressor casing (24), and the start end thereof is opened to the space above the motor (23) in the compressor casing (24). The compression mechanism (21) compresses the refrigerant sucked from the suction pipe (25) and discharges it to the compressor casing (24).

In the bottom of the compressor casing (24), refrigerator oil is reserved as a lubricant oil. Namely, an oil reservoir (27) is formed within the compressor casing (24).

The drive shaft (22) composes an oil supply mechanism for supplying the refrigerator oil from the oil reservoir (27) to the compression mechanism (21). Though not shown, an axially extending oil supply path is formed inside the drive shaft (22). The oil supply path is opened at the lower end of the drive shaft (22) and serves as a generally-called centrifugal pump. The lower end of the drive shaft (22) is dipped in the oil reservoir (27). When the drive shaft (22) is rotated, the refrigerator oil is sucked by the operation of the centrifugal pump from the oil reservoir (27) into the oil supply path. The refrigerator oil sucked in the oil supply path is supplied to the compression mechanism (21) for lubrication of the compression mechanism (21).

The expander (30) includes a vertically cylindrical expander casing (34). Inside the expander casing (34), there are housed an expansion mechanism (31), a generator (33), and an output shaft (32). The expansion mechanism (31) is a generally-called rotary positive displacement fluid machinery. The generator (33) is arranged under the expansion mechanism (31) in the expander casing (34). The output shaft (32) is arranged vertically to connect the expansion mechanism (31) and the generator (33).

The inflow pipe (35) and the outflow pipe (36) are provided at the expander casing (34). Both the inflow pipe (35) and the outflow pipe (36) pass through the upper part of the expander casing (34). The terminal end of the inflow pipe (35) is connected directly to the expansion mechanism (31). The start end of the outflow pipe (36) is connected directly to the expansion mechanism (31). The expansion mechanism (31) expands the refrigerant flowing therein through the inflow pipe (35) and sends the expanded refrigerant to the outflow pipe (36). Namely, the refrigerant passing through the expander (30) passes through only the expansion mechanism (31) without flowing into the internal space of the expander casing (34).

In the bottom of the expander casing (34), refrigerator oil is reserved as the lubricant oil. Namely, an oil reservoir (37) is formed within the expander casing (34).

The output shaft (32) composes an oil supply mechanism for supplying the refrigerator oil from the oil reservoir (37) to the expansion mechanism (31). Though not shown, an axially extending oil supply path is formed inside the output shaft (32). The oil supply path is opened at the lower end of the output shaft (32) and serves as a generally-called centrifugal pump. The lower end of the output shaft (32) is dipped in the oil reservoir (37). When the output shaft (32) is rotated, the refrigerator oil is sucked by the operation of the centrifugal pump from the oil reservoir (37) into the oil supply path. The refrigerator oil sucked in the oil supply path is supplied to the expansion mechanism (31) for lubrication of the expansion mechanism (31).

The low-pressure side communication pipe (80) is connected to the expander casing (34). The end part of the low-pressure side communication pipe (80) is opened to a part of the internal space of the expander casing (34) which is located between the expansion mechanism (31) and the generator (33). The internal space of the expander casing (34) communicates with a pipe connected to the suction pipe (25) of the compressor (20) through the low-pressure side communication pipe (80).

An oil pipe (42) is provided between the compressor casing (24) and the expander casing (34). The oil pipe (42) composes an oil distribution path. One end of the oil pipe (42) is connected to the lower part of the side face of the compressor casing (24). The one end of the oil pipe (42) is opened to the internal space of the compressor casing (24) at a level a predetermined level higher than the lower end of the drive shaft (22). During the usual operation, the oil level in the oil reservoir (27) in the compressor casing (24) is higher than the one end of the oil pipe (42). On the other hand, the other end of the oil pipe (42) is connected to the lower part of the side face of the expander casing (34). The other end of the oil pipe (42) is opened to the internal space of the expander casing (34) at a level a predetermined level higher than the lower end of the output shaft (32). During the usual operation, the oil level in the oil reservoir (37) in the expander casing (34) is higher than the other end of the oil pipe (42).

The oil pipe (42) includes an oil amount adjusting valve (52). The oil amount adjusting valve (52) is a solenoid valve opening/closing according to a signal from outside. An oil level sensor (51) is housed inside the expander casing (34). The oil level sensor (51) detects the oil level in the oil reservoir (37) in the expander casing (34) and serves as an oil level detector. A controller (53) is provided in the refrigerating apparatus. The controller (53) serves as control means for controlling the oil amount adjusting valve (52) on the basis of an output signal of the oil level sensor (51).

In the present embodiment, adjusting means (50) for adjusting the flow state of the refrigerator oil in the oil pipe (42) is composed of the oil amount adjusting valve (52), the oil level sensor (51), and the controller (53). The oil amount adjusting valve (52) serves as a control valve operated according to the output of the oil level sensor (51).

—Driving Operation—

Driving operations of the air conditioner (10) will be described. Herein, description will be given first of the driving operations in a cooling operation and a heating operation of the air conditioner (10), and then, be given next of that in an operation for adjusting each oil amount in the compressor (20) and the expander (30).

<Cooling Operation>

During the cooling operation, the first four-way switching valve (12) and the second four-way switching valve (13) are set as shown in FIG. 1, and a vapor compression refrigeration cycle is performed by circulating the refrigerant in the refrigerant circuit (11). The high pressure of the refrigeration cycle performed in the refrigerant circuit (11) is set higher than the critical pressure of carbon dioxide, the refrigerant.

In the compressor (20), the motor (23) drives and rotates the compression mechanism (21). The compression mechanism (21) compresses the refrigerant sucked through the suction pipe (25) and discharge it into the compressor casing (24). The high-pressure refrigerant in the compressor casing (24) is discharged from the compressor (20) through the discharge pipe (26). The refrigerant discharged from the compressor (20) is sent to the outdoor heat exchanger (14) to radiate heat outdoors. The high-pressure refrigerant having radiated the heat in the outdoor heat exchanger (14) flows into the expander (30).

In the expander (30), the high-pressure refrigerant flowing in the expansion mechanism (31) through the inflow pipe (35) is expanded to drive and rotate the generator (33). The motive power generated by the generator (33) is supplied to the motor (23) of the compressor (20). The refrigerant expanded in the expansion mechanism (31) is sent out from the expander (30) through the outflow pipe (36). The refrigerant sent out from the expander (30) is sent to the indoor heat exchanger (15). In the indoor heat exchanger (15), the refrigerant flowing therein absorbs heat from indoor air to be evaporated, thereby cooling the indoor air. The low-pressure refrigerant flowing out from the indoor heat exchanger (15) flows into the suction pipe (25) of the compressor (20).

<Heating Operation>

During the heating operation, the first four-way switching valve (12) and the second four-way switching valve (13) are set as shown in FIG. 2, and a vapor compression refrigeration cycle is performed by circulating the refrigerant in the refrigerant circuit (11). Similarly to the cooling operation, the high pressure of this refrigeration cycle performed in the refrigerant circuit (11) is set higher than the critical pressure of carbon dioxide, the refrigerant.

In the compressor (20), the motor (23) drives and rotates the compression mechanism (21). The compression mechanism (21) compresses the refrigerant sucked through the suction pipe (25) and discharges it into the compressor casing (24). The high-pressure refrigerant in the compressor casing (24) is discharged from the compressor (20) through the discharge pipe (26). The refrigerant discharged from the compressor (20) is sent to the indoor heat exchanger (15). In the indoor heat exchanger (15), the refrigerant flowing therein radiates heat to indoor air to heat the indoor air. The high-pressure refrigerant having radiated the heat in the indoor heat exchanger (15) flows into the expander (30).

In the expander (30), the high-pressure refrigerant flowing in the expansion mechanism (31) through the inflow pipe (35) is expanded to drive and rotate the generator (33). The motive power generated by the generator (33) is supplied to the motor (23) of the compressor (20). The refrigerant expanded in the expansion mechanism (31) is sent out from the expander (30) through the outflow pipe (36). The refrigerant sent out from the expander (30) is sent to the outdoor heat exchanger (14). In the outdoor heat exchanger (14), the refrigerant flowing therein absorbs heat from outdoor air to be evaporated. The low-pressure refrigerant flowing out from the outdoor heat exchanger (14) flows into the suction pipe (25) of the compressor (20).

<Oil Amount Adjusting Operation>

First of all, during the operation of the compressor (20), the refrigerator oil is supplied from the oil reservoir (27) in the compressor casing (24) to the compression mechanism (21). While the refrigerator oil supplied to the compression mechanism (21) is utilized for lubrication of the compression mechanism (21), part of thereof is discharged together with the refrigerant into the internal space of the compressor casing (24). In the process of passing of the refrigerator oil discharged from the compression mechanism (21) together with the refrigerant through a slit between the rotor and the stator of the motor (23), a slit between the stator and the compressor casing (24), and the like, part thereof is separated from the refrigerant. The refrigerator oil separated from the refrigerant in the compressor casing (24) drops into the oil reservoir (27). On the other hand, the refrigerator oil not separated from the refrigerant flows outside the compressor (20) through the discharge pipe (26) together with the refrigerant.

During the operation of the expander (30), the refrigerator oil is supplied from the oil reservoir (37) in the expander casing (34) to the expansion mechanism (31). While the refrigerator oil supplied to the expansion mechanism (31) is utilized for lubrication of the expansion mechanism (31), part thereof is sent out from the expansion mechanism (31) together with the expanded refrigerant. The refrigerator oil sent out from the expansion mechanism (31) flows outside the expander (30) through the outflow pipe (36).

Thus, the refrigerator oil flows out from the compressor (20) and the expander (30) during the operation of the air conditioner (10). The refrigerator oil flowing out from the compressor (20) and the expander (30) is circulated in the refrigerant circuit (11) together with the refrigerant and is returned to the compressor (20) and the expander (30) again.

In the compressor (20), the refrigerator oil flowing in the refrigerant circuit (11) is sucked into the compression mechanism (21) through the suction pipe (25) together with the refrigerant. The refrigerator oil sucked in the compression mechanism (21) through the suction pipe (25) is discharged into the internal space of the compressor casing (24) together with the compressed refrigerant. As described above, part of the refrigerator oil discharged from the compression mechanism (21) together with the refrigerant is separated from the refrigerant when flowing in the internal space of the compressor casing (24) and is then returned to the oil reservoir (27). In other words, during the operation of the compressor (20), the refrigerator oil in the compressor casing (24) flows out through the discharge pipe (26) while at the same time the refrigerator oil sucked in the compression mechanism (21) through the suction pipe (25) is returned to the oil reservoir (27) in the compressor casing (24). Hence, the amount of the refrigerator oil reserved in the compressor casing (24) is secured in the compressor (20).

Referring to the expander (30), the refrigerator oil flowing in the refrigerant circuit (11) flows into the expansion mechanism (31) through the inflow pipe (35) together with the refrigerant. In contrast to that in the compressor (20), the refrigerant expanded in the expansion mechanism (31) is sent outside the expander casing (34) directly through the outflow pipe (36). Accordingly, the refrigerator oil flowing in the expansion mechanism (31) together with the refrigerant is sent outside the expander casing (34) directly through the outflow pipe (36). In other words, in the expander (30), while the refrigerator oil flowing in the refrigerant circuit (11) flows into the expansion mechanism (31), this refrigerant is sent out from the expander casing (34) without being returned to the oil reservoir (37) in the expander casing (34). Further, in the expander (30), the refrigerator oil supplied from the oil reservoir (37) in the expander casing (34) to the expansion mechanism (31) is sent out from the expander (30) together with the refrigerant. Accordingly, the amount of the refrigerator oil reserved in the expander casing (34) decreases gradually in the operation of the expander (30).

When the amount of the refrigerator oil reserved in the expander casing (34) decreases, the oil level in the oil reservoir (37) lowers accordingly. The controller (53) opens the oil amount adjusting valve (52) when it judges on the basis of the output signal from the oil level sensor (51) that the oil level in the oil reservoir (37) lowers up to or over a given level. When the oil amount adjusting valve (52) is opened, the oil reservoir (27) in the compressor casing (24) and the oil reservoir (37) in the expander casing (34) communicate with each other.

As described above, the refrigerant compressed in the compression mechanism (21) is discharged into the internal space of the compressor casing (24) in the compressor (20). Accordingly, the inner pressure of the compressor casing (24) is almost equal to the pressure of the refrigerant discharged from the compression mechanism (21), that is, the high pressure of the refrigeration cycle. On the other hand, in the expander (30), the low-pressure side communication pipe (80) is connected to the expander casing (34) while the internal space of the expander casing (34) communicates with a pipe connected to the suction pipe (25) of the compressor (20). Accordingly, the inner pressure of the expander casing (34) is almost equal to the pressure of the refrigerant sucked to the compressor (20), that is, the low pressure of the refrigeration cycle.

Thus, the inner pressure of the compressor casing (24) is higher than that of the expander casing (34), so that the refrigerator oil flows through the oil pipe (42) from the oil reservoir (27) in the compressor casing (24) toward the oil reservoir (37) in the expander casing (34) when the oil amount adjusting valve (52) is opened. Then, the controller (53) closes the oil amount adjusting valve (52) when it judges on the basis of the output signal of the oil level sensor (51) that the oil level in the oil reservoir (37) rises up to or over a given level.

Effects of Embodiment 1

In the present embodiment, the inner pressure of the compressor casing (24) is set higher than that of the expander casing (34) to supply the refrigerator oil from the oil reservoir (27) in the compressor casing (24) to the oil reservoir (37) in the expander casing (34) through the oil pipe (42). Accordingly, even when the refrigerator oil is distributed excessively to the compressor (20) in the operation of the air conditioner (10), the refrigerator oil can be supplied through the oil pipe (42) from the compressor (20) in which the refrigerator oil is excessive to the expander (30) in which the refrigerator oil is deficient. As a result, each amount of the refrigerator oil reserved in the compressor casing (24) and the expander casing (34) can be secured sufficiently to enable definite lubrication of the compression mechanism (21) and the expansion mechanism (31). Hence, in the present embodiment, damage of the compressor (20) and the expander (30) caused due to insufficient lubrication can be prevented to ensure the reliability of the air conditioner (10).

Herein, in the refrigerant circuit (11), a heat exchanger functioning as an evaporator is arranged downstream of the expander (30). It is desirable for securing the absorption amount of the heat of the refrigerant in the heat exchanger functioning as an evaporator to set the enthalpy of the refrigerant flowing out from the expander (30) low as far as possible. On the other hand, the refrigerant before being sucked into the compression mechanism (21) is lower in temperature than that after being compressed by the compression mechanism (21).

In the present embodiment, the expander casing (34) is connected through the low-pressure side communication pipe (80) to the pipe in which the low-pressure refrigerant to be sucked into the compressor (20) flows. Since the low-pressure refrigerant is comparatively low in temperature, the temperature inside the expander casing (34) is not so high. For this reason, the amount of heat that invades the refrigerant expanded in the compression mechanism (31) can be reduced, thereby suppressing the enthalpy of the refrigerant flowing out from the expander (30) low. Hence, in the present embodiment, the absorption amount of the heat of the refrigerant in a heat exchanger functioning as an evaporator can be secured sufficiently.

Modified Example 1 of Embodiment 1

Figure 4:
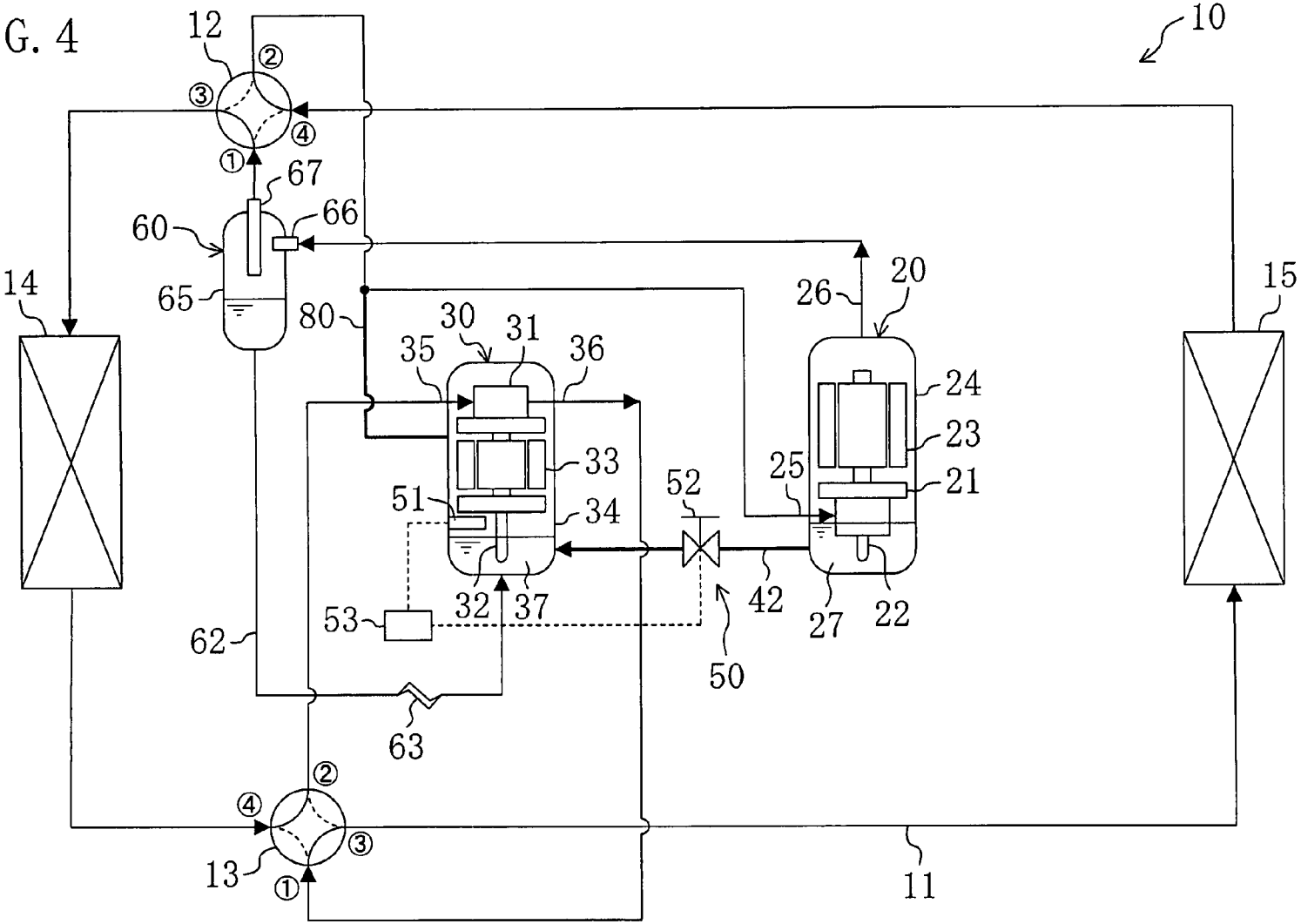
FIG. 4 is a refrigerant circuit diagram showing a construction of a refrigerant circuit in accordance with Modified Example 1 of Embodiment 1.

In the present embodiment, an oil separator (60) and an oil return pipe (62) may be added to the refrigerant circuit (11). Only the difference of an air conditioner (10) of the present modified example from that shown in FIG. 1 and FIG. 2 will be described herein. As shown in FIG. 4, the oil separator (60) is arranged on the discharge side of the compressor (20). The oil separator (60) separates the refrigerant and the refrigerator oil discharged from the compressor (20) from each other. Specifically, the oil separator (60) includes a body member (65) in a form of a vertically cylindrical sealed container. An inlet pipe (66) and an outlet pipe (67) are provided at the body member (65). The inlet pipe (66) protrudes transversely from the body member (65) so as to pass through the upper part of the side wall of the body member (65). The outlet pipe (67) protrudes upward from the body member (65) so as to pass through the top of the body member (65). The inlet pipe (66) of the oil separator (60) is connected to the discharge pipe (26) of the compressor (20) while the outlet pipe (67) thereof is connected to the first port of the first four-way switching valve (12).

The oil return pipe (62) connects the oil separator (60) and the expander (30) to form an oil return path. The oil return pipe (62) is connected at one end thereof to the bottom of the body member (65) of the oil separator (60) while being connected at the other end thereof to the bottom of the expander casing (34). A capillary tube (63) is provided in the middle of the oil return pipe (62) for reducing the pressure of the refrigerator oil. The internal space of the body member (65) of the oil separator (60) communicates with the oil reservoir (37) in the expander casing (34) through the oil return pipe (62).

An oil amount adjusting operation performed in the air conditioner (10) of the present modified example will be described.

The refrigerator oil discharged from the compressor (20) together with the refrigerant flows into the oil separator (60), is separated from the refrigerant, and is then reserved in the bottom of the body member (65). The refrigerator oil reserved in the body member (65) flows into the oil return pipe (62), is reduced in pressure in the capillary tube (63), and is then supplied to the oil reservoir (37) in the expander casing (34). On the other hand, the refrigerator oil flowing out from the expander (30) together with the refrigerant flows in the refrigerant circuit (11) together with the refrigerant and is then sucked into the compression mechanism (21) of the compressor (20). The refrigerator oil sucked in the compression mechanism (21) is discharged into the internal space of the compressor casing (24) together with the compressed refrigerant, and part thereof drops into the oil reservoir (27) in the compressor casing (24).

Thus, in the present modified example, the refrigerator oil flowing out from the compressor (20) is supplied into the expander casing (34) through the oil separator (60) and the oil return pipe (62) while the refrigerator oil flowing out from the expander (30) flows into the compressor casing (24), wherein part thereof is returned to the oil reservoir (37) in the expander casing (34) through the oil pipe (42).

Modified Example 2 of Embodiment 1

The oil separator (60) may be connected to the compressor casing (24) rather than to the expander casing (34) in the refrigerant circuit (11) of Modified Example 1. Only the difference of an air conditioner (10) of the present modified example from that of Modified Example 1 will be described.

Figure 5:
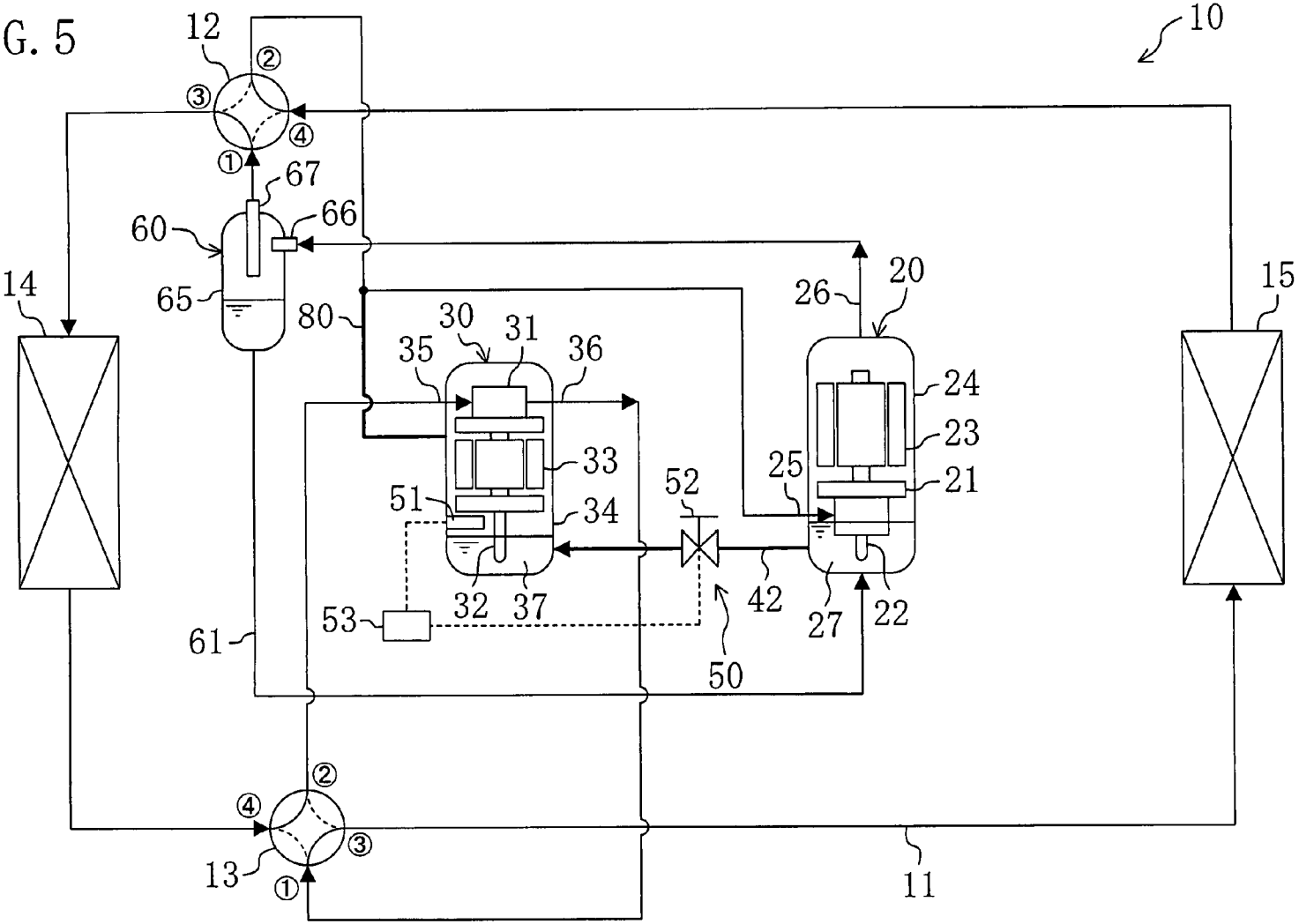
FIG. 5 is a refrigerant circuit diagram showing a construction of a refrigerant circuit in accordance with Modified Example 2 of Embodiment 1.

As shown in FIG. 5, in the refrigerant circuit (11) of the present modified example, the body member (65) of the oil separator (60) and the compressor casing (24) are connected to each other through the oil return pie (61). The oil return pipe (61) is connected at one end thereof to the bottom of the body member (65) of the oil separator (60) while being connected at the other end thereof to the bottom of the compressor casing (24). The oil return pipe (61) composes an oil return path for allowing the body member (65) of the oil separator (60) and the oil reservoir (27) in the compressor casing (24) to communicate with each other.

In the refrigerant circuit (11) of the present modified example, the refrigerator oil discharged from the compressor (20) together with the refrigerant is separated from the refrigerant in the oil separator (60) and is then returned to the oil reservoir (27) in the compressor casing (24) through the oil return pipe (61). The refrigerator oil flowing out from the expander (30) together with the refrigerant is sucked into the compression mechanism (21) of the compressor (20), and part thereof drops into the oil reservoir (27) in the compressor casing (24). Namely, both the refrigerator oil flowing out from the compressor (20) and the refrigerator oil flowing out from the expander (30) are collected in the oil reservoir (27) in the compressor casing (24), and the thus collected refrigerator oil is distributed from the oil reservoir (27) in the compressor casing (24) to the oil reservoir (37) in the expander casing (34) in the present modified example.

Modified Example 3 of Embodiment 1

In the present embodiment, an oil separator (75) and an oil pipe (62) may be added to the refrigerant circuit (11). Herein, only the difference of an air conditioner (10) of the present modified example from that shown in FIG. 1 and FIG. 2 will be described.

Figure 6:
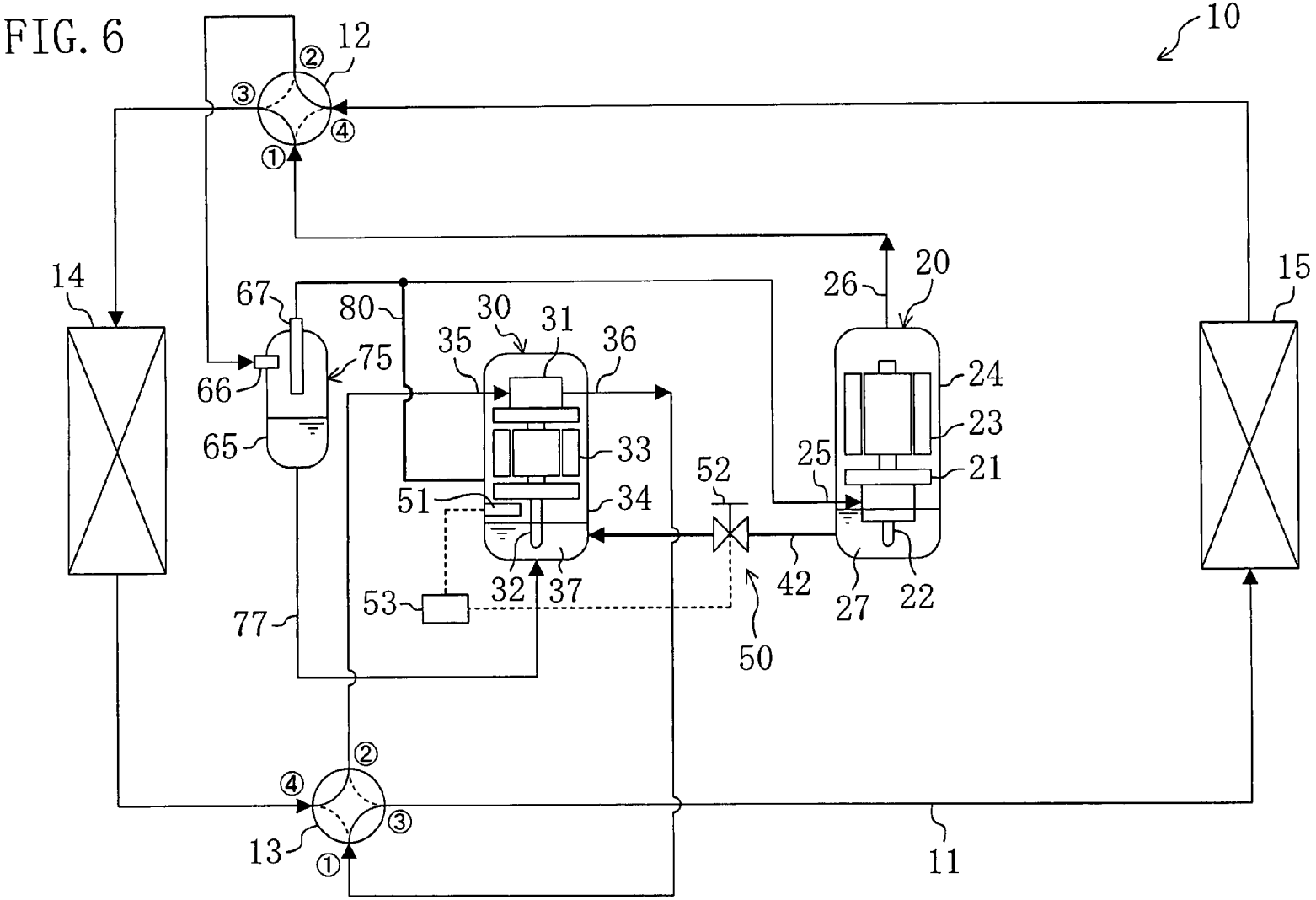
FIG. 6 is a refrigerant circuit diagram showing a construction of a refrigerant circuit in accordance with Modified Example 3 of Embodiment 1.

As shown in FIG. 6, the oil separator (75) is arranged on the suction side of the compressor (20). The oil separator (75) itself has the same construction as the oil separator (60) in Modified Example 1. Specifically, the oil separator (75) includes a body member (65), an inlet pipe (66), and an outlet pipe (67). The inlet pipe (66) of the oil separator (75) is connected to the second port of the first four-way switching valve (12) while the outlet pipe (67) thereof is connected to the suction pipe (25) of the compressor (20).

The oil return pipe (77) connects the oil separator (75) and the expander casing (34) to form an oil return pipe. The oil return pipe (77) is connected at one end thereof to the bottom of the body member (65) of the oil separator (75) while being connected at the other end thereof to the bottom of the expander casing (34). The internal space of the body member (65) of the oil separator (75) communicates with the oil reservoir (37) in the expander casing (34) through the oil return pipe (77).

In the refrigerant circuit (11) of the present modified example, the refrigerator oil discharged from the compressor (20) together with the refrigerant flows in the refrigerant circuit (11) then into the expansion mechanism (31) through the inflow pipe (35) of the expander (30). The refrigerator oil flowing in the expansion mechanism (31) flows out from the expander (30) through the outflow pipe (36) together with the refrigerator oil supplied from the oil reservoir (37) in the expander casing (34) to the expansion mechanism (31). The refrigerator oil flowing out from the expansion mechanism (31) flows in the refrigerant circuit (11) together with the refrigerant then into the oil separator (75).

Part of the refrigerator oil flowing in the body member (65) of the oil separator (75) is separated from the refrigerant and is then reserved in the bottom of the body member (65). The refrigerator oil reserved in the body member (65) is supplied to the oil reservoir (37) in the expander casing (34) through the oil return pipe (77). On the other hand, the refrigerant in the oil separator (75) flows into the compressor casing (24) through the suction pipe (25) of the compressor (20) together with the remaining refrigerator oil.

In the present modified example, the refrigerator oil is collected in the oil separator (75) arranged on the suction side of the compressor (20). Accordingly, the amount of the refrigerator oil flowing into the compressor casing (24) together with the refrigerant can be reduced. In other words, the amount of the refrigerator oil sucked into the compression mechanism (21) can be reduced. Since the volume of the fluid that the compression mechanism (21) can suck at one stroke of suction is determined, reduction in the amount of the lubricant oil sucked into the compression mechanism (21) together with the refrigerant results in an increase in the amount of the refrigerant sucked into the compression mechanism (21). Hence, the compressor (20) can exert its performance fully in the present embodiment.

Modified Example 4 of Embodiment 1

In the present embodiment, an oil separator (70) and an oil return pipe (72) may be added to the refrigerant circuit (11). Herein, only the difference of an air conditioner (10) in the present modified example from that shown in FIG. 1 and FIG. 2 will be described.

Figure 7:
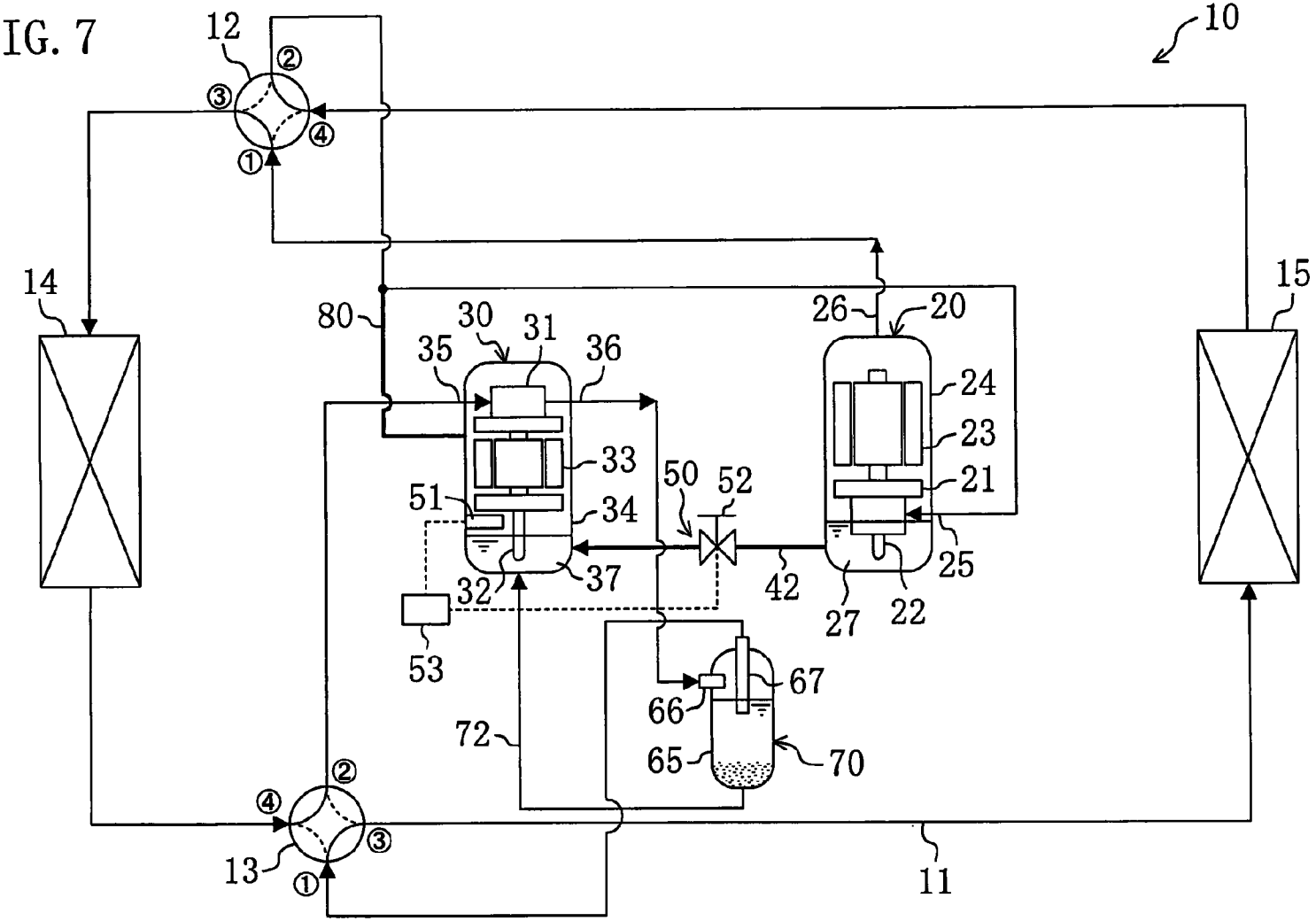
FIG. 7 is a refrigerant circuit diagram showing a construction of a refrigerant circuit in accordance with Modified Example 4 of Embodiment 1.

As shown in FIG. 7, the oil separator (70) is arranged on the outflow side of the expander (30). The oil separator (70) itself has the same construction as the oil separator (60) in Modified Example 1. Specifically, the oil separator (70) includes a body member (65), an inlet pipe (66), and an outlet pipe (67). The inlet pipe (66) of the oil separator (70) is connected to the outflow pipe (36) of the expander (30) while the outlet pipe (67) thereof is connected to the first port of the second four-way switching valve (13).

The oil return pipe (72) connects the oil separator (70) and the expander casing (34). The oil return pipe (72) is connected at one end thereof to the bottom of the body member (65) of the oil separator (70) while being connected at the other end thereof to the bottom of the expander casing (34). The oil return pipe (72) composes an oil return path for allowing the body member (65) of the oil separator (70) and the oil reservoir (37) in the expander casing (34) to communicate with each other.

In the refrigerant circuit (11) of the present modified example, the refrigerator oil discharged from the compressor (20) together with the refrigerant flows in the refrigerant circuit (11) then into the expansion mechanism (31) through the inflow pipe (35) of the expander (30). The refrigerator oil flowing in the expansion mechanism (31) flows out from the expander (30) through the outflow pipe (36) together with the refrigerator oil supplied to the expansion mechanism (31) from the oil reservoir (37) in the expander casing (34).

The refrigerator oil flowing out from the expander (30) flows into the body member (65) of the oil separator (70) together with the expanded refrigerant in a gas-liquid two-phase state. The mixture of the liquid refrigerant and the refrigerator oil is reserved in the bottom of the body member (65) while the gas refrigerant is reserved thereabove. The specific gravity of the refrigerator oil used in the refrigerant circuit (11) is larger than that of the liquid refrigerant. Accordingly, the ratio of the refrigerator oil becomes large as it goes down while the ratio of the liquid refrigerant becomes large as it goes up in such a liquid reservoir in the body member (65).

As described above, the oil return pipe (72) is connected to the bottom of the body member (65). The refrigerator oil present in the bottom of the liquid reservoir in the body member (65) is supplied to the oil reservoir (37) in the expander casing (34) through the oil return pipe (72). On the other hand, the outlet pipe (67) of the oil separator (70) is dipped at the lower end thereof in the liquid reserved in the body member (65). The liquid refrigerant present in the upper layer in the liquid reservoir of the body member (65) flows out from the body member (65) through the outlet pipe (67) and is then supplied to the indoor heat exchanger (15) in the cooling operation while on the other hand being supplied to the outdoor heat exchanger (14) in the heating operation.

Modified Example 5 of Embodiment 1

In the refrigerant circuit (11) of Modified Example 4, the oil separator (70) may be connected to the suction side of the compressor (20) rather than to the expander casing (34). Herein, only the difference of an air conditioner (10) of the present modified example from that of Modified Example 4 will be described.

Figure 8:
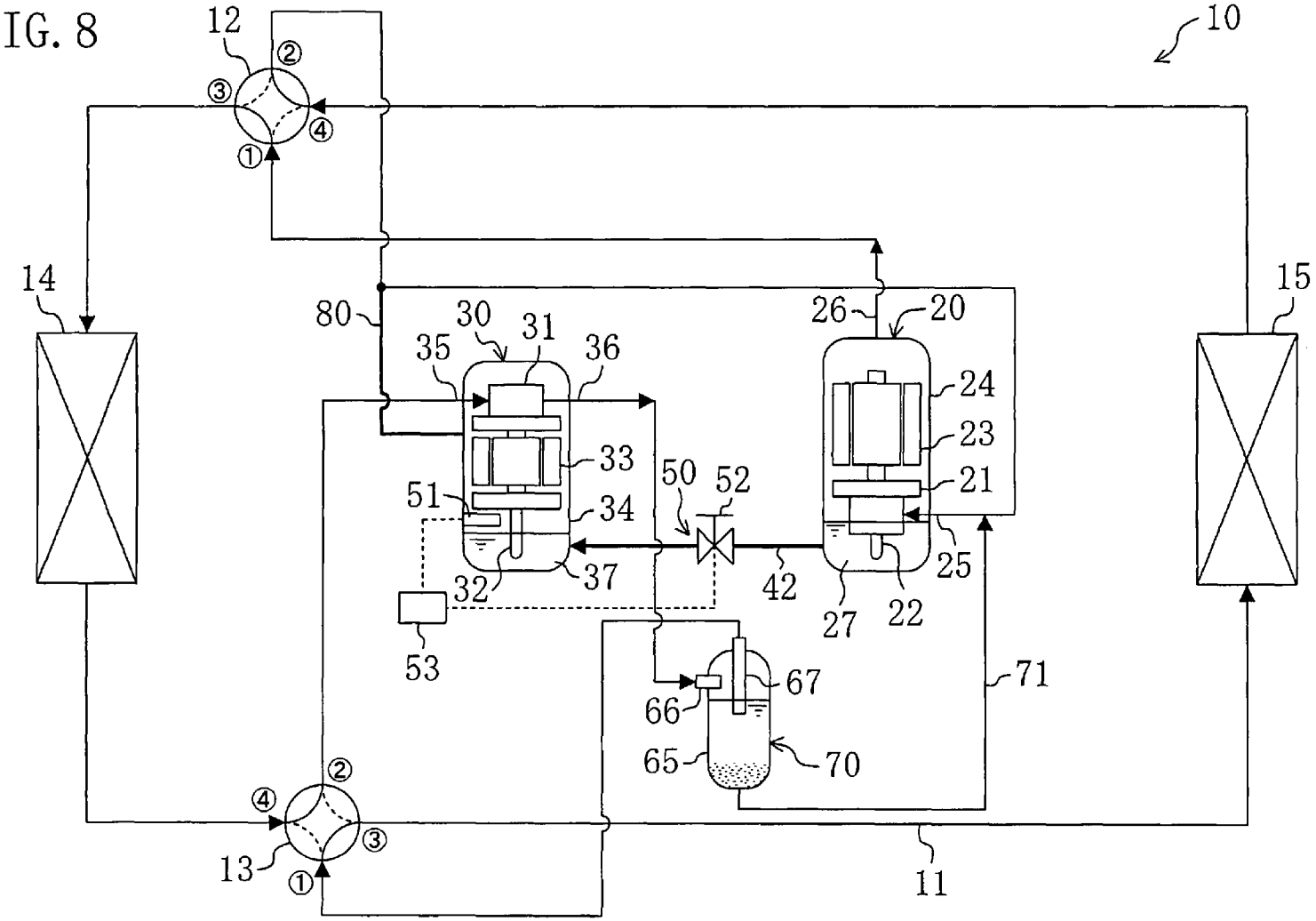
FIG. 8 is a refrigerant circuit diagram showing a construction of a refrigerant circuit in accordance with Modified Example 5 of Embodiment 1.

As shown in FIG. 8, the body member (65) of the oil separator (70) and the suction pipe (25) of the compressor (20) are connected to each other through the oil return pipe (71) in the refrigerant circuit (11) of the present modified example. The oil return pipe (71) is connected at one end thereof to the bottom of the body member (65) of the oil separator (70) while being connected at the other end thereof to a pipe connecting the suction pipe (25) of the compressor (20) and the second port of the first four-way switching valve (12). The oil return pipe (71) connects the oil separator (70) and the suction pipe (25) of the compressor (20) to form an oil return path.

The refrigerator oil reserved in the body member (65) of the oil separator (70) flows into the suction side of the compressor (20) through the oil return pipe (71) and is then sucked into the compression mechanism (21) through the suction pipe (25) together with the refrigerant. The refrigerator oil sucked in the compression mechanism (21) is discharged into the internal space of the compressor casing (24) together with the compressed refrigerant, and part thereof drops into the oil reservoir (27) in the compressor casing (24). Namely, in the present modified example, both the refrigerator oil flowing out from the compressor (20) and the refrigerator oil flowing out from the expander (30) are once collected in the oil reservoir (27) in the compressor casing (24), and the refrigerator oil is distributed from the oil reservoir (27) in the compressor casing (24) to the oil reservoir (37) in the expander casing (34).

Embodiment 2 of the Invention

Embodiment 2 of the present invention will be described. In an air conditioner (10) of the present embodiment, the construction of the refrigerant circuit (11) is changed from that in the Embodiment 1. Herein, only the difference of the air conditioner (10) of the present embodiment from that of Embodiment 1 will be described.

Figure 9:
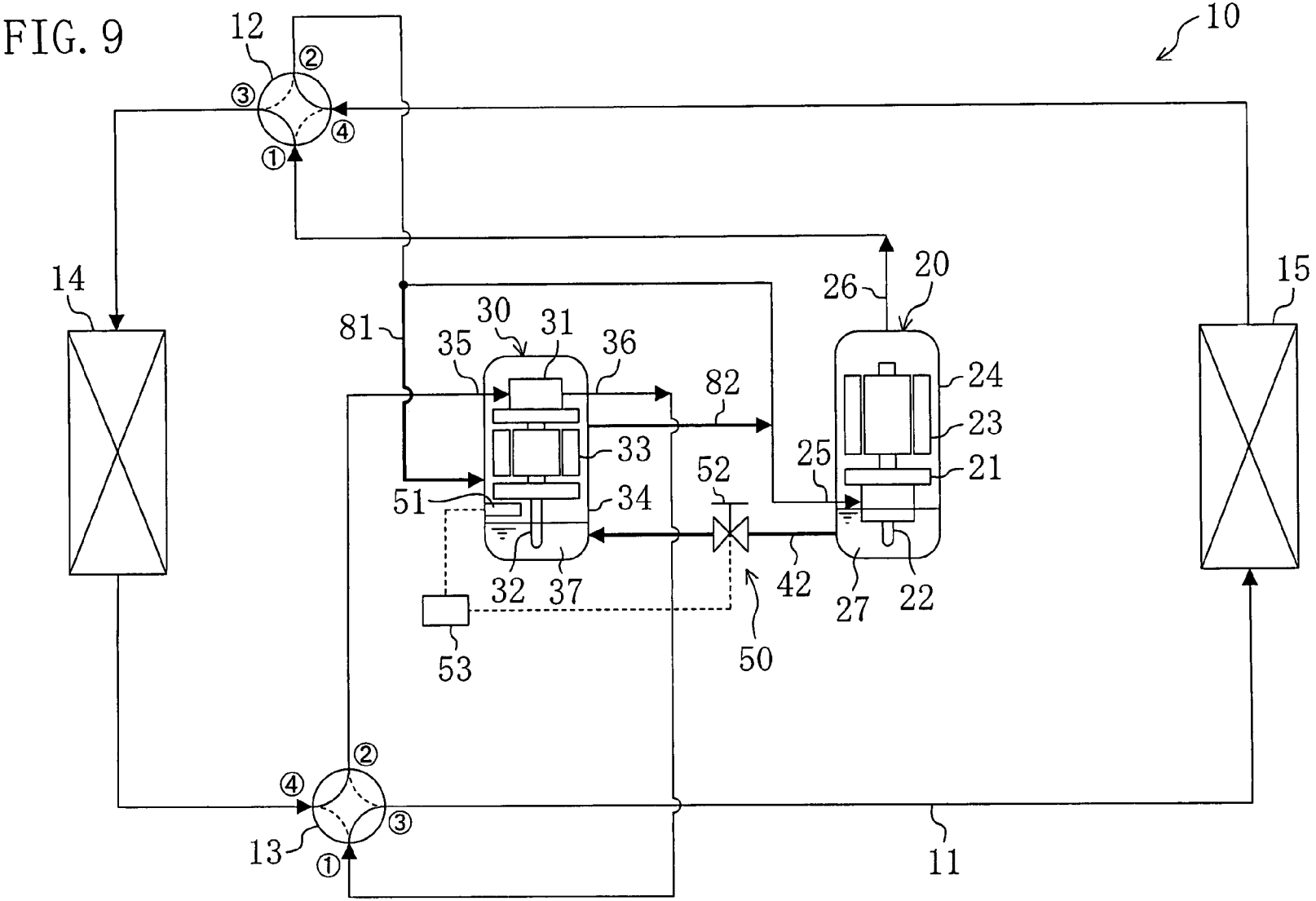
FIG. 9 is a refrigerant circuit diagram showing a construction of a refrigerant circuit in accordance with Embodiment 2.
Figure 10:
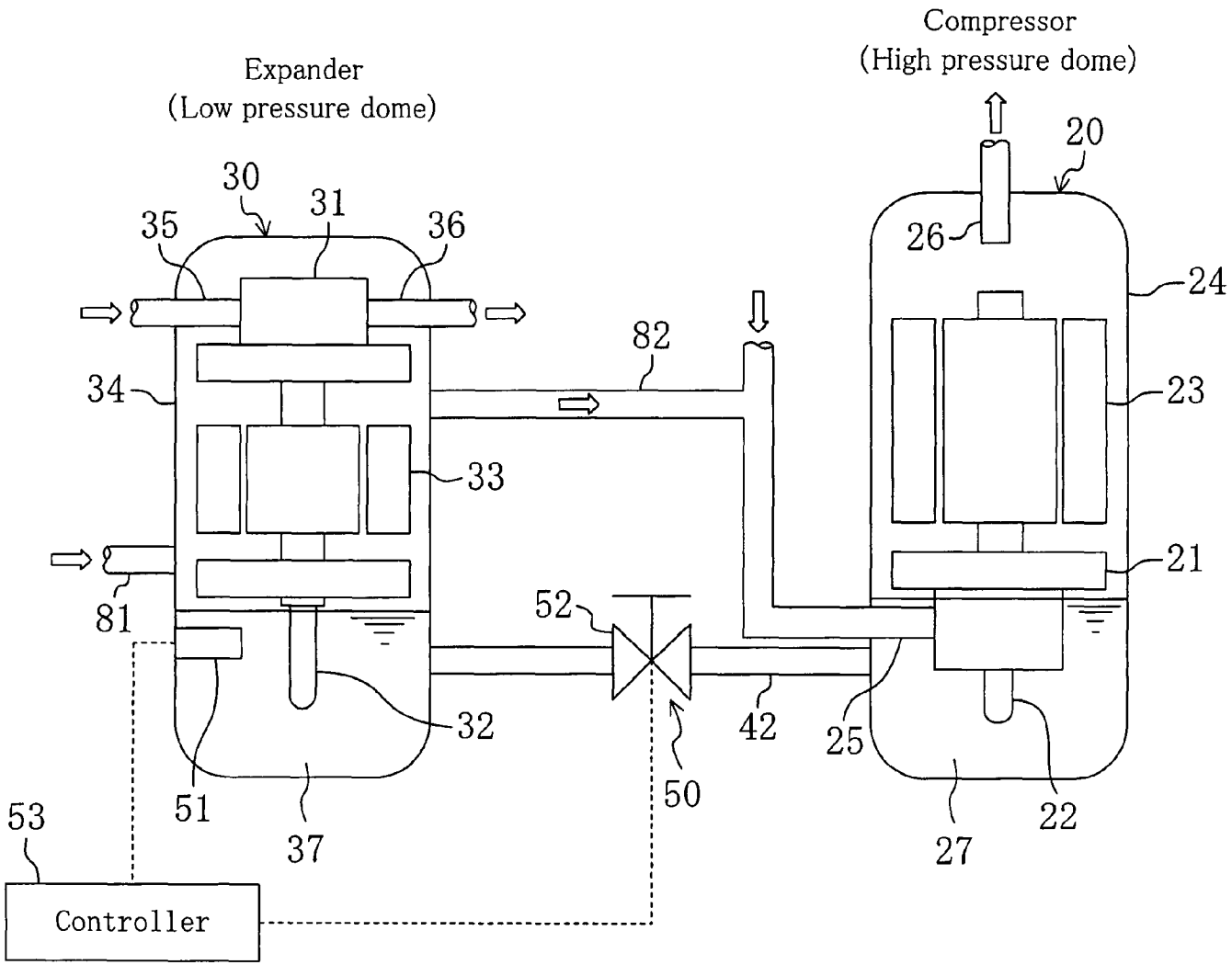
FIG. 10 is an enlarged view of a main part of the refrigerant circuit in accordance with Embodiment 2.

As shown in FIG. 9 and FIG. 10, a refrigerant circuit (11) of the present embodiment includes a low-pressure side introduction pipe (81) and a low-pressure side leading pipe (82). The low-pressure side communication pipe (80) in Embodiment 1 is omitted in this refrigerant circuit (11).

The low-pressure side introduction pipe (81) composes a low-pressure side introduction path. The start end of the low-pressure side introduction pipe (81) is connected to a pipe connecting the suction pipe (25) of the compressor (20) and the second port of the first four-way switching valve (12) while the terminal end thereof is connected to the expander casing (34). The terminal end of the low-pressure side introduction pipe (81) is opened to a part of the internal space of the expander casing (34) which is located lower than the generator (33).

The low-pressure side leading pipe (82) composes a low-pressure side leading path. The start end of the low-pressure side leading pipe (82) is connected to the expander casing (34). The start end of the low-pressure side leading pipe (82) is opened to a part of the internal space of the expander casing (34) which is located between the expansion mechanism (31) and the generator (33). The terminal end of the low-pressure side leading pipe (82) is connected to a part of a pipe connecting the suction pipe (25) of the compressor (20) and the second port of the first four-way switching valve (12) which is located closer to the compressor (20) than the connection point of the pipe to the low-pressure side introduction pipe (81).

—Driving Operation—

Driving operations of the refrigerant circuit (11) of the present embodiment in the cooling operation and the heating operation are the same as those performed in the refrigerant circuit (11) of Embodiment 1 except the flowing path of the refrigerant to be sucked into the compressor (20) through the first four-way switching valve (12).

In the present embodiment, part of the refrigerant flowing out from one of the outdoor heat exchanger (14) and the indoor heat exchanger (15) whichever serves as an evaporator is sucked into the compressor (20) via the expander casing (34) while the other thereof is sucked into the compressor (20) directly.

Specifically, part of the low-pressure refrigerant having passed through the first four-way switching valve (12) flows into the expander casing (34) through the low-pressure side introduction pipe (81). The low-pressure refrigerant flowing in the expander casing (34) passes from blow upward through a slit formed between the rotor and the stator of the generator (33), a slit between the stator and the expander casing (34), and the like. In the process of this passing, the refrigerator oil flowing in the expander casing (34) together with the low-pressure refrigerant is separated from the refrigerant. The refrigerator oil separated from the refrigerant in the expander casing (34) drops into the oil reservoir (37). The low-pressure refrigerant having passed through the generator (33) flows into the low-pressure side leading pipe (82), is merged with the refrigerant flowing directly toward the compressor (20) from the first four-way switching valve (12), and is then sucked into the compressor (20).

Effects of Embodiment 2

The present embodiment can obtain the same effects as Embodiment 1. Further in the present embodiment, since part of the low-pressure refrigerant flowing toward the compressor (20) is sucked into the compressor (20) after passing through the expander casing (34), the amount of the refrigerator oil sucked in the compressor (20) together with the refrigerant can be reduced. Hence, according to the present embodiment, the amount of the refrigerant sucked in the compression mechanism (21) can be secured to allow the compressor (20) to exert its performance fully, as in the case of Modified Example 3 of Embodiment 1.

Herein, there is a case where all the liquid refrigerant cannot be evaporated according to the driving operation in one of the outdoor heat exchanger (14) and the indoor heat exchanger (15) whichever serves as an evaporator. If so, the liquid refrigerant is mixed with the low-pressure refrigerant flowing toward the compressor (20). In contrast, in the present embodiment, part of the low-pressure refrigerant flowing toward the compressor (20) passes through the generator (33) in the expander casing (34). Accordingly, the liquid refrigerant mixed with the low-pressure refrigerant absorbs heat generated by the generator (33) to be evaporated. Hence, according to the present embodiment, the possibility that the liquid refrigerant is mixed with the refrigerant and is then sucked into the compressor (20) can be reduced to suppress danger that the compressor (20) is broken by generally-called wet vapor suction. In other words, the expander casing (34) can be utilized as an accumulator.

Further in the present embodiment, part of the low-pressure refrigerant flowing toward the suction side of the compressor (20) is introduced into the internal space of the expander casing (34) so that the refrigerator oil and the low-pressure refrigerant are separated from each other by utilizing the generator (33) provided there. This easily secures the amount of the refrigerator oil reserved in the expander casing (34).

Moreover, in the expander (30) in the present embodiment, the low-pressure refrigerant flowing in the expander casing (34) passes from below upward through the generator (33) while the refrigerator oil separated from the refrigerant when passing through the generator (33) drops from above downward. In other words, the direction in which the low-pressure refrigerant flows is reverse to the direction in which the refrigerator oil separated from the low-pressure refrigerant flows in the internal space of the expander casing (34). Accordingly, in the present embodiment, the amount of the refrigerator oil can be reduced further definitely which flows again to the low-pressure side leading pipe (82) together with the low-pressure refrigerant out of the refrigerator oil separated from the low-pressure refrigerant.

Furthermore, in the expander (30) in the present embodiment, the low-pressure refrigerant at comparatively low temperature passes through the internal space of the expander casing (34). This results in cooling of the generator (33) housed in the expander casing (34) by the low-pressure refrigerant to suppress efficiency lowering of the generator (33) which is caused due to temperature rise. Particularly, the low-pressure refrigerant flowing in the expander casing (34) through the low-pressure side introduction pipe (81) passes through the generator (33). Hence, the generator (33) can be cooled definitely by the low-pressure refrigerant in the present embodiment.

Modified Example 1 of Embodiment 2

Figure 11:
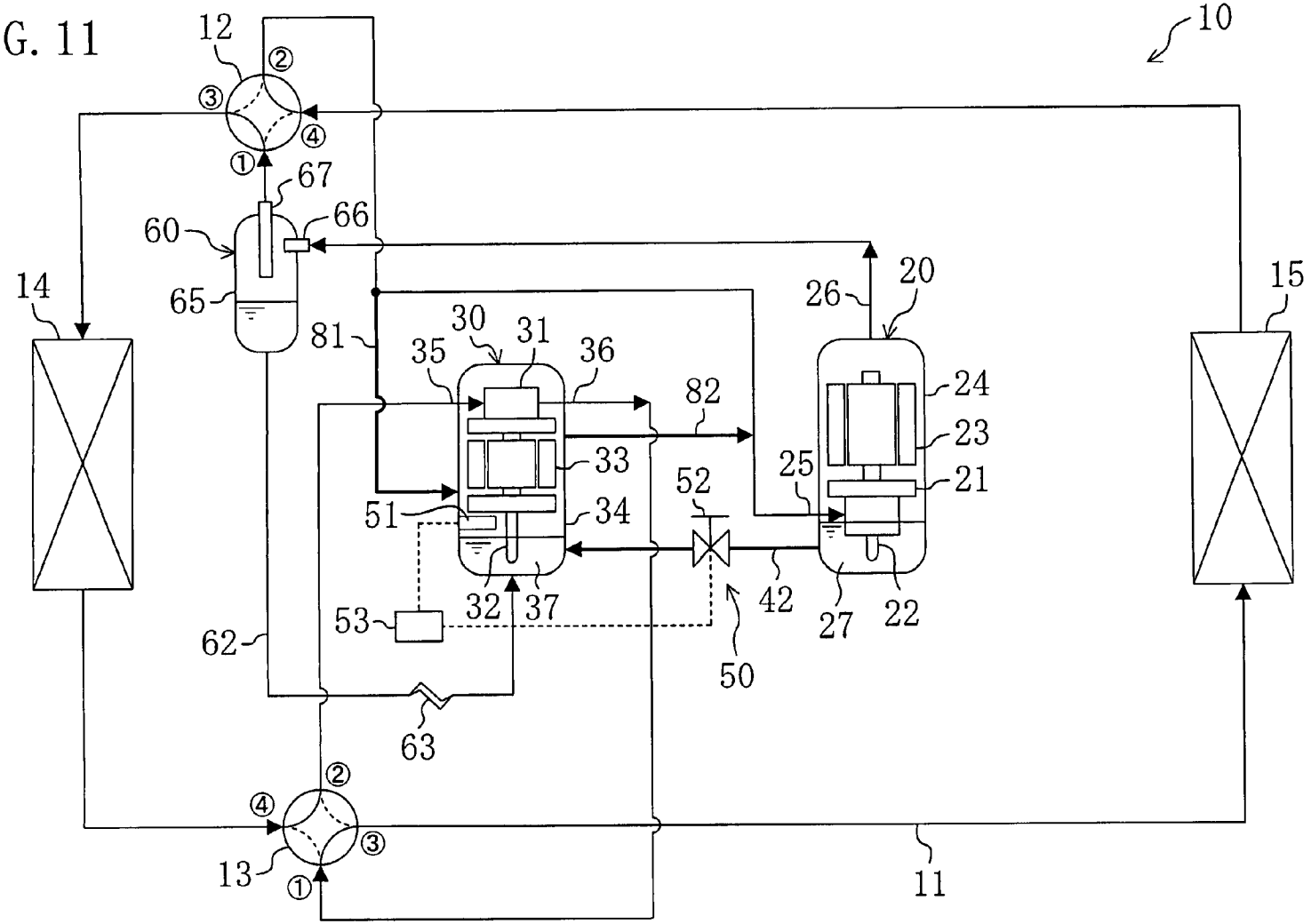
FIG. 11 is a refrigerant circuit diagram showing a construction of a refrigerant circuit in accordance with Modified Example 1 of Embodiment 2.

In the present embodiment, as shown in FIG. 11, an oil separator (60) may be provided on the discharge side of the compressor (20) in such a manner that the bottom of a body member (65) of the oil separator (60) is connected to the bottom of the expander casing (34) through an oil return pipe (62) in which a capillary tube (63) is provided for reducing the pressure of the refrigerator oil.

The difference of a refrigerant circuit (11) of the present modified example from the refrigerant circuit (11) shown in FIG. 9 is the same as the difference of the refrigerant circuit (11) of Modified Example 1 of Embodiment 1 (see FIG. 4) from the refrigerant circuit (11) shown in FIG. 1 and FIG. 2. Therefore, the description of Modified example 1 of Embodiment 1 is evoked as the description of the present modified example.

Modified Example 2 of Embodiment 2

Figure 12:
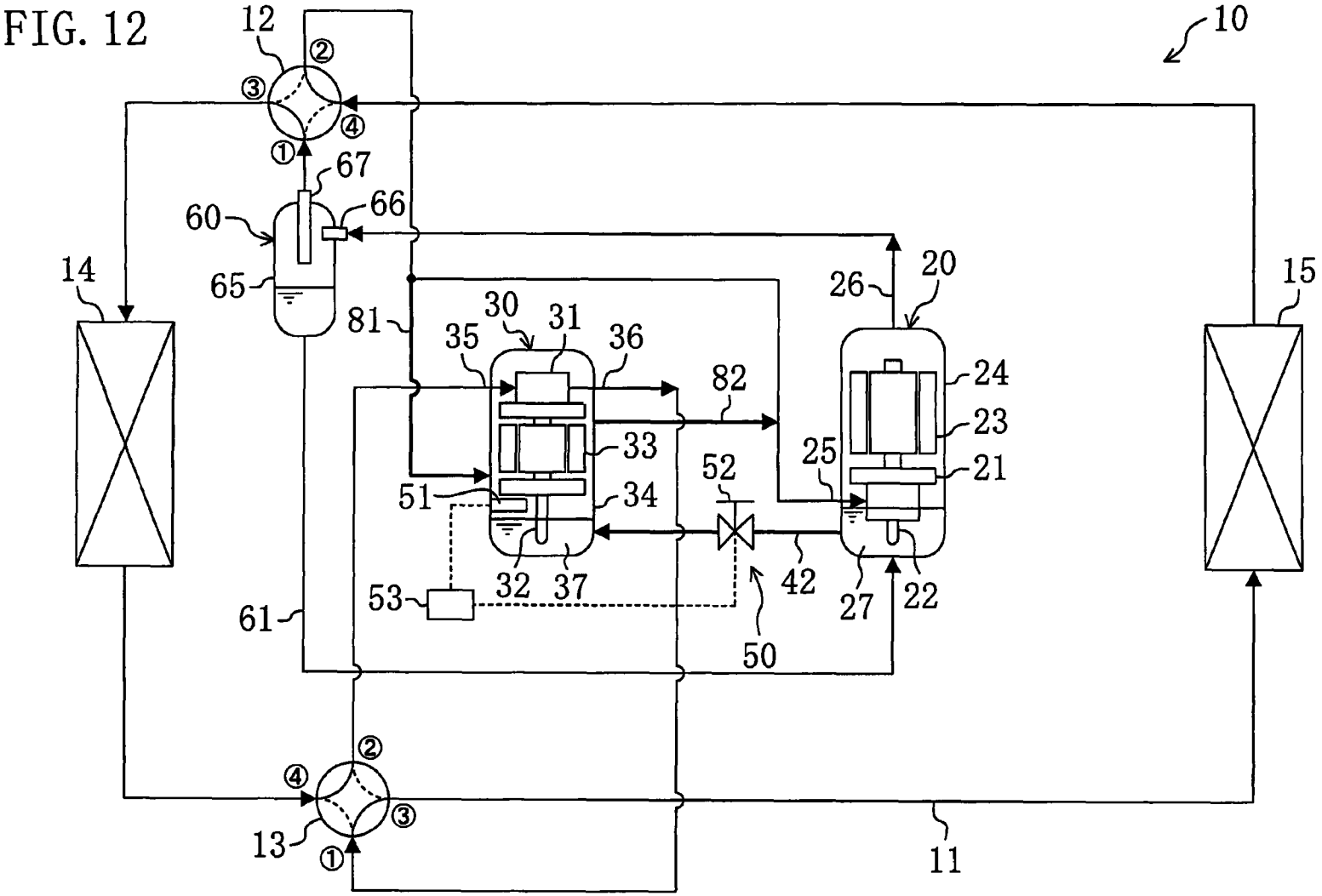
FIG. 12 is a refrigerant circuit diagram showing a construction of a refrigerant circuit in accordance with Modified Example 2 of Embodiment 2.

As shown in FIG. 12, an oil separator (60) may be provided on the discharge side of the compressor (20) in such a manner that the bottom of a body member (65) of the oil separator (60) is connected to the bottom of the compressor casing (24) through an oil return pipe (61) in the present embodiment.

The difference of a refrigerant circuit (11) of the present modified example from the refrigerant circuit (11) shown in FIG. 9 is the same as the difference of the refrigerant circuit (11) of Modified Example 2 of Embodiment 1 (see FIG. 5) from the refrigerant circuit (11) shown in FIG. 1 and FIG. 2. Therefore, the description of Modified example 2 of Embodiment 1 is evoked as the description of the present modified example.

Modified Example 3 of Embodiment 2

Figure 13:
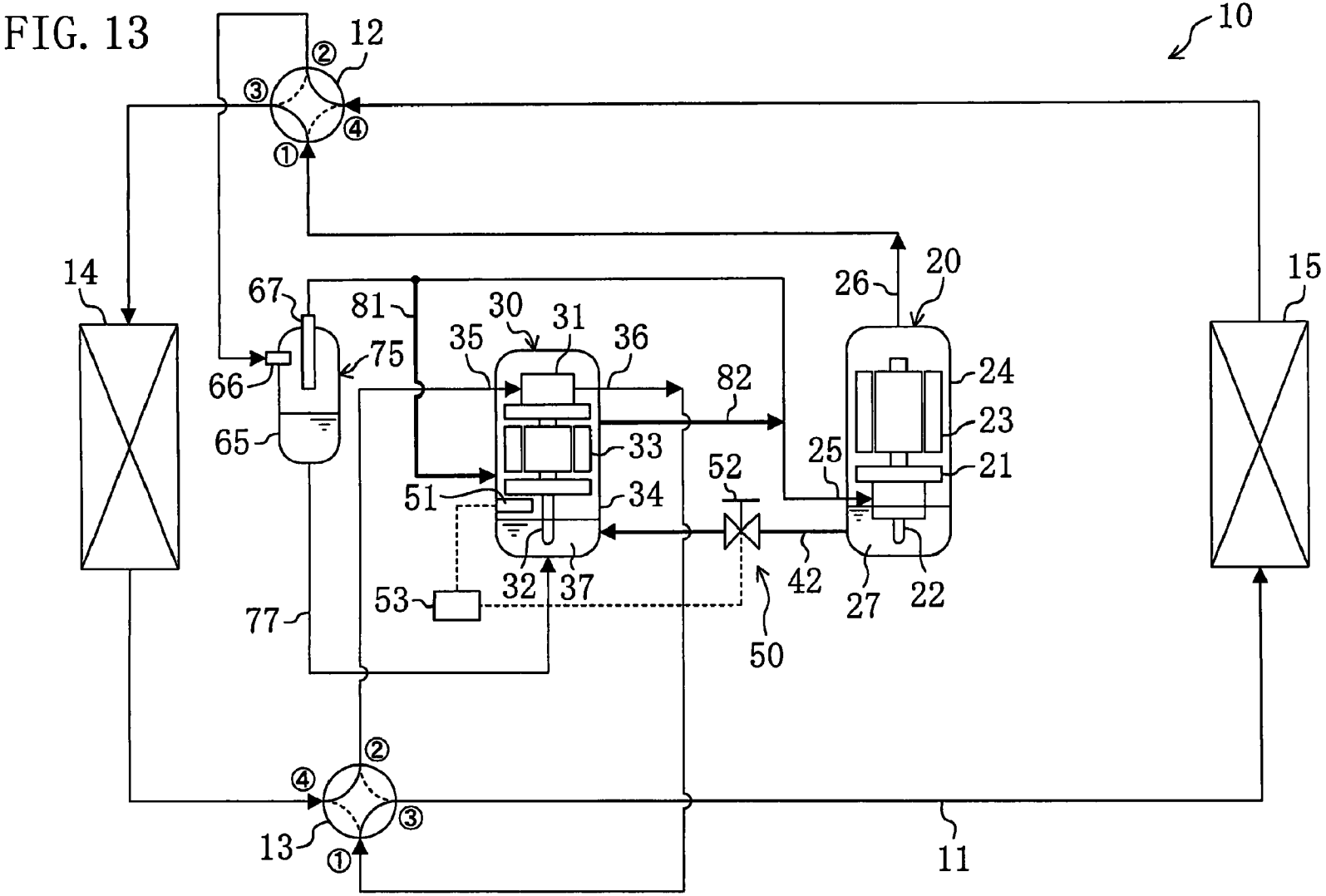
FIG. 13 is a refrigerant circuit diagram showing a construction of a refrigerant circuit in accordance with Modified Example 3 of Embodiment 2.

In the present embodiment, an oil separator (75) may be provided on the suction side of the compressor (20) in such a manner that the bottom of a body member (65) of the oil separator (75) is connected to the bottom of the expander casing (34) through an oil return pipe (77), as shown in FIG. 13.

The difference of a refrigerant circuit (11) of the present modified example from the refrigerant circuit (11) shown in FIG. 9 is the same as the difference of the refrigerant circuit (11) of Modified Example 3 of Embodiment 1 (see FIG. 6) from the refrigerant circuit (11) shown in FIG. 1 and FIG. 2. Therefore, the description of Modified example 3 of Embodiment 1 is evoked as the description of the present modified example.

Modified Example 4 of Embodiment 2

Figure 14:
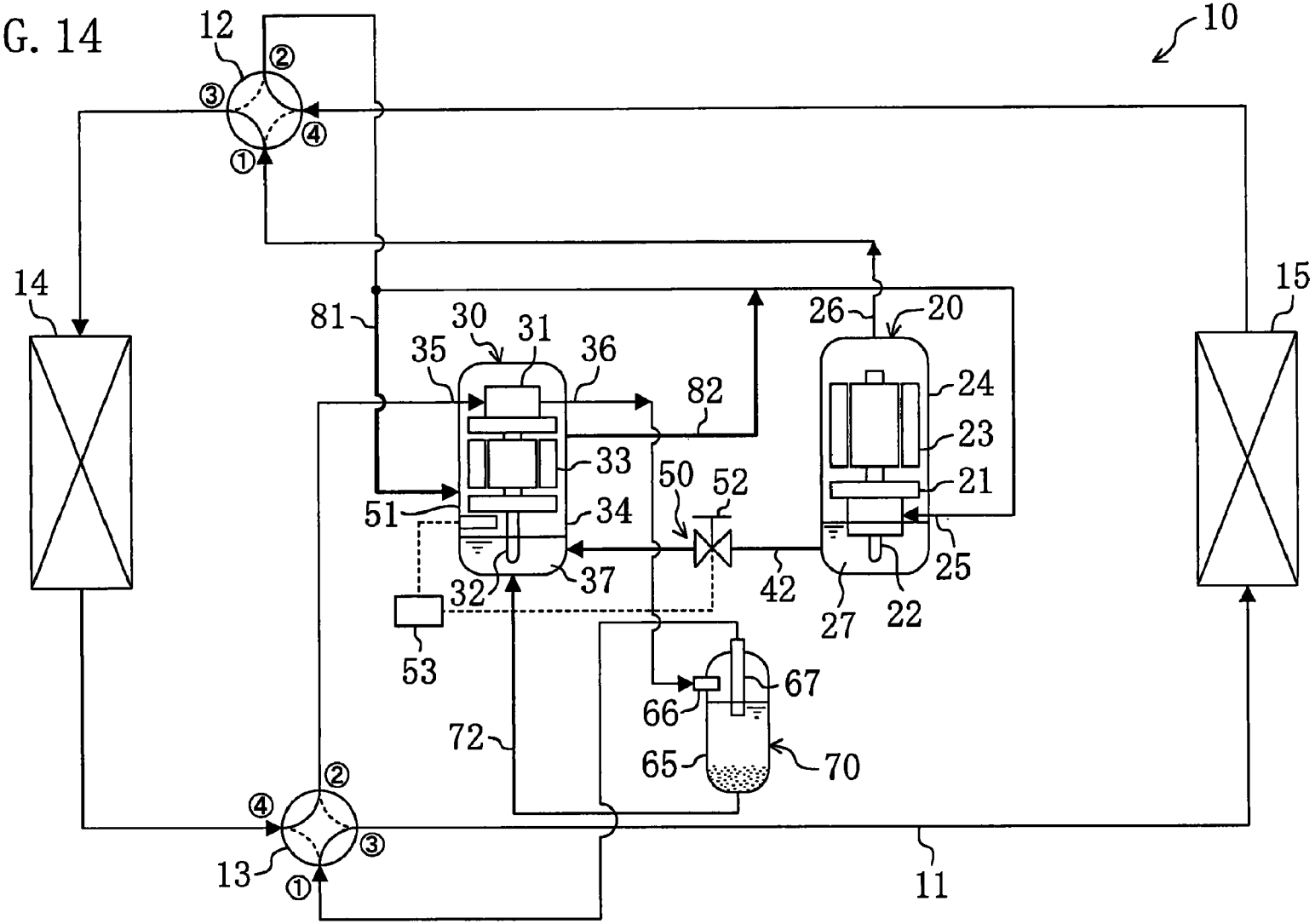
FIG. 14 is a refrigerant circuit diagram showing a construction of a refrigerant circuit in accordance with Modified Example 4 of Embodiment 2.

As shown in FIG. 14, in the present embodiment, an oil separator (70) may be provided on the outflow side of the expander (30) in such a manner that the bottom of a body member (65) of the oil separator (70) is connected to the bottom of the expander casing (34) through an oil return pipe (72).

The difference of a refrigerant circuit (11) of the present modified example from the refrigerant circuit (11) shown in FIG. 9 is the same as the difference of the refrigerant circuit (11) of Modified Example 4 of Embodiment 1 (see FIG. 7) from the refrigerant circuit (11) shown in FIG. 1 and FIG. 2. Therefore, the description of Modified example 4 of Embodiment 1 is evoked as the description of the present modified example.

Modified Example 5 of Embodiment 2

Figure 15:
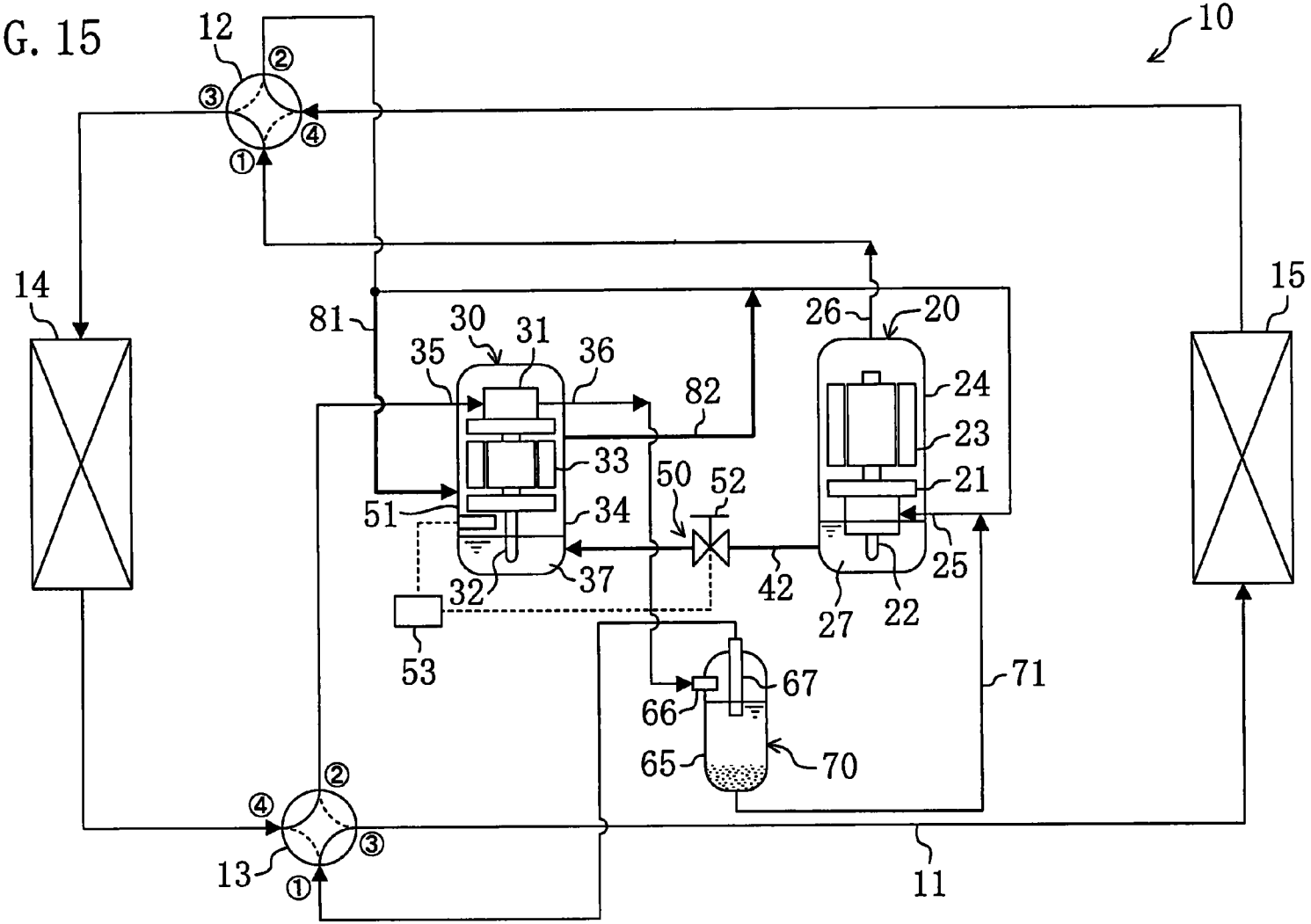
FIG. 15 is a refrigerant circuit diagram showing a construction of a refrigerant circuit in accordance with Modified Example 5 of Embodiment 2.

In the present embodiment, an oil separator (70) may be provided on the outflow side of the expander (30) in such a manner that the bottom of a body member (65) of the oil separator (70) is connected to the suction pipe (25) of the compressor (20) through an oil return pipe (71), as shown in FIG. 15.

The difference of a refrigerant circuit (11) of the present modified example from the refrigerant circuit (11) shown in FIG. 9 is the same as the difference of the refrigerant circuit (11) of Modified Example 5 of Embodiment 1 (see FIG. 8) from the refrigerant circuit (11) shown in FIG. 1 and FIG. 2. Therefore, the description of Modified example 5 of Embodiment 1 is evoked as the description of the present modified example.

Embodiment 3 of the Invention

Embodiment 3 of the present invention will be described. An air conditioner (10) of the present embodiment is one in which the construction of the refrigerant circuit (11) of embodiment 2 is changed. Only the difference of the air conditioner (10) of the present embodiment from that of Embodiment 2 will be described.

Figure 16:
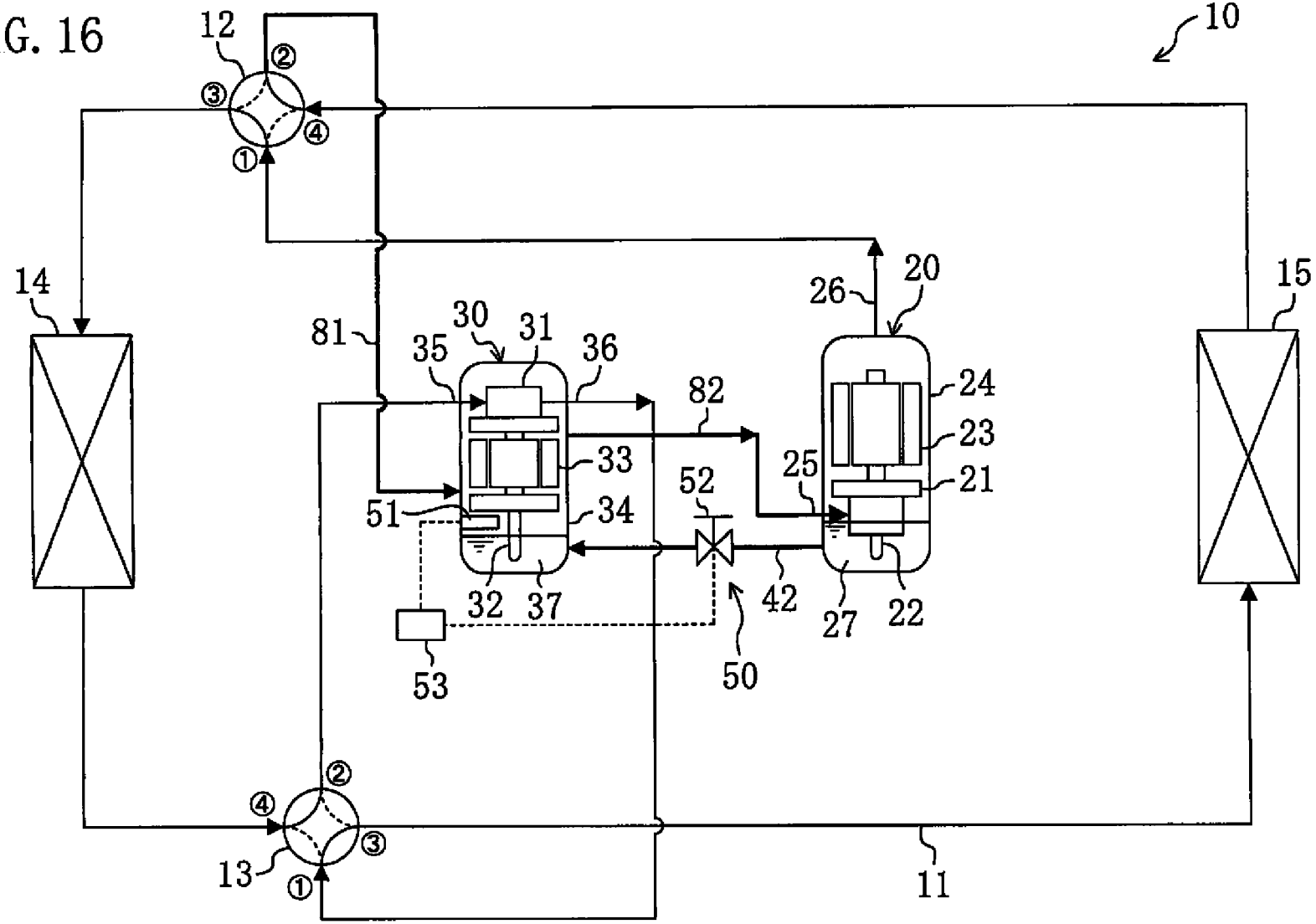
FIG. 16 is a refrigerant circuit diagram showing a construction of a refrigerant circuit in accordance with Embodiment 3.
Figure 17:
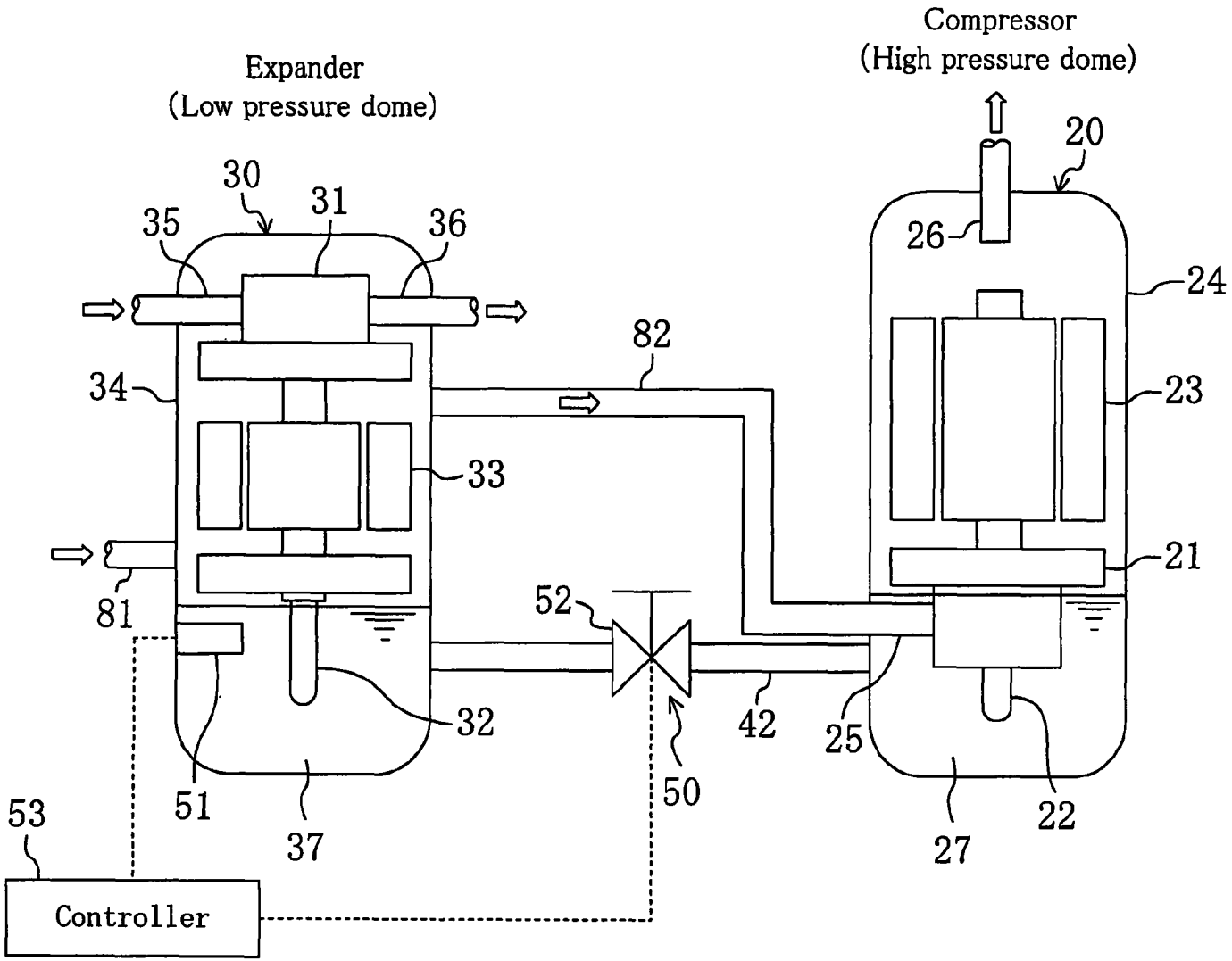
FIG. 17 is an enlarged view of a main part of the refrigerant circuit in accordance with Embodiment 3.

As shown in FIG. 16 and FIG. 17, in the refrigerant circuit (11) of the present embodiment, the pipe connecting the suction pipe (25) of the compressor (20) and the second port of the first four-way switching valve (12) is omitted. Further in this refrigerant circuit (11), the start end of the low-pressure side introduction pipe (81) is connected to the second port of the first four-way switching valve (12) while the terminal end of the low-pressure leading pipe (82) is connected to the suction pipe (25) of the compressor (20). The connection points of the low-pressure side introduction pipe (81) and the low-pressure side leading pipe (82) to the expander casing (34) are the same as those in Embodiment 2.

In the refrigerant circuit (11) of the present embodiment, all of the refrigerant flowing out from one of the outdoor heat exchanger (14) and the indoor heat exchanger (15) whichever serves as an evaporator flows into the internal space of the expander casing (34) through the low-pressure side introduction pipe (81), passes through the generator (33) from below upward, and is then sucked into the compressor (20) through the low-pressure side leading pipe (82).

In the present embodiment, all of the low-pressure refrigerant to be sucked into the compressor (20) passes through the internal space of the expander casing (34). Accordingly, the effects obtained in Embodiment 2 can be obtained at further greater degree in the present embodiment. Namely, the amount of the refrigerator oil sucked in the compressor (20) together with the refrigerant can be reduced further to allow the compressor (20) to exert its performance fully. In addition, even if liquid refrigerant is contained in the low-pressure refrigerant flowing toward the compressor (20), almost all of the liquid refrigerant can be evaporated in the expander casing (34) to suppress danger that the compressor (20) is broken by generally-called wet vapor suction.

Modified Example 1 of Embodiment 3

Figure 18:
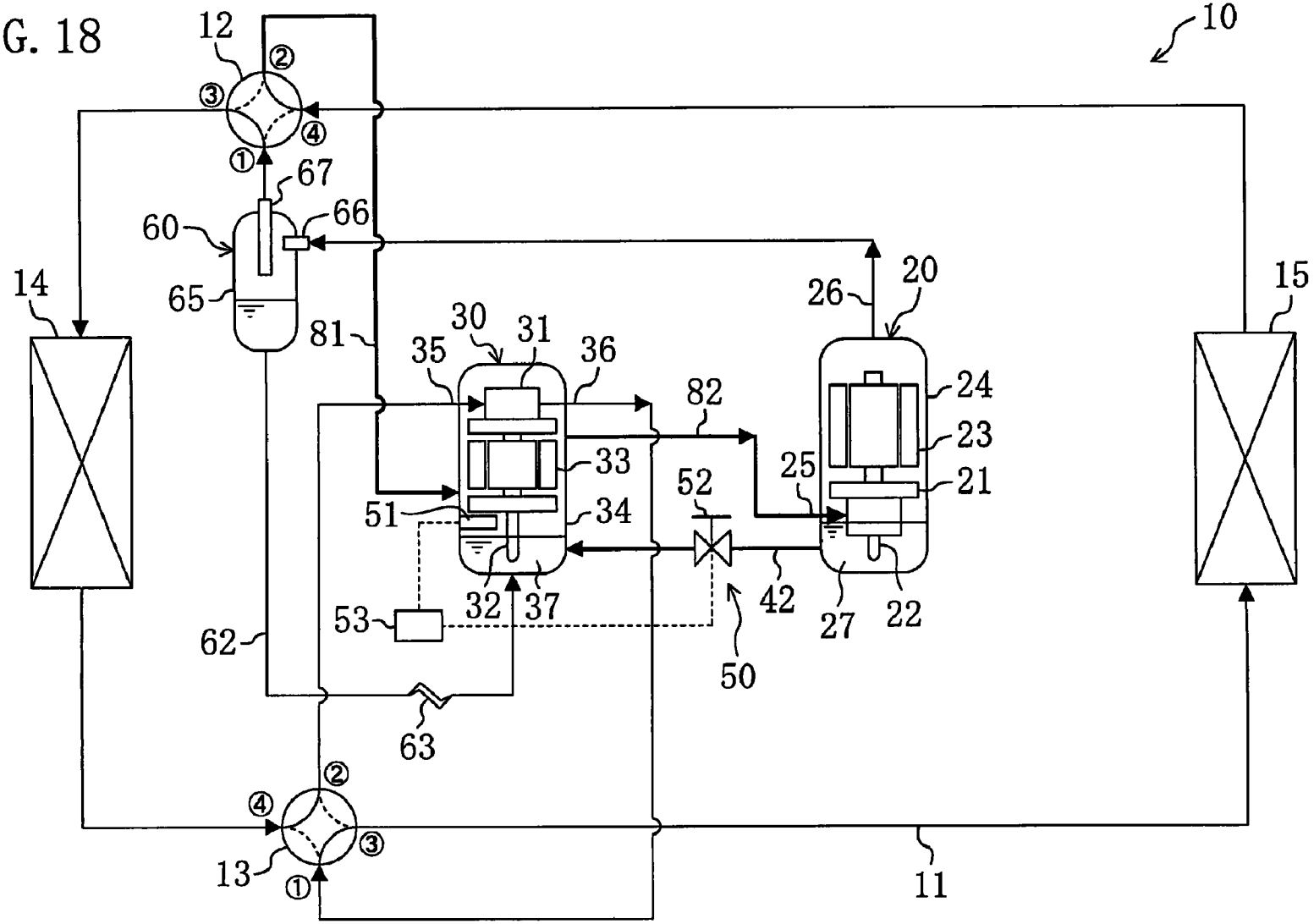
FIG. 18 is a refrigerant circuit diagram showing a construction of a refrigerant circuit in accordance with Modified Example 1 of Embodiment 3.

In the present embodiment, as shown in FIG. 18, an oil separator (60) may be provided on the discharge side of the compressor (20) in such a manner that the bottom of a body member (65) of the oil separator (60) is connected to the bottom of the expander casing (34) through an oil return pipe (62) in which a capillary tube (63) is provided for reducing the pressure of the refrigerator oil.

The difference of a refrigerant circuit (11) of the present modified example from the refrigerant circuit (11) shown in FIG. 16 is the same as the difference of the refrigerant circuit (11) of Modified Example 1 of Embodiment 1 (see FIG. 4)

from the refrigerant circuit (11) in shown in FIG. 1 and FIG. 2. Therefore, the description of Modified example 1 of Embodiment 1 is evoked as the description of the present modified example.

Modified Example 2 of Embodiment 3

Figure 19:
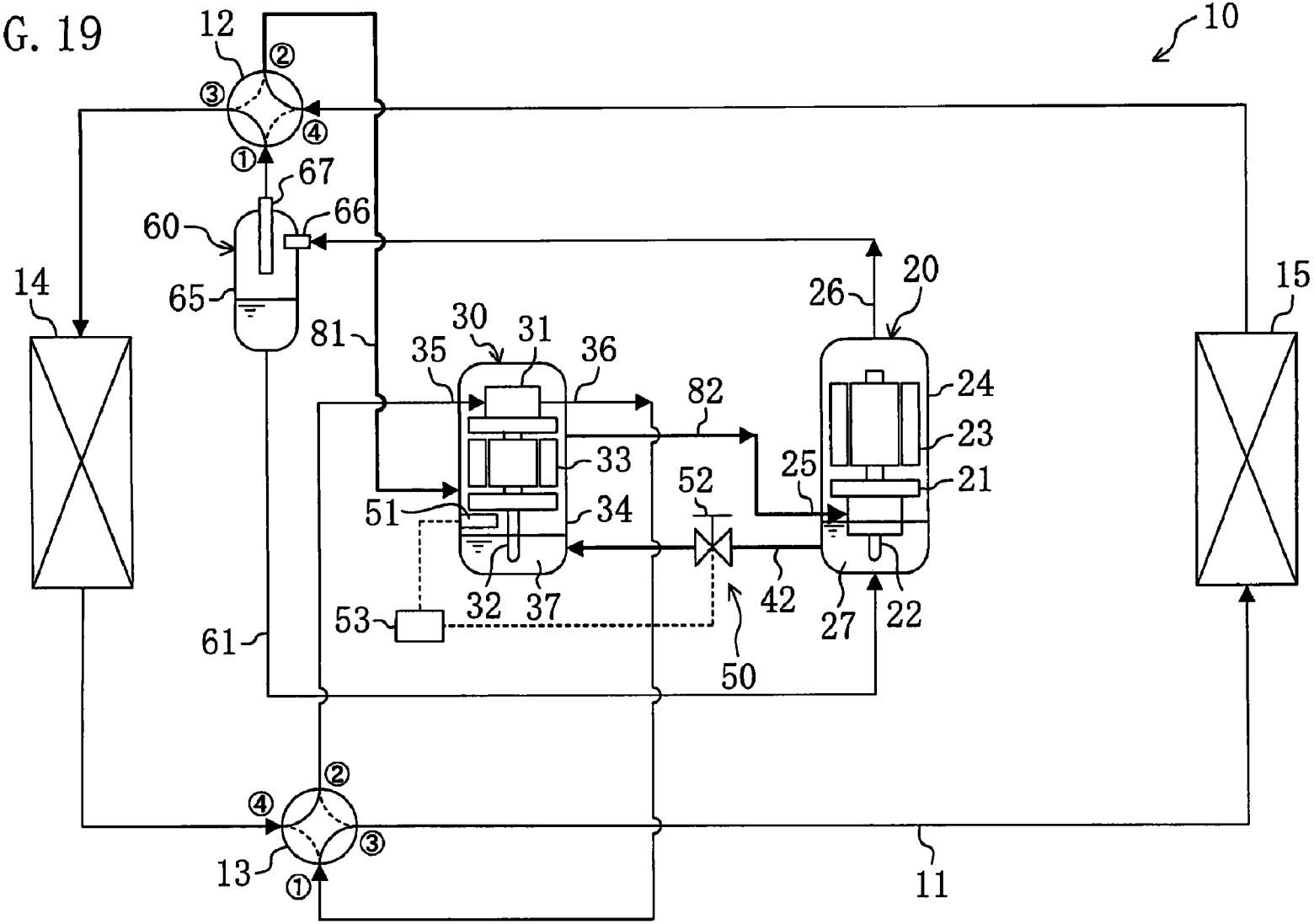
FIG. 19 is a refrigerant circuit diagram showing a construction of a refrigerant circuit in accordance with Modified Example 2 of Embodiment 3.

As shown in FIG. 19, an oil separator (60) may be provided on the discharge side of the compressor (20) in such a manner that the bottom of a body member (65) of the oil separator (60) is connected to the bottom of the compressor casing (24) through an oil return pipe (61) in the present embodiment.

The difference of a refrigerant circuit (11) of the present modified example from the refrigerant circuit (11) shown in FIG. 16 is the same as the difference of the refrigerant circuit (11) of Modified Example 2 of Embodiment 1 (see FIG. 5) from the refrigerant circuit (11) shown in FIG. 1 and FIG. 2. Therefore, the description of Modified example 2 of Embodiment 1 is evoked as the description of the present modified example.

Modified Example 3 of Embodiment 3

Figure 20:
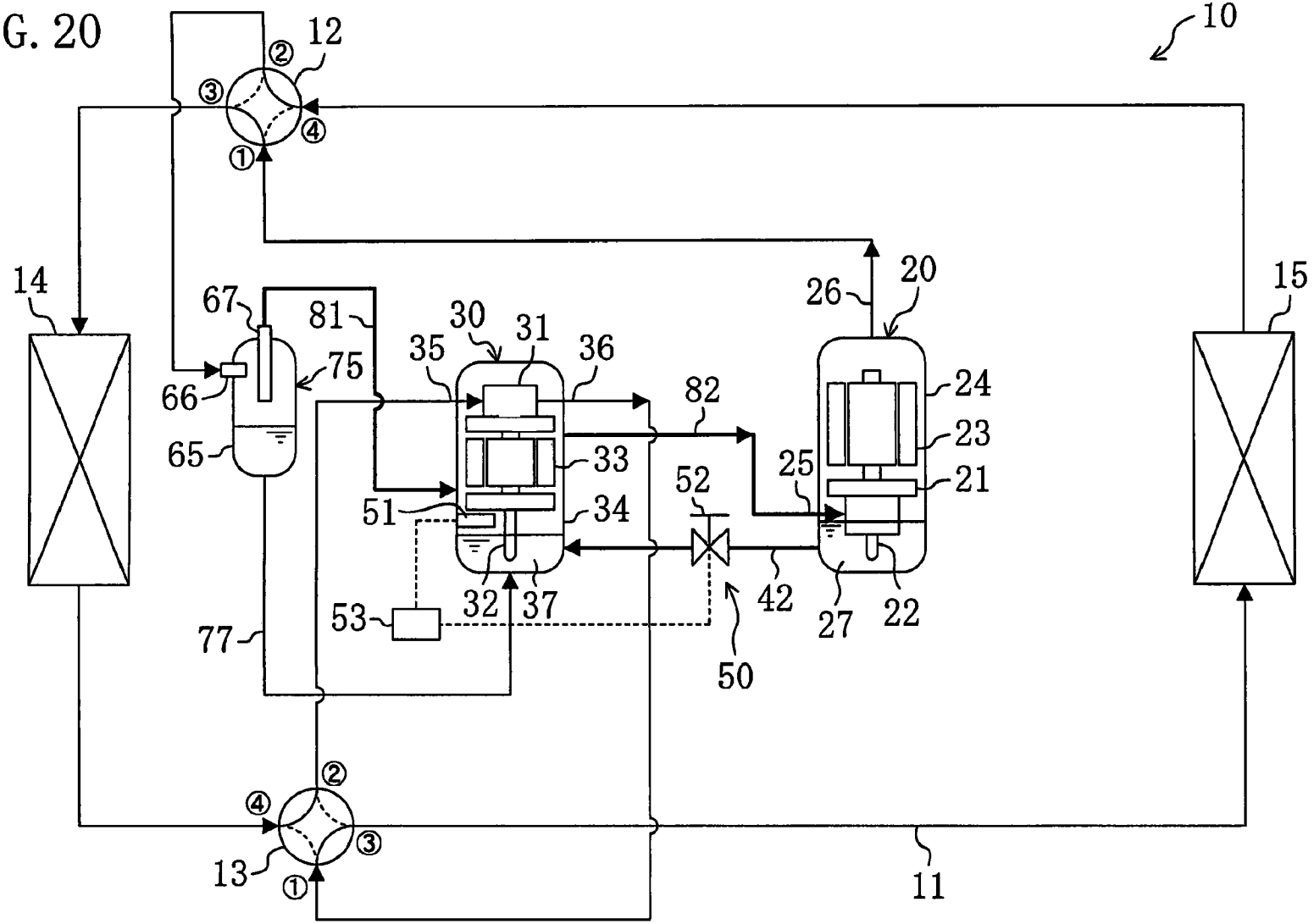
FIG. 20 is a refrigerant circuit diagram showing a construction of a refrigerant circuit in accordance with Modified Example 3 of Embodiment 3.

In the present embodiment, an oil separator (75) may be provided on the suction side of the compressor (20) in such a manner that the bottom of a body member (65) of the oil separator (75) is connected to the bottom of the expander casing (34) through an oil return pipe (77), as shown in FIG. 20.

Herein, only the difference of a refrigerant circuit (11) of the present modified example from the refrigerant circuit (11) shown in FIG. 16 will be described. In the refrigerant circuit (11) of the present modified example, the start end of the low-pressure side introduction pipe (81) is connected to an outlet pipe (67) of the oil separator (75). The other difference is the same as the difference of the refrigerant circuit (11) of Modified Example 3 of Embodiment 1 (see FIG. 6) from the refrigerant circuit (11) shown in FIG. 1 and FIG. 2. Therefore, the description of Modified example 3 of Embodiment 1 is evoked as the description of the present modified example.

Modified Example 4 of Embodiment 3

Figure 21:
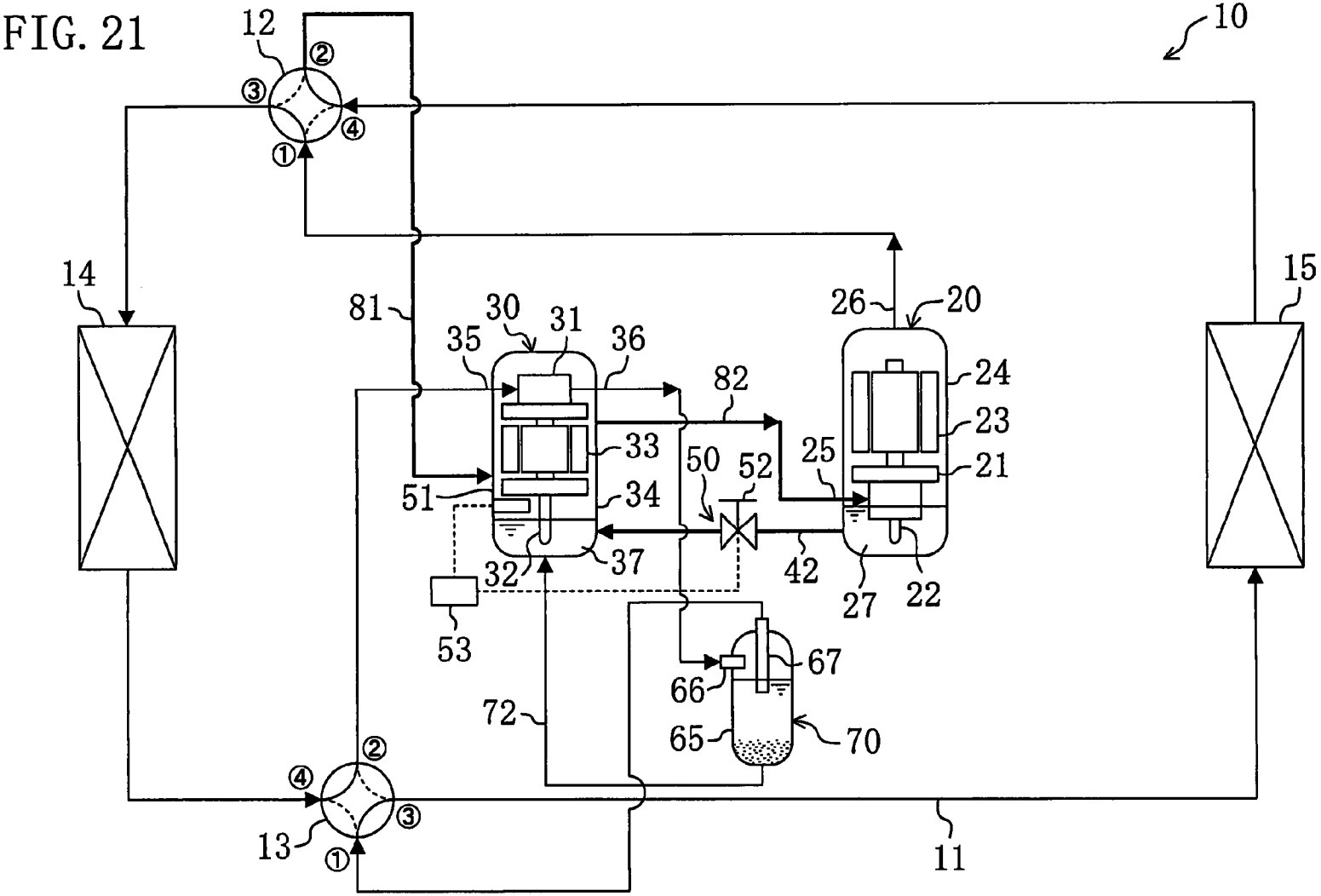
FIG. 21 is a refrigerant circuit diagram showing a construction of a refrigerant circuit in accordance with Modified Example 4 of Embodiment 3.

As shown in FIG. 21, in the present embodiment, an oil separator (70) may be provided on the outflow side of the expander (30) in such a manner that the bottom of a body member (65) of the oil separator (70) is connected to the bottom of the expander casing (34) through an oil return pipe (72).

The difference of a refrigerant circuit (11) of the present modified example from the refrigerant circuit (11) shown in FIG. 16 is the same as the difference of the refrigerant circuit (11) of Modified Example 4 of Embodiment 1 (see FIG. 7) from the refrigerant circuit (11) shown in FIG. 1 and FIG. 2. Therefore, the description of Modified example 4 of Embodiment 1 is evoked as the description of the present modified example.

Modified Example 5 of Embodiment 3

Figure 22:
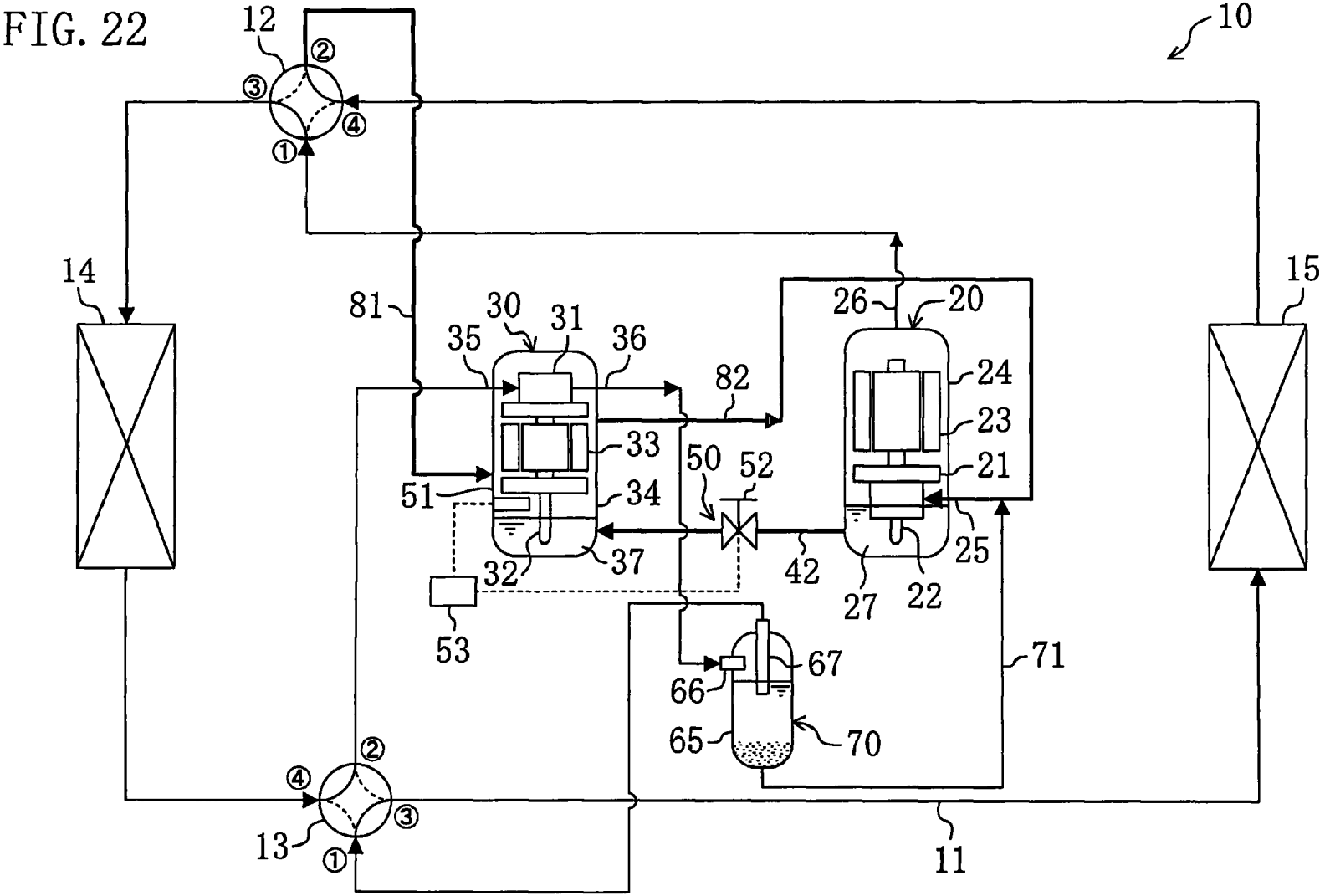
FIG. 22 is a refrigerant circuit diagram showing a construction of a refrigerant circuit in accordance with Modified Example 5 of Embodiment 3.

In the present embodiment, an oil separator (70) may be provided on the outflow side of the expander (30) in such a manner that the bottom of a body member (65) of the oil separator (70) is connected to the suction pipe (25) of the compressor (20) through an oil return pipe (71), as shown in FIG. 22.

The difference of a refrigerant circuit (11) of the present modified example from the refrigerant circuit (11) shown in FIG. 16 is the same as the difference of the refrigerant circuit (11) of Modified Example 5 of Embodiment 1 (see FIG. 8) from the refrigerant circuit (11) shown in FIG. 1 and FIG. 2. Therefore, the description of Modified example 5 of Embodiment 1 is evoked as the description of the present modified example.

Embodiment 4

Embodiment 4 of the present invention will be described. An air conditioner (10) of the present invention is one in which the construction of the refrigerant circuit (11) of Embodiment 1 is changed. Only the difference of the air conditioner (10) of the present embodiment from that of Embodiment 1 will be described.

Figure 23:
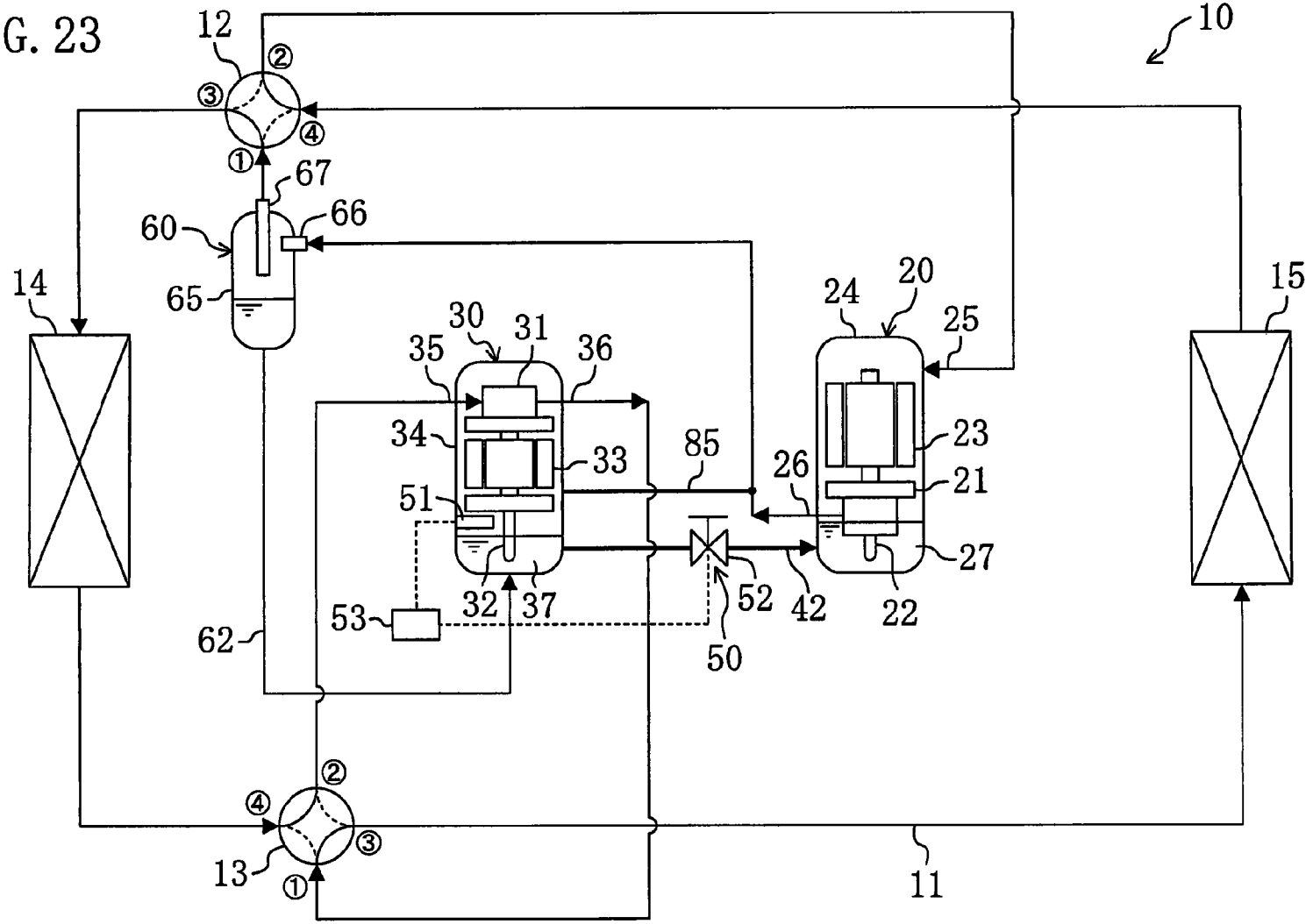
FIG. 23 is a refrigerant circuit diagram showing a construction of a refrigerant circuit in accordance with Embodiment 4.
Figure 24:
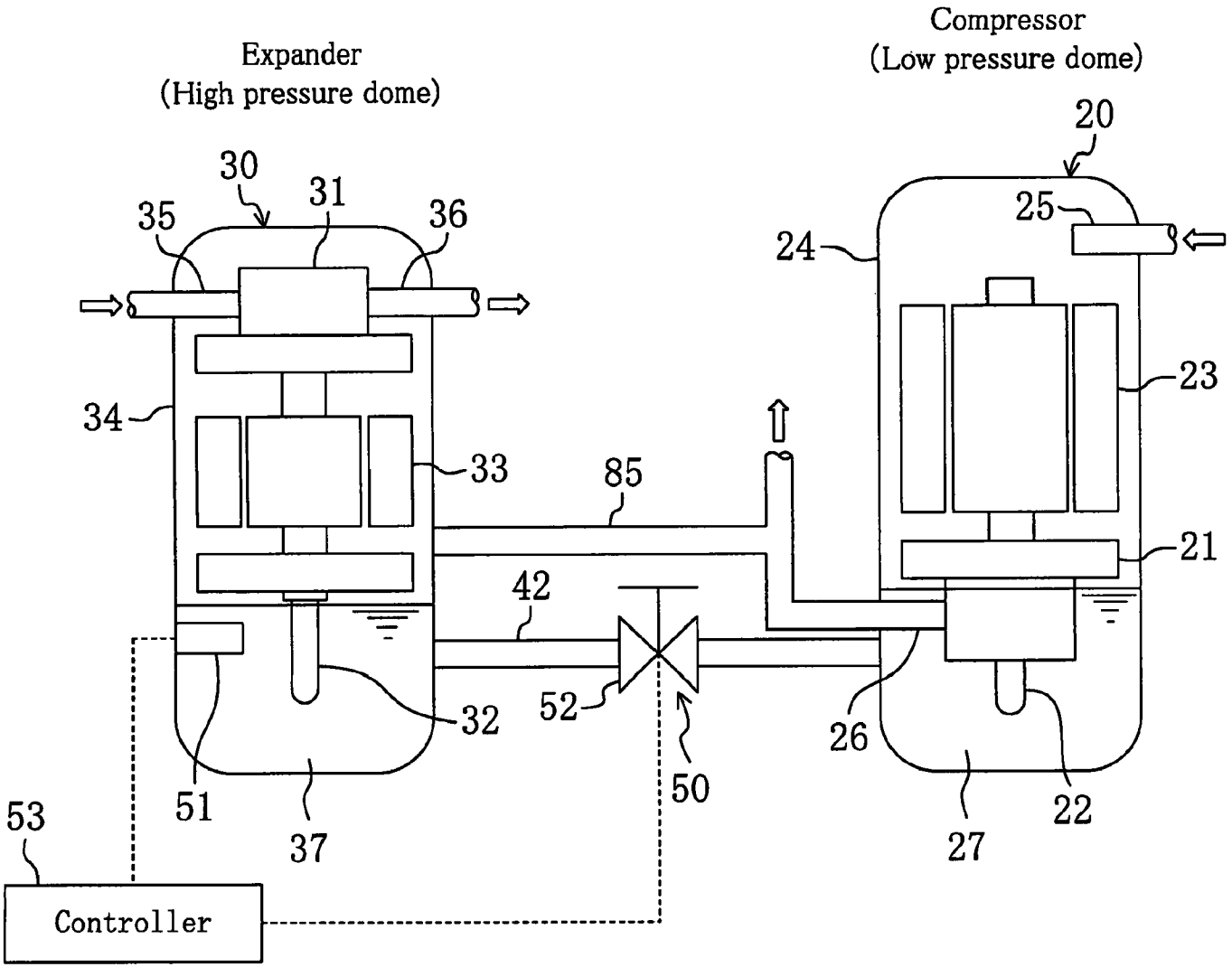
FIG. 24 is an enlarged view of a main part of the refrigerant circuit in accordance with Embodiment 4.

As shown in FIG. 23 and FIG. 24, a compressor (20) in the present embodiment is a generally-called hermetic compressor (20) of low-pressure dome type. In the compressor (20), a suction pipe (25) passes through the upper part of the compressor casing (24), and the terminal end thereof is opened to the space above the motor (23) in the compressor casing (24). On the other hand, a discharge pipe (26) passes through the lower part of the compressor casing (24), and the start end thereof is connected directly to the compression mechanism (21). It is the same as in Embodiment 1 that the compression mechanism (21) composes a rotary positive displacement fluid machinery and that the drive shaft (22) serves as an oil supply mechanism.

In the refrigerant circuit (11) of the present embodiment, an oil separator (60) and an oil return pipe (62) are provided. Further, a high-pressure side communication pipe (85) is provided in this refrigerant circuit (11).

The oil separator (60) is arranged on the discharge side of the compressor (20). The oil separator (60) itself has the same construction as the oil separator (60) in Modified Example 1 of Embodiment 1. Specifically, the oil separator (60) includes a body member (65), an inlet pipe (66), and an outlet pipe (67). The inlet pipe (66) of the oil separator (60) is connected to the discharge pipe (26) of the compressor (20) while the outlet pipe (67) thereof is connected to the first port of the first four-way switching valve (12).

The oil return pipe (62) connects the oil separator (60) and the expander (30) to form an oil return path. The oil return pipe (62) is connected at one end thereof to the bottom of the body member (65) of the oil separator (60) while being connected at the other end thereof to the bottom of the expander casing (34). The internal space of the body member (65) of the oil separator (60) communicates with the oil reservoir (37) in the expander casing (34) through the oil return pipe (62).

The high-pressure side communication pipe (85) composes a high-pressure side communication path. The high-pressure side communication pipe (85) is connected at one end thereof to a pipe connecting the discharge pipe (26) of the compressor (20) and the first port of the first four-way switching valve (12) while being connected at the other end thereof to the expander casing (34). The other end of the high-pressure side communication pipe (85) is opened to a part of the internal space of the expander casing (34) which is located lower than the generator (33).

—Driving Operation—

Driving operations of the refrigerant circuit (11) of the present embodiment in the cooling operation and the heating operation are the same as those performed in the refrigerant circuit (11) of Embodiment 1 except that the refrigerant discharged from the compressor (20) passes through the oil separator (60). In the refrigerant circuit (11) of the present embodiment, the refrigerant discharged from the compressor (20) passes through the oil separator (60), flows into the first four-way switching valve (12), and is then supplied to the outdoor heat exchanger (14) in the cooling operation while on the other hand being supplied to the indoor heat exchanger (15) in the heating operation.

An oil amount adjusting operation performed in the air conditioner (10) of the present embodiment will be described.

The refrigerator oil discharged from the compressor (20) together with the refrigerant flows into the oil separator (60) and is separated from the refrigerant, thereby being reserved in the bottom of the body member (65). The refrigerator oil reserved in the body member (65) is supplied to the oil reservoir (37) in the expander casing (34) through the oil return pipe (62).

On the other hand, the refrigerator oil flowing out from the expander (30) together with the refrigerant flows in the refrigerant circuit (11) together with the refrigerant then into the internal space of the compressor casing (24) through the suction pipe (25) of the compressor (20). The refrigerator oil flowing in the compressor casing (24) together with the refrigerant passes through the slit formed between the rotor and the stator of the generator (33), the slit between the stator and the compressor casing (24), and the like. Through the process of passing therethrough, part of the refrigerator oil is separated from the refrigerant and drops into the oil reservoir (27). The refrigerator oil not separated from the refrigerant is sucked into the compression mechanism (21) together with the refrigerant and is then discharged from the compressor (20) together with the refrigerant.

Thus, in the present embodiment, the refrigerator oil flowing out from the compressor (20) is collected in the oil separator (60) and is then supplied to the expander casing (30). Accordingly, the reserved amount of the refrigerator oil in the expander casing (34) increases gradually while the reserved amount of the refrigerator oil in the compressor casing (24) decreases gradually in the operation of the air conditioner (10).

When the reserved amount of the refrigerator oil increases in the expander casing (34), the oil level in the oil reservoir (37) rises accordingly. The controller (53) opens the oil amount adjusting valve (52) when it judges on the basis of the output signal of the oil level sensor (51) that the oil level in the oil reservoir (37) rises up to or over a given level. When the oil amount adjusting valve (52) is opened, the oil reservoir (27) in the compressor casing (24) and the oil reservoir (37) in the expander casing (34) communicate with each other.

Herein, the refrigerant to be sucked to the compressor (20) is sucked into the compressor (20) only after passing through the internal space of the compressor casing (24). Accordingly, the inner pressure of the compressor casing (24) is almost equal to the pressure of the refrigerant to be sucked in the compression mechanism (21), that is, the low pressure of the refrigeration cycle. On the other hand, in the expander (30), the expander casing (34) is connected to the high-pressure side communication pipe (85) and the internal space of the expander casing (34) communicates with the pipe connected to the discharge pipe (26) of the compressor (20). Accordingly, the inner pressure of the expander casing (34) is almost equal to the pressure of the refrigerant discharged from the compressor (20), that is, the high pressure of the refrigeration cycle.

Thus, the inner pressure of the expander casing (34) is higher than that of the compressor casing (24). Accordingly, the refrigerator oil flows through the oil pipe (42) from the oil reservoir (37) in the expander casing (34) toward the oil reservoir (27) in the compressor casing (24) when the oil amount adjusting valve (52) is opened. Then, the controller (53) closes the oil amount adjusting valve (52) when it judges on the basis of the output signal of the oil level sensor (51) that the oil level in the oil reservoir (37) lowers up to or over a given level.

Embodiment 5 of the Invention

Embodiment 5 of the present invention will be described. An air conditioner (10) of the present invention is one in which the construction of the refrigerant circuit (11) of Embodiment 4 is changed. Only the difference of the air conditioner (10) of the present embodiment from that of Embodiment 4 will be described.

Figure 25:
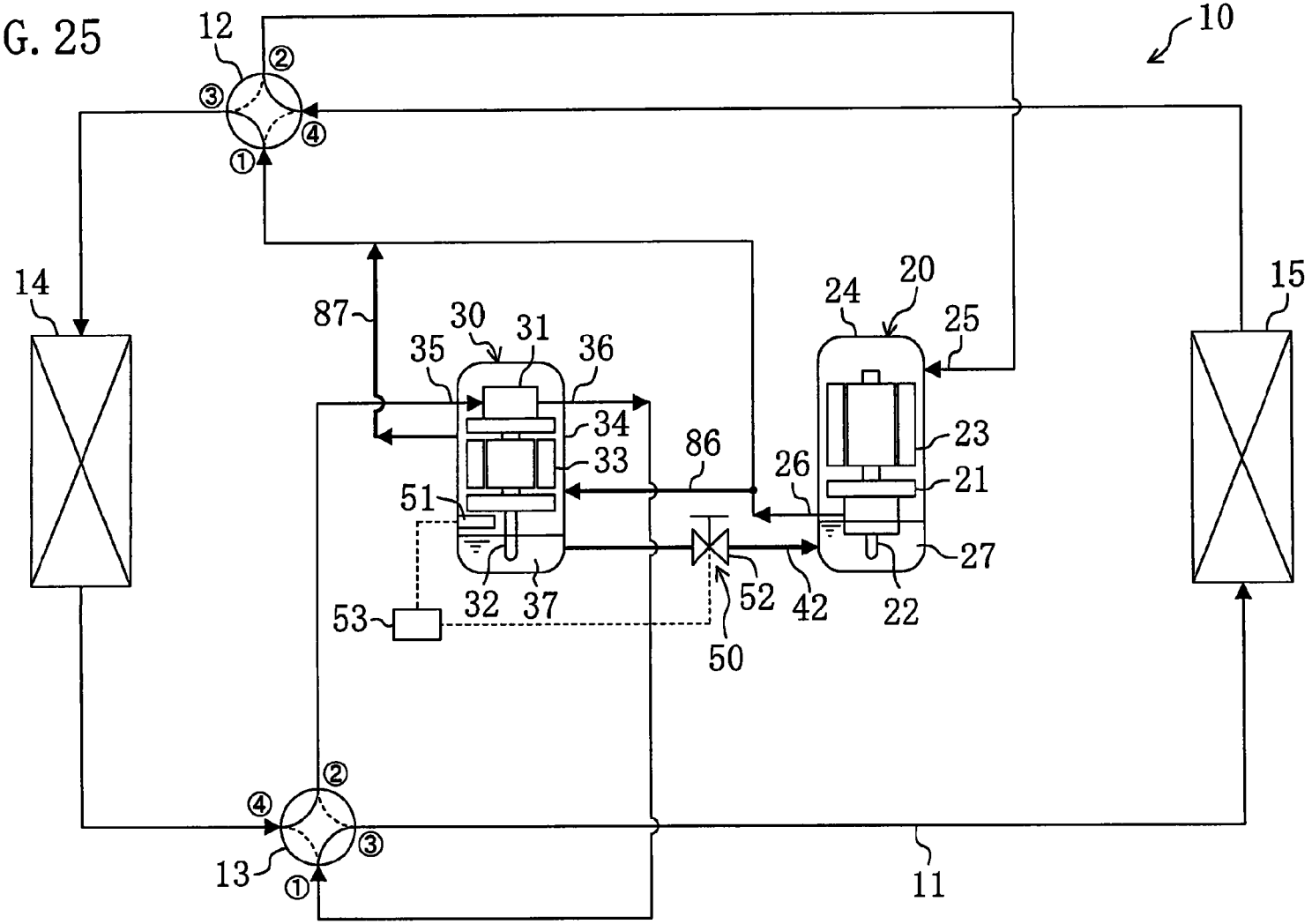
FIG. 25 is a refrigerant circuit diagram showing a construction of a refrigerant circuit in accordance with Embodiment 5.
Figure 26:
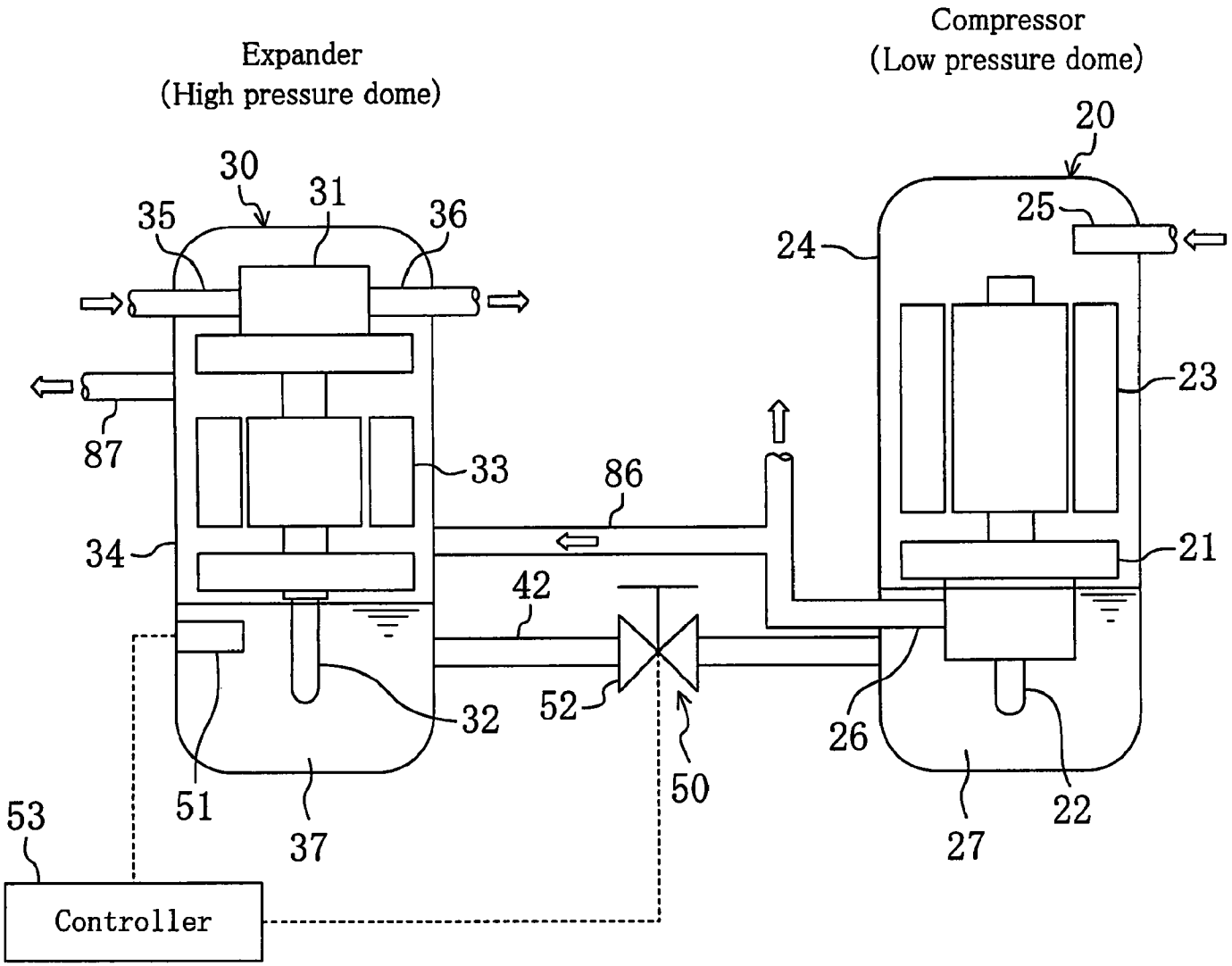
FIG. 26 is an enlarged view of a main part of the refrigerant circuit in accordance with Embodiment 5.

As shown in FIG. 25 and FIG. 26, the refrigerant circuit (11) of the present embodiment is provided with a high-pressure side introduction pipe (86) and a high-pressure side leading pipe (87). In this refrigerant circuit (11), the high-pressure side communication pipe (85), the oil separator (60), and the oil return pipe (62) in Embodiment 4 are omitted.

The high-pressure side introduction pipe (86) composes a high-pressure side introduction path. The high-pressure introduction pipe (86) is connected at the start end thereof to a pipe connecting the discharge pipe (26) of the compressor (20) and the first port of the first four-way switching valve (12) while being connected at the terminal end thereof to the expander casing (34). The terminal end of the high-pressure side introduction pipe (86) is opened to a part of the internal space of the expander casing (34) which is located lower than the generator (33).

The high-pressure side leading pipe (87) composes a high-pressure side leading path. The high-pressure leading pipe (87) is connected at the start end thereof to the expander casing (34). The start end of the high-pressure side leading pipe (87) is opened to a part of the internal space of the expander casing (34) which is located between the expansion mechanism (31) and the generator (33). The terminal end of the high-pressure side leading pipe (87) is connected to a part of the pipe connecting the discharge pipe (26) of the compressor (20) and the first port of the first four-way switching valve (12) which is closer to the first four-way switching valve (12) than the connection point of the pipe to the high-pressure side introduction pipe (86).

—Driving Operation—

Driving operations of the refrigerant circuit (11) of the present embodiment in the cooling operation and the heating operation are the same as those performed in the refrigerant circuit (11) of Embodiment 4 except the path in which the refrigerant discharged from the compressor (20) flows toward the first four-wary switching valve (12). In the present embodiment, part of the refrigerant discharged from the compressor (20) flows into the first four-way switching valve (12) via the expander casing (34) while the other thereof flows into the first four-way switching valve (12) directly.

Specifically, part of the refrigerant discharged from the compressor (20) flows into the expander casing (34) through the high-pressure side introduction pipe (86). The high-pressure refrigerant flowing in the expander casing (34) passes from below upward through the slit formed between the rotor and the stator of the generator (33), the slit between the stator and the expander casing (34), and the like. Through the process of passing therethrough, the refrigerator oil flowing in the expander casing (34) together with the high-pressure refrigerant is separated from the refrigerant. The refrigerator oil separated from the refrigerant in the expander casing (34) drops into the oil reservoir (37). The high-pressure refrigerant having passed through the generator (33) flows into the high-pressure side leading pipe (87), is merged with the refrigerant flowing directly from the compressor (20) toward the first four-way switching valve (12), and flows then to the first four-way switching valve (12).

As described above, part of the refrigerator oil discharged from the compressor (20) together with the refrigerant is separated from the high-pressure refrigerant in the expander casing (34). Accordingly, the reserved amount of the refrigerator oil increases gradually in the expander casing (34) while that of the refrigerator oil decreases gradually in the compressor casing (24).

The controller (53) in the present embodiment performs the same operation as that in Embodiment 4. Specifically, the controller (53) opens the oil amount adjusting valve (52) when it judges on the basis of the output signal of the oil level sensor (51) that the oil level in the oil reservoir (37) rises up to or over a given level to supply the refrigerator oil from the oil reservoir (37) in the expander casing (34) to the oil reservoir (27) in the compressor casing (24). The controller (53) closes the oil amount adjusting valve (52) when it judges on the basis of the output signal of the oil level sensor (51) that the oil level in the oil reservoir (37) lowers up to or over a given level.

Effects of Embodiment 5

In addition to the effects obtained in Embodiment 1, the following effects can be obtained in the present embodiment.

In the present embodiment, part of the high-pressure refrigerant discharged from the compressor (20) is introduced into the internal space of the expander casing (34) so as to be separated from the refrigerator oil by utilizing the generator (33) provided there. Accordingly, the amount of the refrigerator oil reserved in the expander casing (34) can be secured effortlessly.

Further, in the expander (30) in the present embodiment, the high-pressure refrigerant flowing in the expander casing (34) passes through the generator (33) from below upward while the refrigerator oil separated from the refrigerant when passing through the generator (33) drops down from above. In other words, the direction in which the high-pressure refrigerant flows is reverse to the direction in which the refrigerator oil separated from the high-pressure refrigerant flows in the internal space of the expander casing (34). Hence, in the present embodiment, the amount of the refrigerator oil can be secured further definitely which flows out again into the high-pressure side leading pipe (87) together with the high-pressure refrigerant out of the refrigerant separated from the high-pressure refrigerant.

Modified Example 1 of Embodiment 5

Similarly to the case of Embodiment 4, an oil separator (60) and an oil return pipe (62) may be provided in the refrigerant circuit (11) in the present embodiment. Herein, only the difference of an air conditioner (10) in the present modified example from that shown in FIG. 25 will be described.

Figure 27:
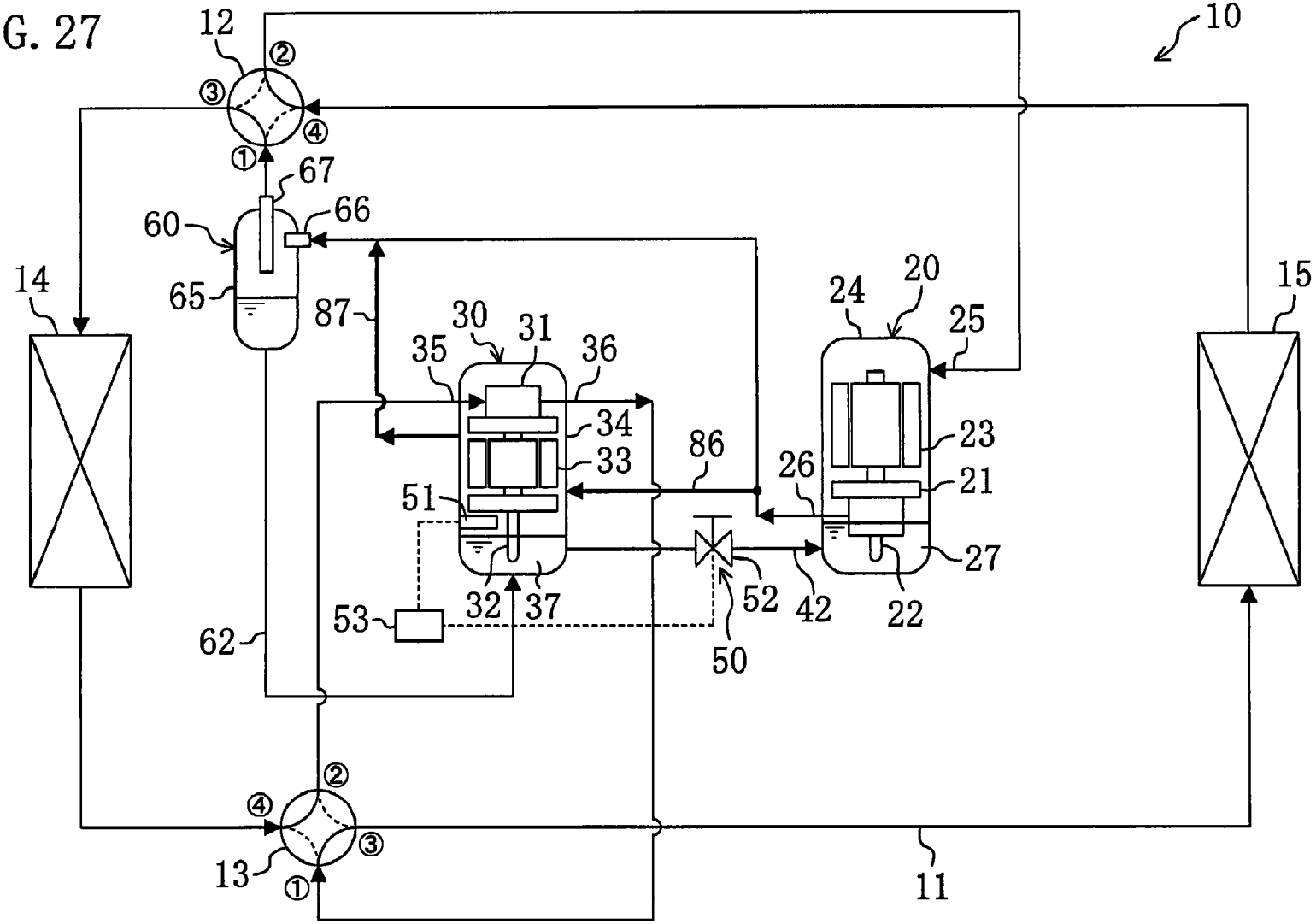
FIG. 27 is a refrigerant circuit diagram showing a construction of a refrigerant circuit in accordance with Modified Example 1 of Embodiment 5.

As shown in FIG. 27, the oil separator (60) is provided on the discharge side of the compressor (20) in the refrigerant circuit (11). The oil separator (60) itself is composed just the same as the oil separator (60) in Embodiment 4. Specifically, the oil separator (60) includes an body member (65), an inlet pipe (66), and an outlet pipe (67). The inlet pipe (66) of the oil separator (60) is connected to the discharge pipe (26) of the compressor (20) while the outlet pipe (67) thereof is connected to the first port of the first four-way switching valve (12).

The oil return pipe (62) connects the oil separator (60) and the expander casing (34) to form an oil return path. The oil return pipe (62) is connected at one end thereof to the bottom of the body member (65) of the oil separator (60) while being connected at the other end thereof to the bottom of the expander casing (34). The internal space of the body member (65) of the oil separator (60) communicates with the oil reservoir (37) in the expander casing (34) through the oil return pipe (62).

In the present modified example, the refrigerator oil discharged from the compressor (20) together with the refrigerant is separated from the high-pressure refrigerant in the oil separator (60) and is then supplied to the oil reservoir (37) in the expander casing (34) through the oil return pipe (62).

Modified Example 2 of Embodiment 5

In the refrigerant circuit (11) in Modified Example 1, the oil separator (60) may be connected to the compressor casing (24) rather than to the expander casing (34). Herein, only the difference of an air conditioner (10) of the present modified example from that of Modified Example 1 will be described.

Figure 28:
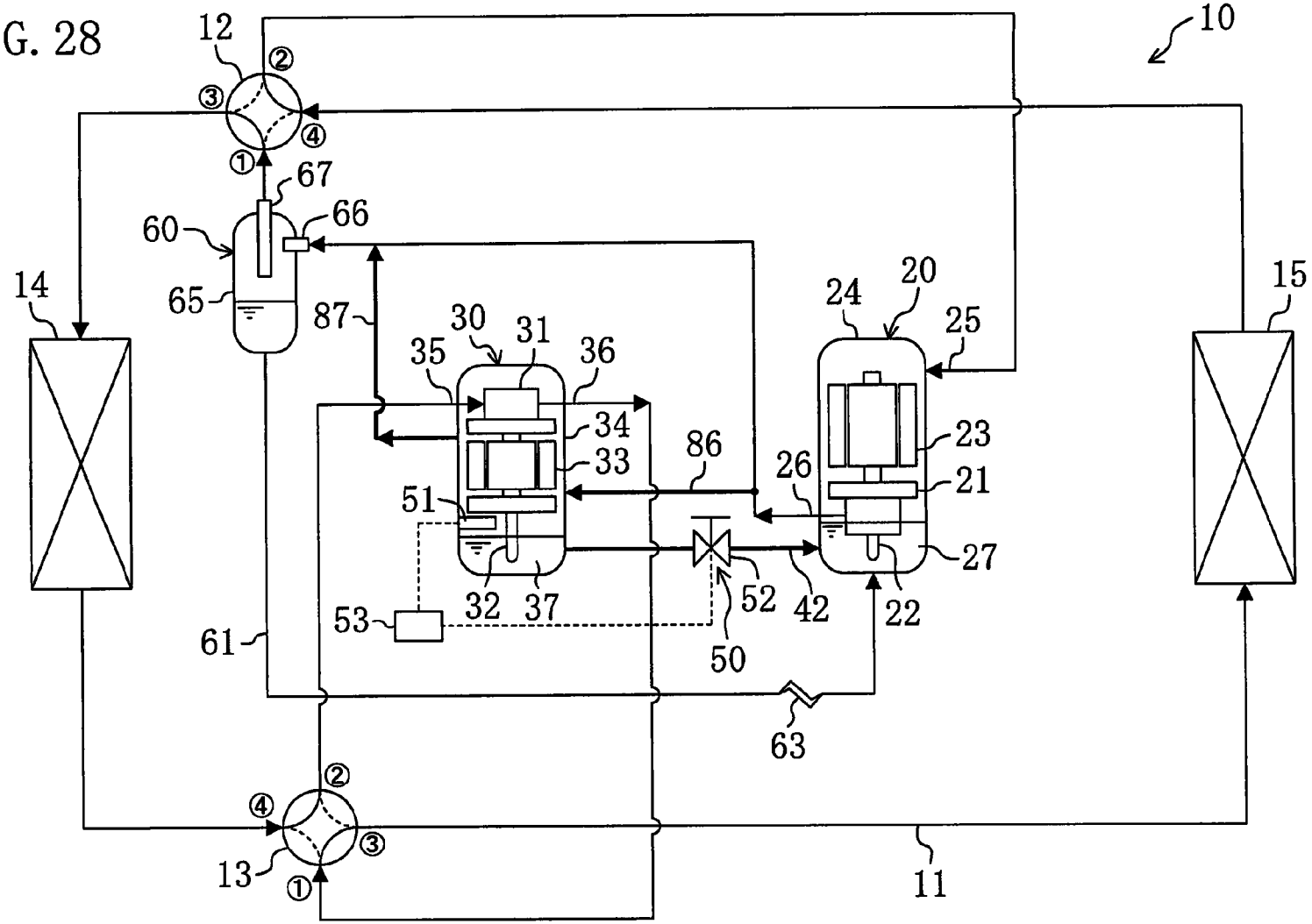
FIG. 28 is a refrigerant circuit diagram showing a construction of a refrigerant circuit in accordance with Modified Example 2 of Embodiment 5.

As shown in FIG. 28, in a refrigerant circuit (11) of the present modified example, a body member (65) of the oil separator (60) and the compressor casing (24) are connected to each other through an oil return pipe (61). The oil return pipe (61) is connected at one end thereof to the bottom of the body member (65) of the oil separator (60) while being connected at the other end thereof to the bottom of the compressor casing (24). The oil return pipe (61) includes a capillary tube (63) for reducing the pressure of the refrigerator oil. The oil return pipe (61) composes an oil return path for allowing the body member (65) of the oil separator (60) and the oil reservoir (27) in the compressor casing (24) to communicate with each other.

In the refrigerant circuit (11) of the present modified example, part of the refrigerator oil discharged from the compressor (20) together with the refrigerant is separated from the high-pressure refrigerant in the expander casing (34) while part of the other refrigerant discharged therefrom is separated from the high-pressure refrigerant by the separator (60). The refrigerator oil separated from the refrigerant in the expander casing (34) flows into the oil reservoir (37) in the expander casing (37). On the other hand, the refrigerator oil separated from the high-pressure refrigerant in the oil separator (60) is supplied to the oil reservoir (27) in the compressor casing (24) through the oil return pipe (61).

Modified Example 3 of Embodiment 5

An oil separator (70) and an oil return pipe (71) may be added to the refrigerant circuit (11) in the present embodiment. Only the difference of an air conditioner (10) of the present modified example from that shown in FIG. 25 will be described here.

Figure 29:
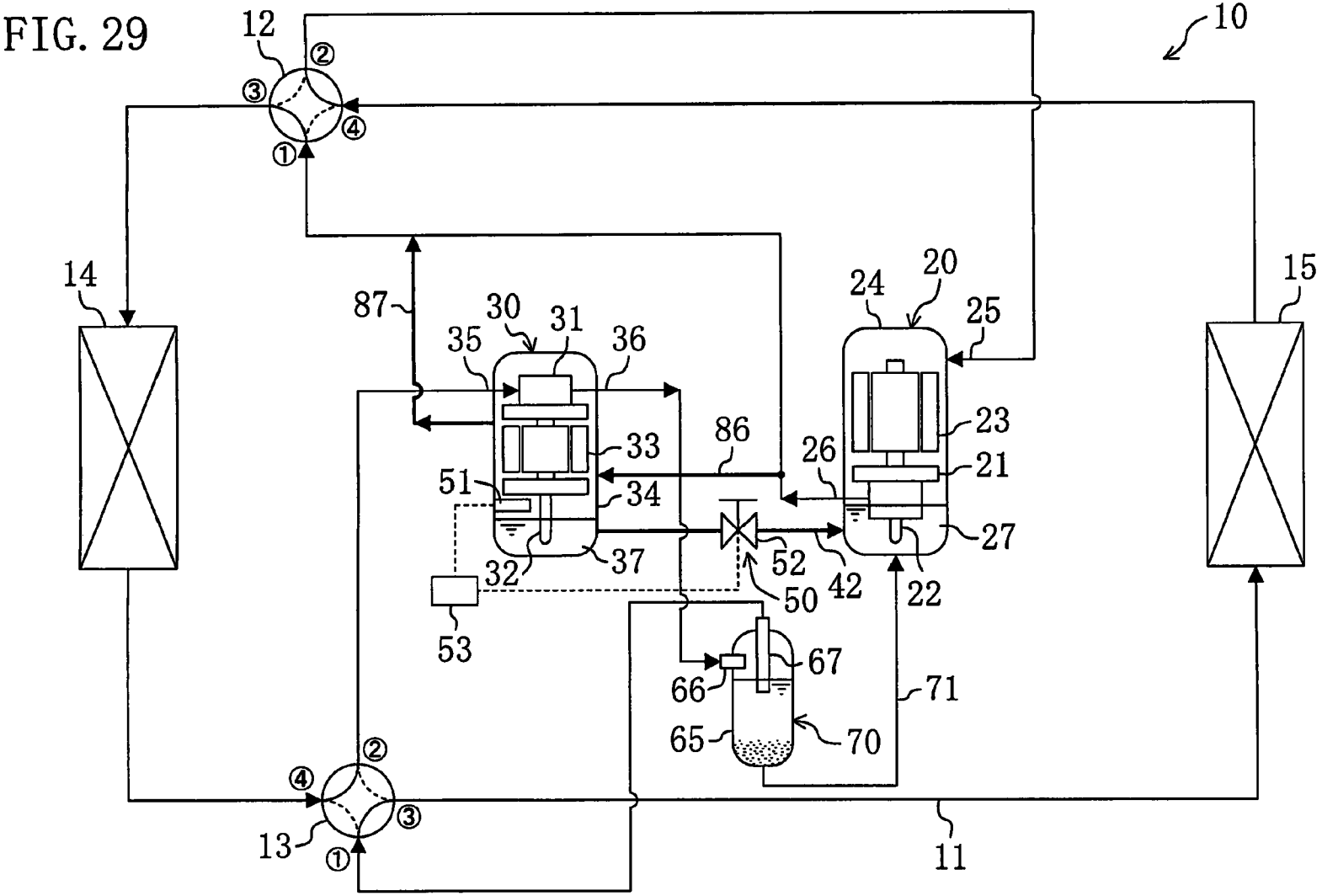
FIG. 29 is a refrigerant circuit diagram showing a construction of a refrigerant circuit in accordance with Modified Example 3 of Embodiment 5.

As shown in FIG. 29, the oil separator (70) is arranged on the outflow side of the expander (30). The oil separator (70) itself has the same construction as the oil separator (60) in Embodiment 4. Specifically, the oil separator (70) includes a body member (65), an inlet pipe (66), and an outlet pipe (67). The inlet pipe (66) of the oil separator (70) is connected to the outflow pipe (36) of the expander (30) while the outlet pipe (67) thereof is connected to the first port of the second four-way switching valve (13).

The oil return pipe (71) is connected at one end thereof to the bottom of the body member (65) of the oil separator (70) while being connected at the other end thereof to the bottom of the compressor casing (24).

The oil return pipe (71) is connected at one end thereof to the bottom of the body member (65) of the oil separator (70) while being connected at the other end thereof to a pipe connecting the suction pipe (25) of the compressor (20) and the second port of the first four-way switching valve (12). The oil return pipe (71) composes an oil return path for allowing the body member (65) of the oil separator (70) and the oil reservoir (27) in the compressor casing (24) to communicate with each other.

In a refrigerant circuit (11) of the present modified example, the refrigerator oil flowing out from the expander (30) flows into the body member (65) of the oil separator (70) together with the expanded refrigerant in a gas-liquid two-phase state. Inside the body member (65), the mixture of the liquid refrigerant and the refrigerator oil is reserved in the bottom thereof, and the gas refrigerant is reserved thereabove. The specific gravity of the refrigerator oil used in the refrigerant circuit (11) is larger than that of the liquid refrigerant. Accordingly, the ratio of the refrigerator oil becomes large as it goes down while the ratio of the liquid refrigerant becomes large as it goes up in such a liquid reservoir in the body member (65).

As described above, the oil return pipe (71) is connected to the bottom of the body member (65). The refrigerator oil present in the bottom of the liquid reservoir in the body member (65) is supplied to the oil reservoir (27) in the compressor casing (24) through the oil return pipe (71). On the other hand, the lower end of the outlet pipe (67) of the oil separator (70) is dipped in the liquid reservoir in the body member (65). The liquid refrigerant present in the upper layer in the liquid reservoir of the body member (65) flows out from the body member (65) through the outlet pipe (67) to be supplied to the indoor heat exchanger (15) in the cooling operation while on the other hand to be supplied to the outdoor heat exchanger (14) in the heating operation.

Embodiment 6 of the Invention

Embodiment 6 of the present invention will be described. An air conditioner (10) of the present embodiment is one in which the construction of the refrigerant circuit (11) of Embodiment 5 is changed. Only the difference of the air conditioner (10) of the present embodiment from that of Embodiment 5 will be described.

Figure 30:
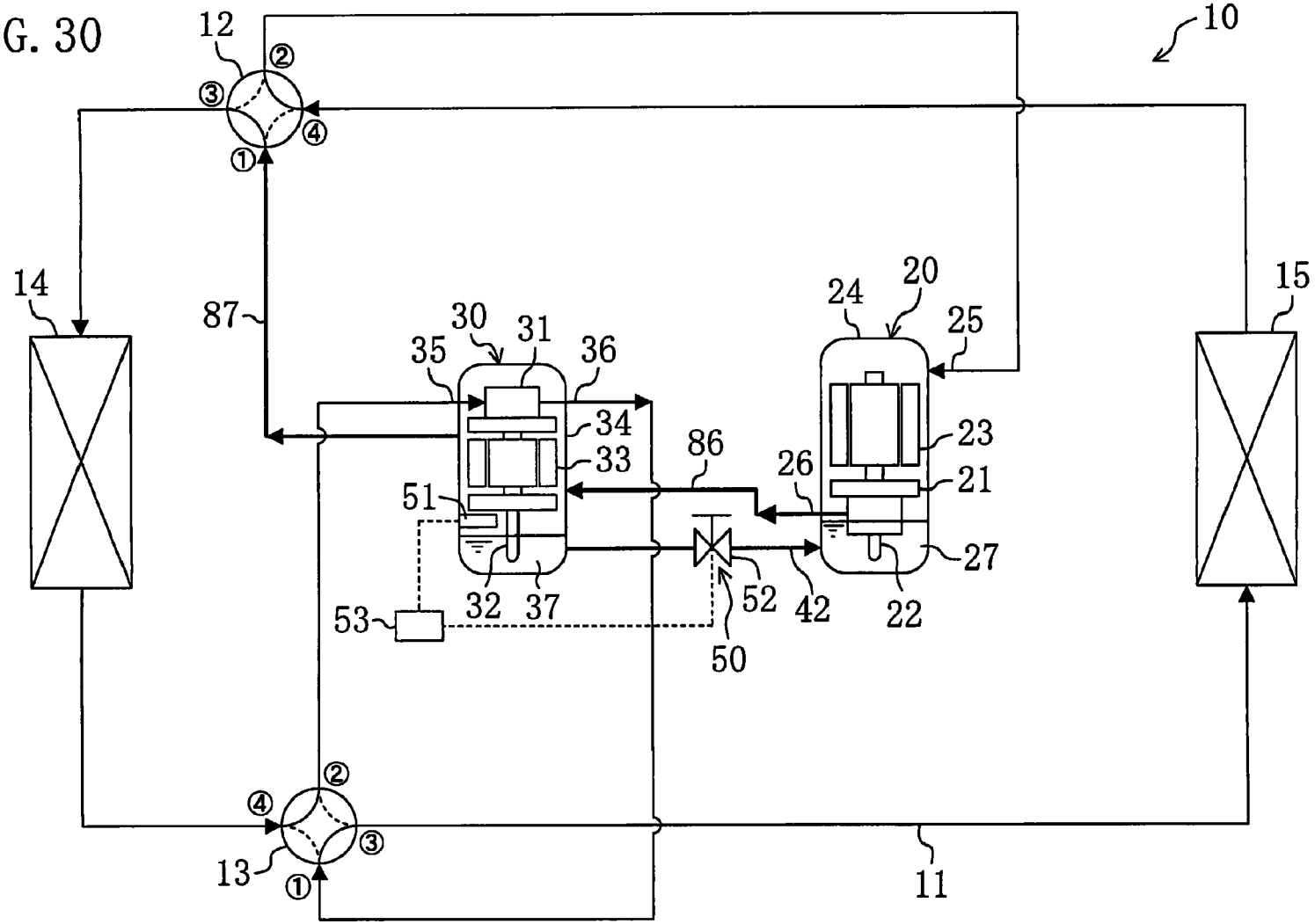
FIG. 30 is a refrigerant circuit diagram showing a construction of a refrigerant circuit in accordance with Embodiment 6.
Figure 31:
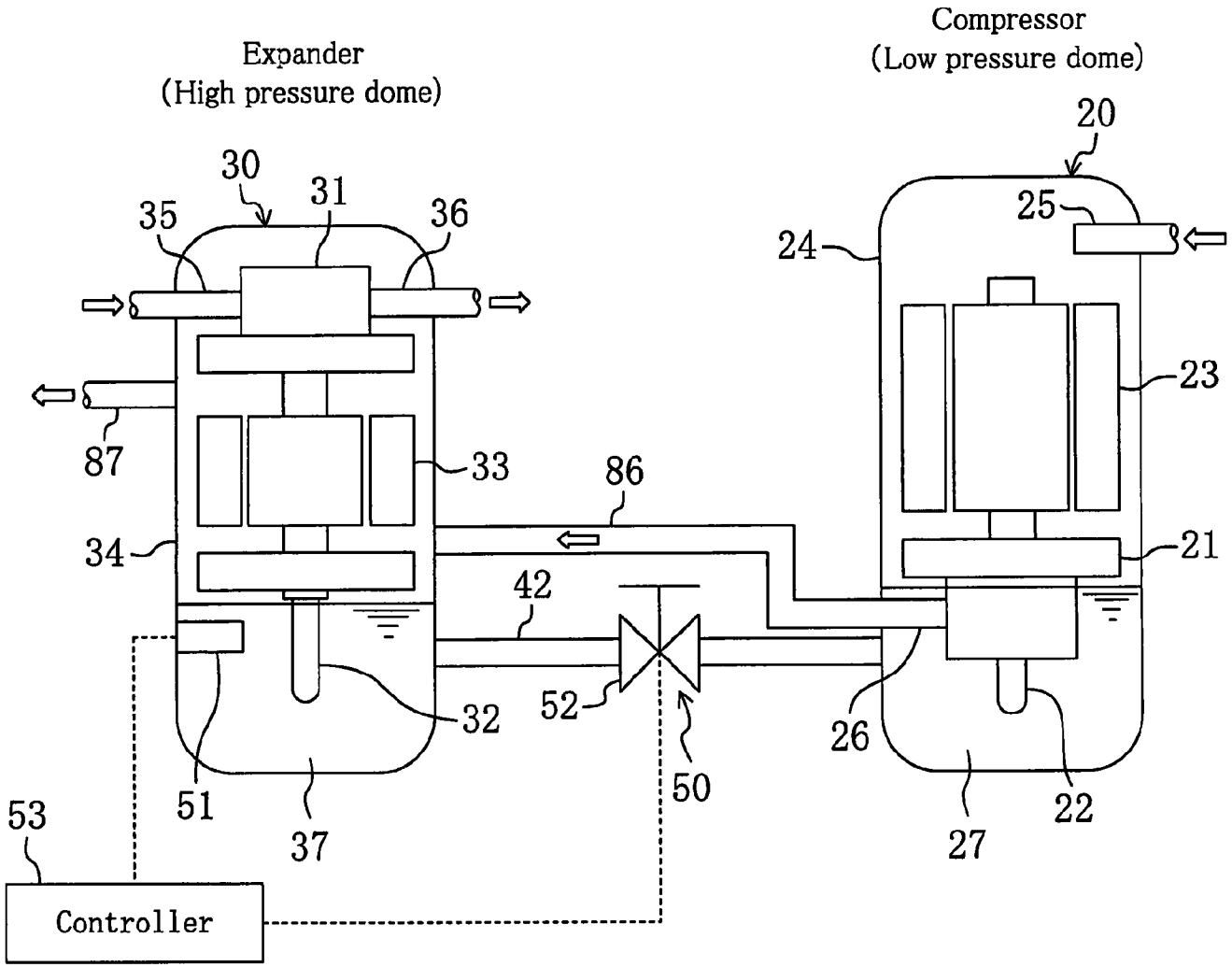
FIG. 31 is an enlarged view of a main part of the refrigerant circuit in accordance with Embodiment 6.

As shown in FIG. 30 and FIG. 31, the pipe connecting the discharge pipe (26) of the compressor (20) and the first port of the first four-way switching valve (12) is omitted in a refrigerant circuit (11) of the present embodiment. Further in this refrigerant circuit (11), the start end of the high-pressure side introduction pipe (86) is connected to the discharge pipe (26) of the compressor (20) while the terminal end of the high-pressure side leading pipe (87) is connected to the first port of the first four-way switching valve (12). The connection points of the high-pressure side introduction pipe (86) and the high-pressure side leading pipe (87) to the expander casing (34) are the same as those in Embodiment 5.

In the refrigerant circuit (11) of the present embodiment, all of the refrigerant discharged from the compressor (20) flows into the internal space of the expander casing (34) through the high-pressure side introduction pipe (86), passes through the generator (33) from below upward, and flows then to the first four-way switching valve (12) through the high-pressure side leading pipe (87).

In the present embodiment, all of the high-pressure refrigerant discharged from the compressor (20) passes through the internal space of the expander casing (34). Therefore, the effects obtained in Embodiment 5 can be obtained to a further greater degree in the present embodiment. Namely, in the present embodiment, the amount of the refrigerator oil separated from the high-pressure refrigerant in the expander casing (34) increases when compared with that in Embodiment 5 to secure the amount of the refrigerator oil reserved in the expander casing (34) further effortlessly, thereby further suppressing the danger that the expander (30) is damaged due to deficiency of the refrigerator oil.

Modified Example 1 of Embodiment 6

Figure 32:
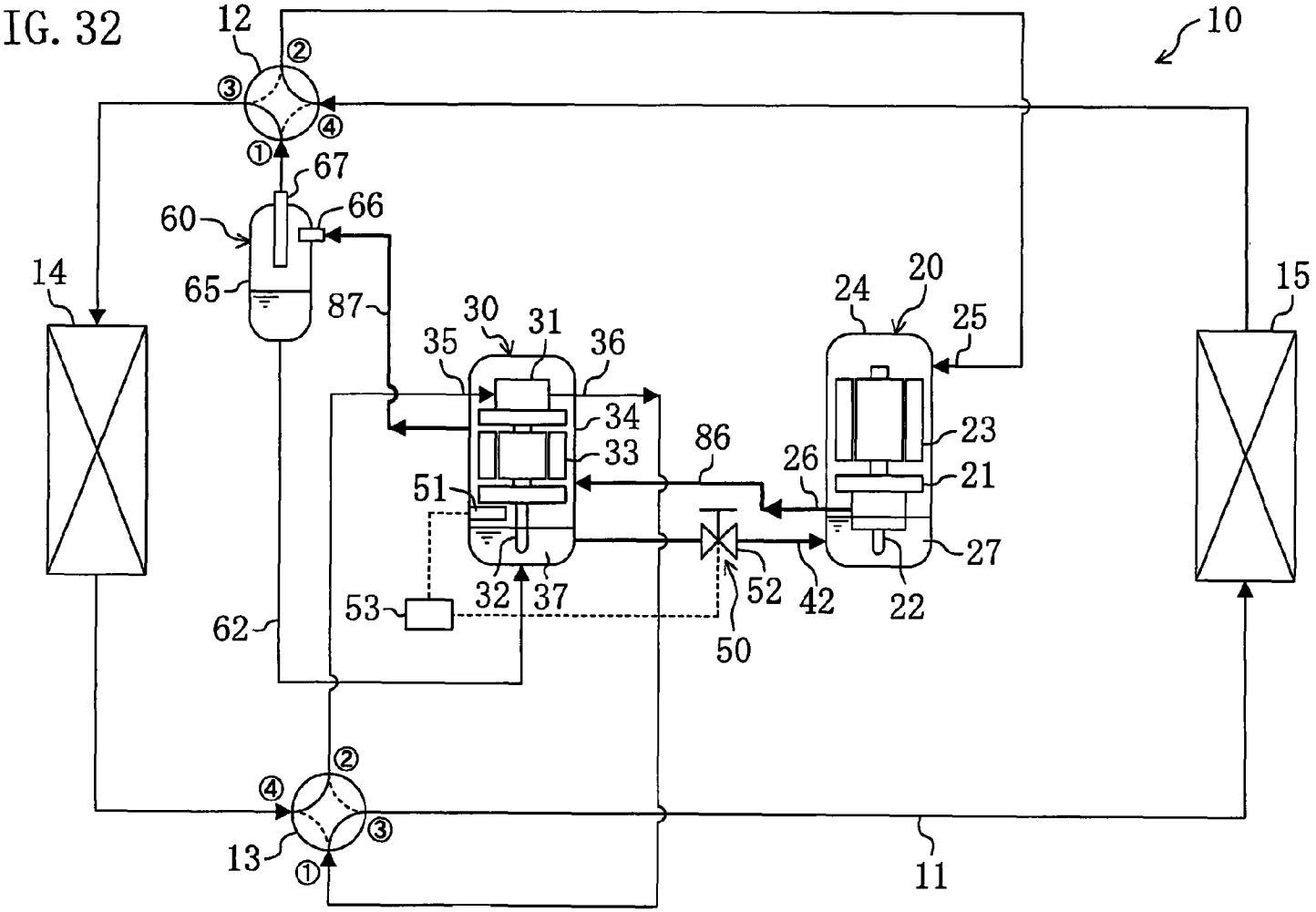
FIG. 32 is a refrigerant circuit diagram showing a construction of a refrigerant circuit in accordance with Modified Example 1 of Embodiment 6.

As shown in FIG. 32, an oil separator (60) may be provided on the discharge side of the compressor (20) in such a manner that the bottom of a body member (65) of the oil separator (60) is connected to the bottom of the expander casing (34) through an oil return pipe (62).

Herein, only the difference of a refrigerant circuit (11) of the present modified example from that shown in FIG. 30 will be described. In the refrigerant circuit (11) of the present modified example, the terminal end of the high-pressure side leading pipe (87) is connected to the inlet pipe (66) of the oil separator (75). The other difference is the same as the difference of the refrigerant circuit (11) of Modified Example 1 of Embodiment 5 (see FIG. 27) from the refrigerant circuit (11) shown in FIG. 25. Therefore, the description of Modified example 1 of Embodiment 5 is evoked as the description of the present modified example.

Modified Example 2 of Embodiment 6

Figure 33:
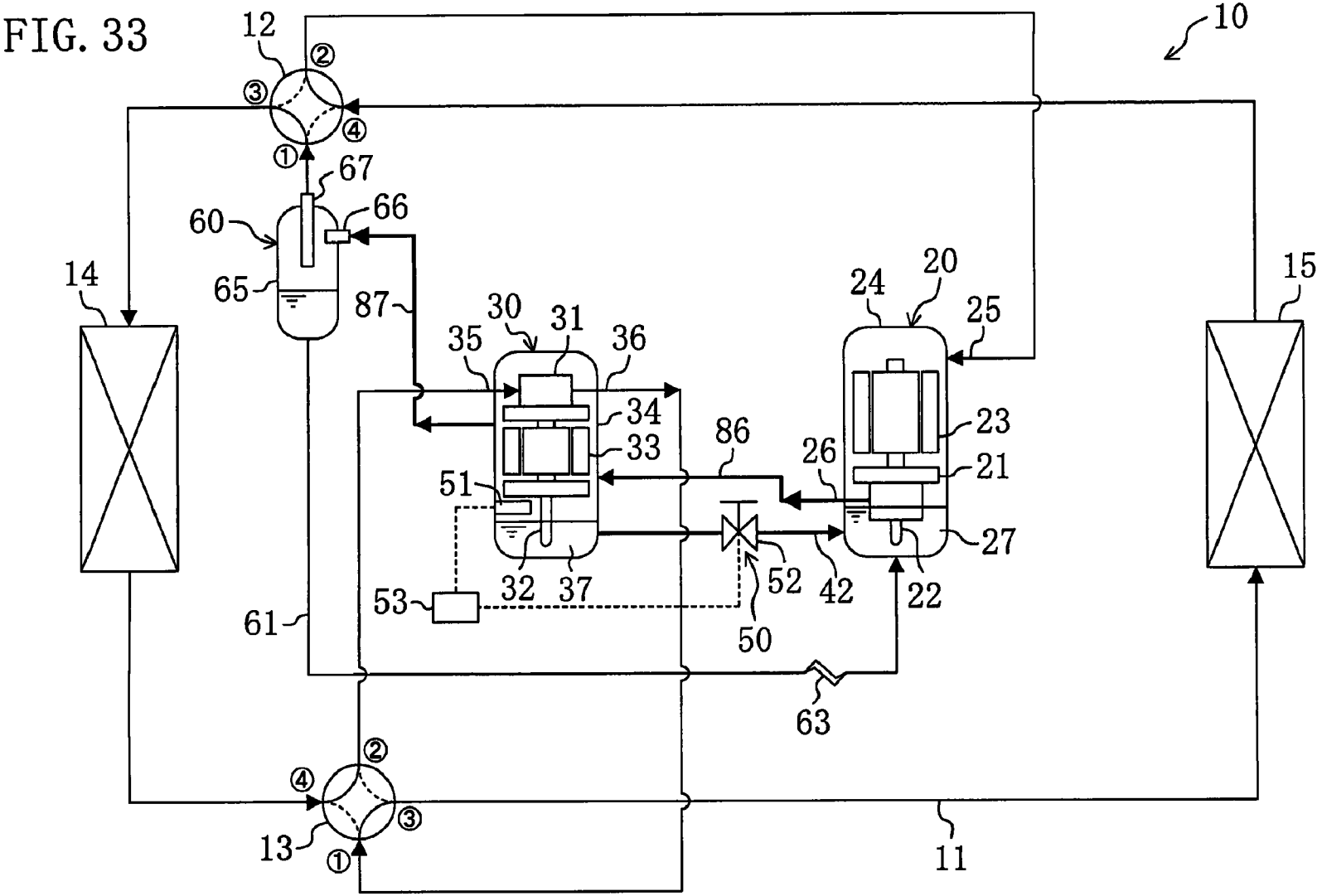
FIG. 33 is a refrigerant circuit diagram showing a construction of a refrigerant circuit in accordance with Modified Example 2 of Embodiment 6.

As shown in FIG. 33, an oil separator (60) may be provided on the discharge side of the compressor (20) in such a manner that the bottom of a body member (65) of the oil separator (60) is connected to the bottom of the compressor casing (24) through an oil return pipe (61).

Herein, only the differences of a refrigerant circuit (11) of the present modified example from that shown in FIG. 30 will be described. In the refrigerant circuit (11) of the present modified example, the terminal end of the high-pressure side leading pipe (87) is connected to the inlet pipe (66) of the oil separator (60). The other difference is the same as the difference of the refrigerant circuit (11) of Modified Example 2 of Embodiment 5 (see FIG. 28) from the refrigerant circuit (11) shown in FIG. 25. Therefore, the description of Modified example 5 of Embodiment 2 is evoked as the description of the present modified example.

Modified Example 3 of Embodiment 6

Figure 34:
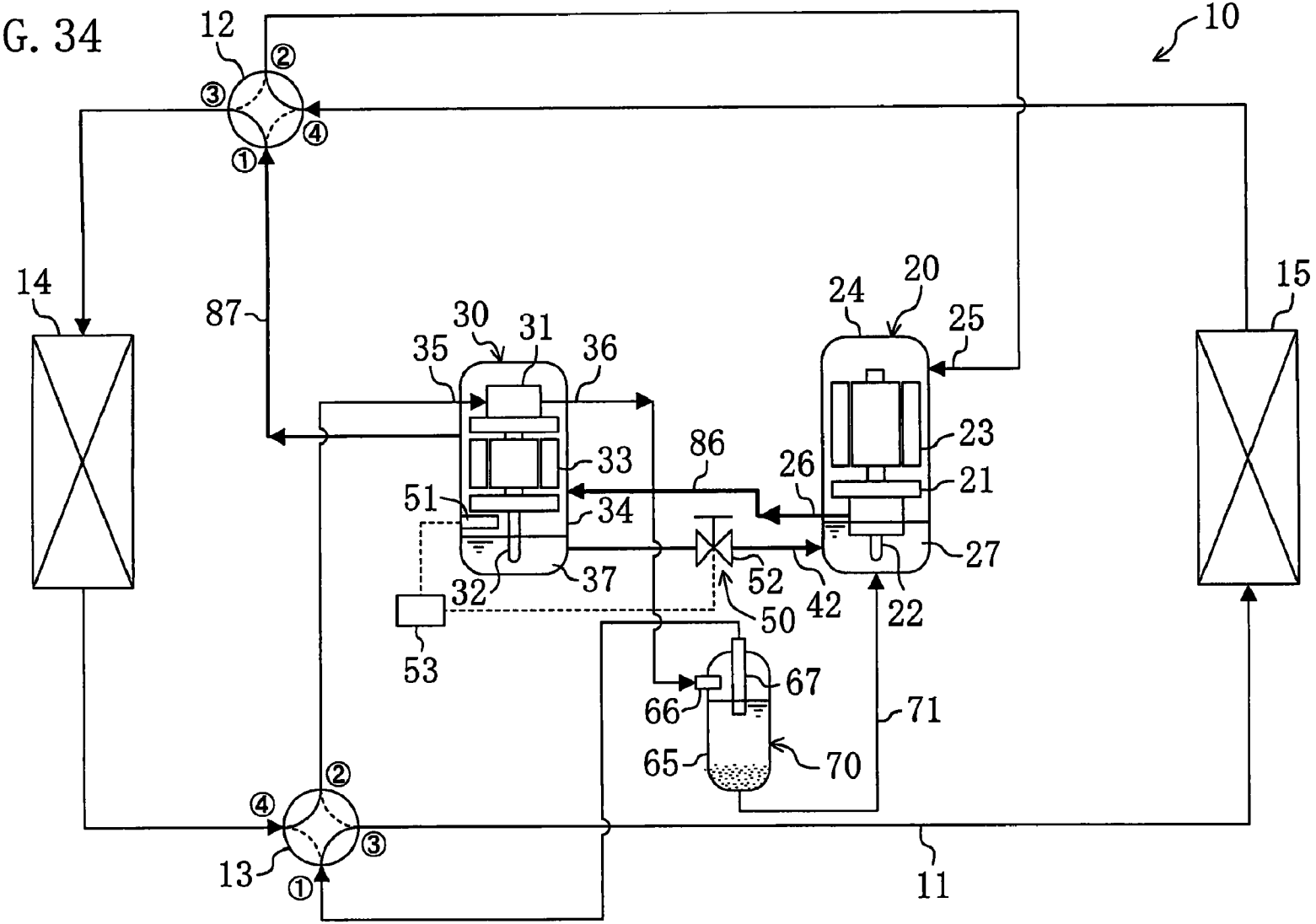
FIG. 34 is a refrigerant circuit diagram showing a construction of a refrigerant circuit in accordance with Modified Example 3 of Embodiment 6.

As shown in FIG. 34, an oil separator (70) may be provided on the outflow side of the expander (30) in such a manner that the bottom of a body member (65) of the oil separator (70) is connected to the bottom of the compressor casing (24) through an oil return pipe (71).

The difference of a refrigerant circuit (11) of the present modified example from that shown in FIG. 30 is the same as the difference of the refrigerant circuit (11) of Modified Example 3 of Embodiment 5 (see FIG. 29) from the refrigerant circuit (11) shown in FIG. 25. Therefore, the description of Modified example 3 of Embodiment 5 is evoked as the description of the present modified example.

Other Embodiments

The above embodiments may have any of the following constructions.

First Modified Example

Figure 35:
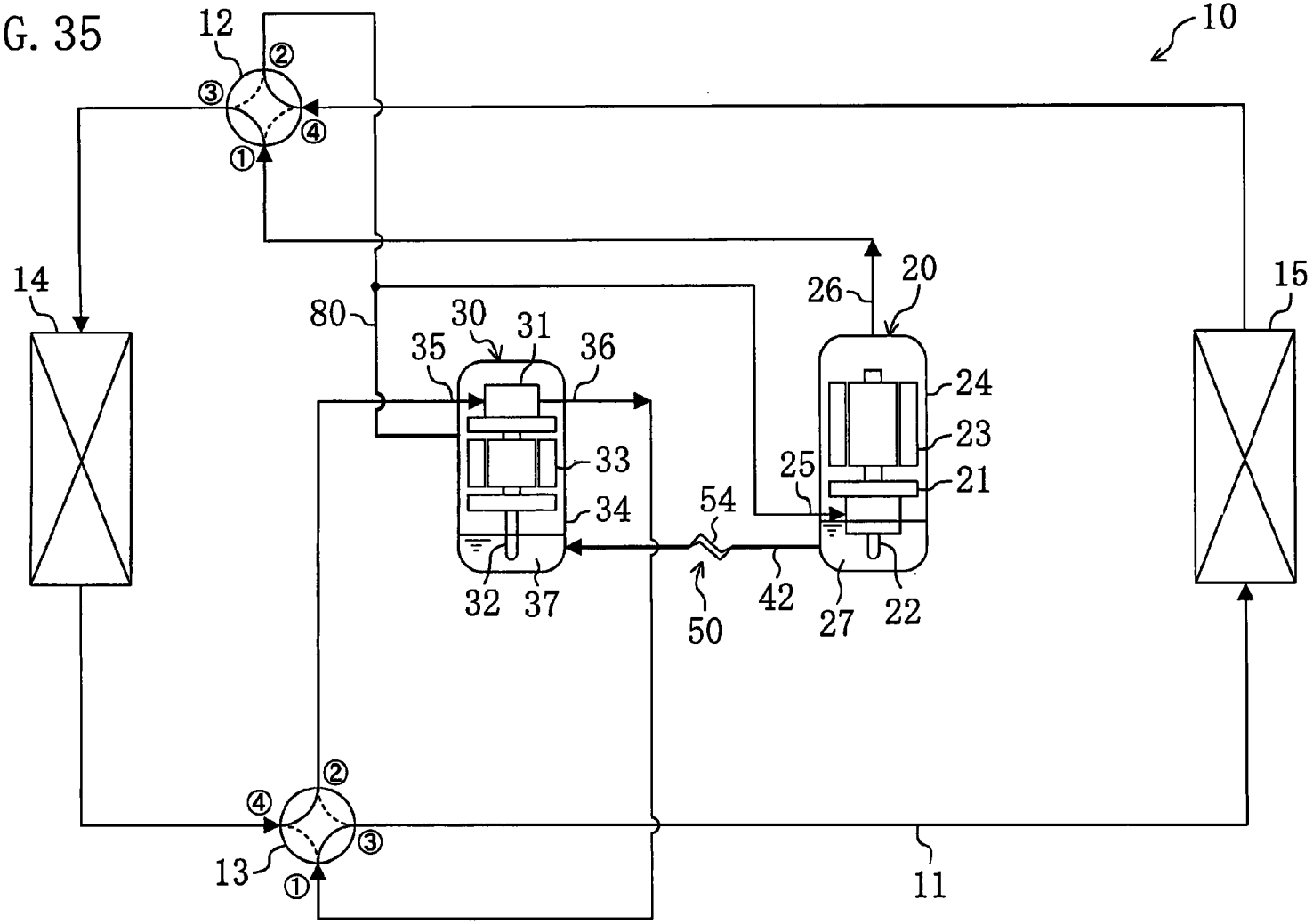
FIG. 35 is a refrigerant circuit diagram showing a construction of a refrigerant circuit in accordance with a first modified example of another embodiment.

In each of the above embodiments, a capillary tube (54) as adjusting means may be provided in the middle of the oil pipe (42), as shown in FIG. 35. A refrigerant circuit (11) shown in FIG. 35 is Embodiment 1 to which the present modified example is applied.

Provision of the capillary tube (54) in the oil pipe (42) reduces the pressure of the refrigerator oil flowing in the oil pipe (42) when passing through the capillary tube (54). Accordingly, even though the compressor casing (24) and the expander casing (34), of which inner pressures are different from each other, are connected to each other through the oil pipe (42), the refrigerator oil is prevented from being distributed excessively to one of the compressor (20) and the expander (30) whichever has an inner pressure lower than the other. In other words, the capillary tube (54) adjusts the flow rate of the refrigerator oil in the oil pipe (42) so that the refrigerator oil is prevented from being distributed to one of the compressor casing (24) and the expander casing (34) whichever has an inner pressure lower than the other.

Second Modified Example

Figure 36:
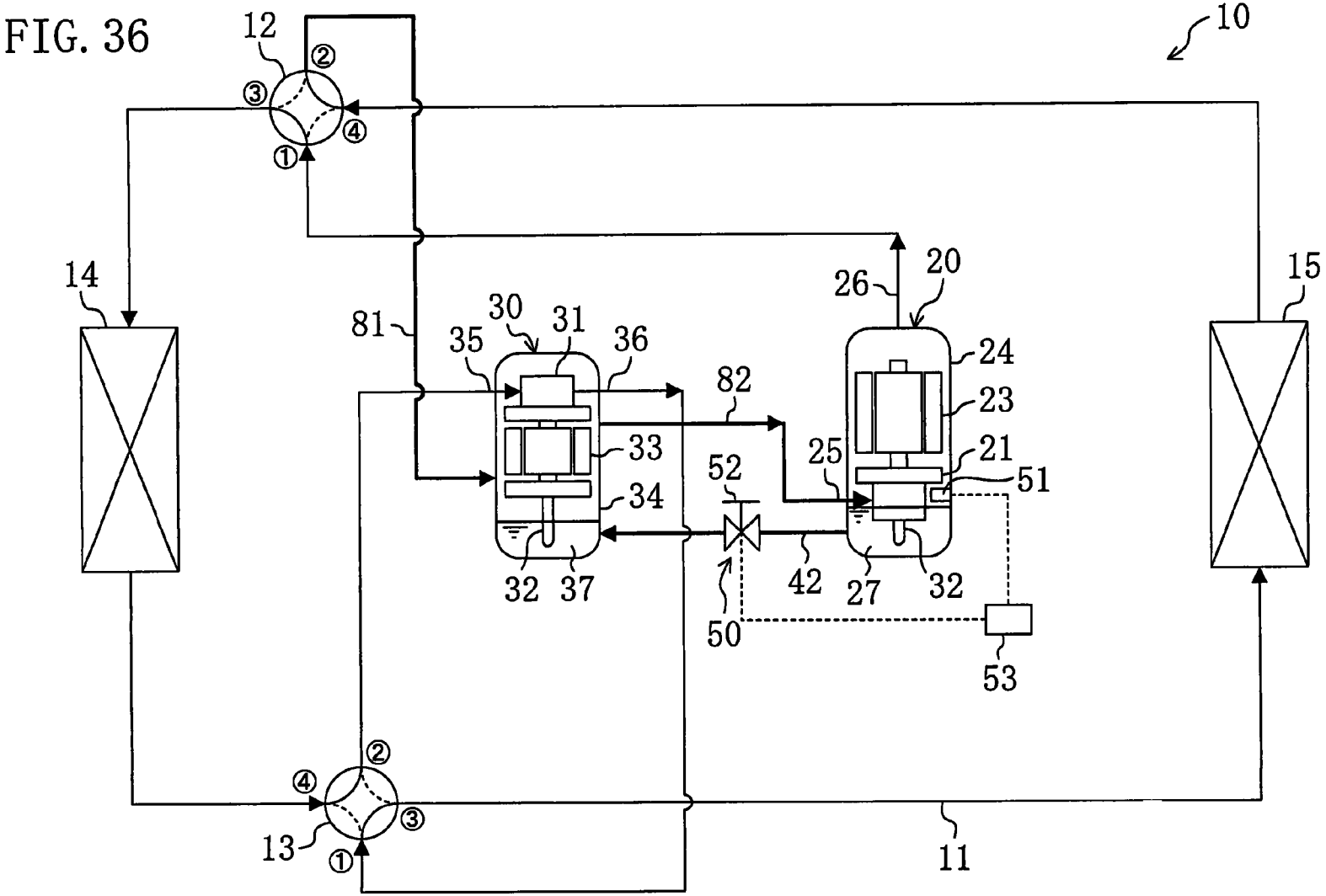
FIG. 36 is a refrigerant circuit diagram showing a construction of a refrigerant circuit in accordance with a second modified example of the other embodiment.
Figure 37:
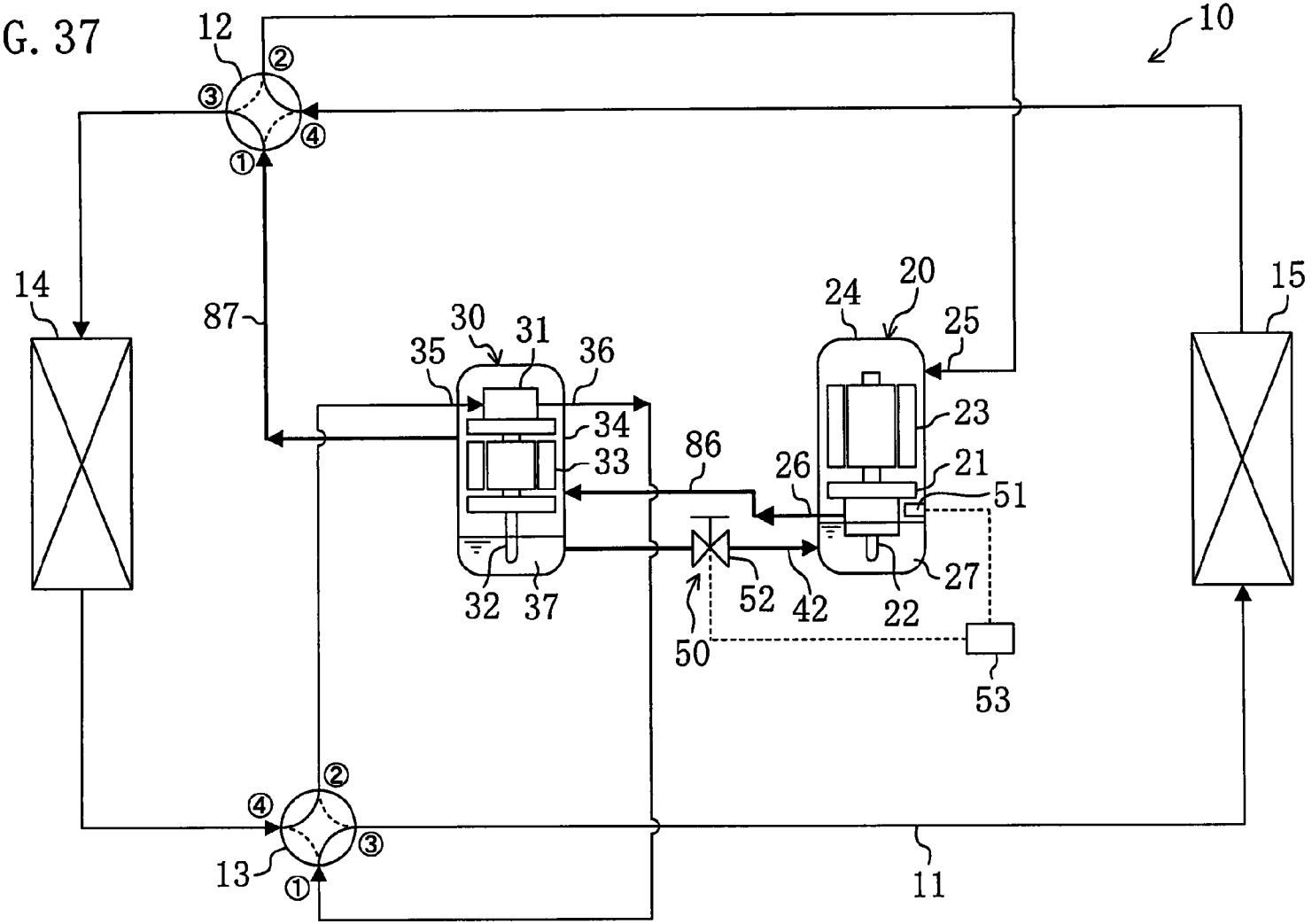
FIG. 37 is a refrigerant circuit diagram showing a construction of a refrigerant circuit in accordance with the second modified example of the other embodiment.

In each of the above embodiments, the oil level sensor (51) may be provided inside the compressor casing (24), as shown in FIG. 36 and FIG. 37. A refrigerant circuit (11) shown in FIG. 36 is Embodiment 3 to which the present modified example is applied. As well, a refrigerant circuit (11) shown in FIG. 37 is Embodiment 6 to which the present modified example is applied.

In the refrigerant circuit (11) shown in FIG. 36, the inner pressure of the compressor casing (24) is higher than that of the expander casing (34). Accordingly, in the oil pipe (42) with the oil amount adjusting valve (52) opened, the refrigerator oil flows from the oil reservoir (27) in the compressor casing (24) toward the oil reservoir (37) in the expander casing (34). In view of this, the controller (53) opens the oil amount adjusting valve (52) when it judges that the oil level in the compressor casing (24) rises up to or over a given level and closes the oil amount adjusting valve (52) when it judges that the oil level in the compressor casing (24) lowers up to or over a given level.

On the other hand, in the refrigerant circuit (11) shown in FIG. 37, the inner pressure of the expander casing (34) is higher than that of the compressor casing (24). Accordingly, in the oil pipe (42) with the oil amount adjusting valve (52) opened, the refrigerator oil flows from the oil reservoir (37) in the expander casing (34) toward the oil reservoir (27) in the compressor casing (24). In view of this, the controller (53) opens the oil amount adjusting valve (52) when it judges that the oil level in the compressor casing (24) lowers up to or over a given level and closes the oil amount adjusting valve (52) when it judges that the oil level in the compressor (24) rises up to or over a given level.

Third Modified Example

Figure 38:
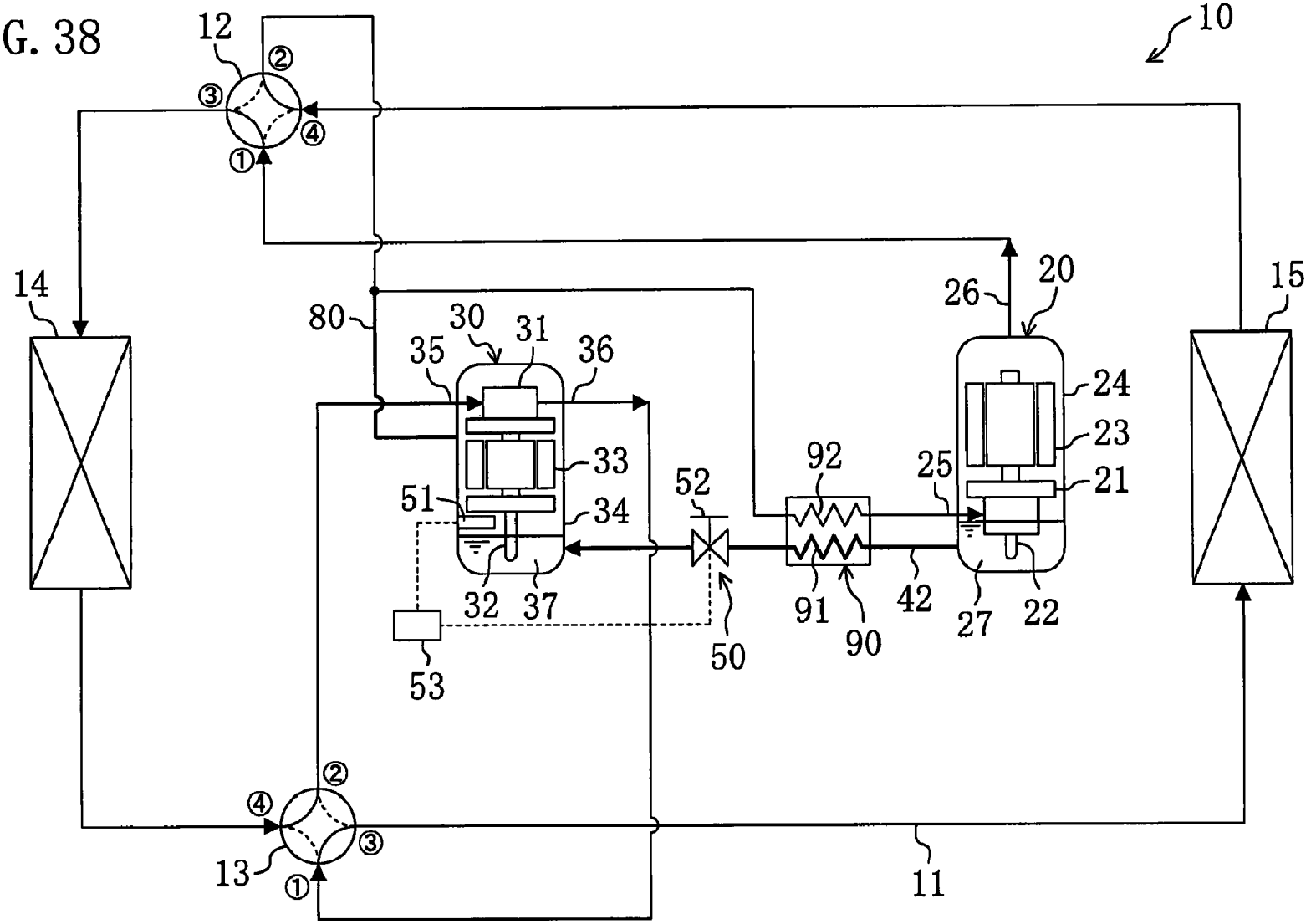
FIG. 38 is a refrigerant circuit diagram showing a construction of a refrigerant circuit in accordance with a third modified example of the other embodiment.

In each of Embodiments 1, 2, and 3, an oil cooling heat exchanger (90) may be added to the refrigerant circuit (11), as shown in FIG. 38.

The oil cooling heat exchanger (90) is of plate type or of double pipe type, for example. Specifically, a first path (91) and a second path (92) are formed in the oil cooling heat exchanger (90). The first path (61) of the oil cooling heat exchanger (90) is provided in the middle of the oil pipe (42) while the second path (92) thereof is provided in the middle of a pipe connecting the suction pipe (25) of the compressor (20) and the first four-way switching valve (12). In the oil cooling heat exchanger (90), heat exchange is performed between the refrigerator oil flowing in the oil pipe (42) and the low-pressure refrigerant flowing from the first four-way switching valve (12) toward the compressor (20).

In the compressor (20) in each of Embodiments 1, 2, and 3, the high-temperature and high-pressure refrigerant compressed in the compression mechanism (21) is discharged into the internal space of the compressor casing (24). Accordingly, the lubricant oil reserved in the oil reservoir (27) in the compressor casing (24) is comparatively high temperature (for example, approximately 80° C.). On the other hand, the low-pressure refrigerant sucked in the compressor (20) is comparatively low temperature (for example, approximately 5° C.). Therefore, the lubricant oil flowing into the oil pipe (42) from the oil reservoir (27) in the compressor casing (20) is cooled by heat exchange with the low-pressure refrigerant when passing through the oil cooling heat exchanger (90) and flows then into the oil reservoir (37) in the expander casing (34).

Herein, in the refrigerant circuit (11), it is desirable for securing the absorption amount of the heat of the refrigerant in one of the outdoor heat exchanger (14) and the indoor heat exchanger (15) whichever serves as an evaporator to set the enthalpy of the refrigerant flowing out from the expander (30) low as far as possible. In contrast, in the present modified example, the refrigerator oil in the compressor casing (24) flows into the expander casing (34) after being cooled in the oil cooling heat exchanger (90) to reduce the amount of heat that invades the refrigerant expanded in the expansion mechanism (31). Hence, in the present modified example, the enthalpy of the refrigerant flowing out from the expander (30) can be suppressed low to secure the absorption amount of the heat of the refrigerant in the evaporator sufficiently.

Fourth Modified Example

Figure 39:
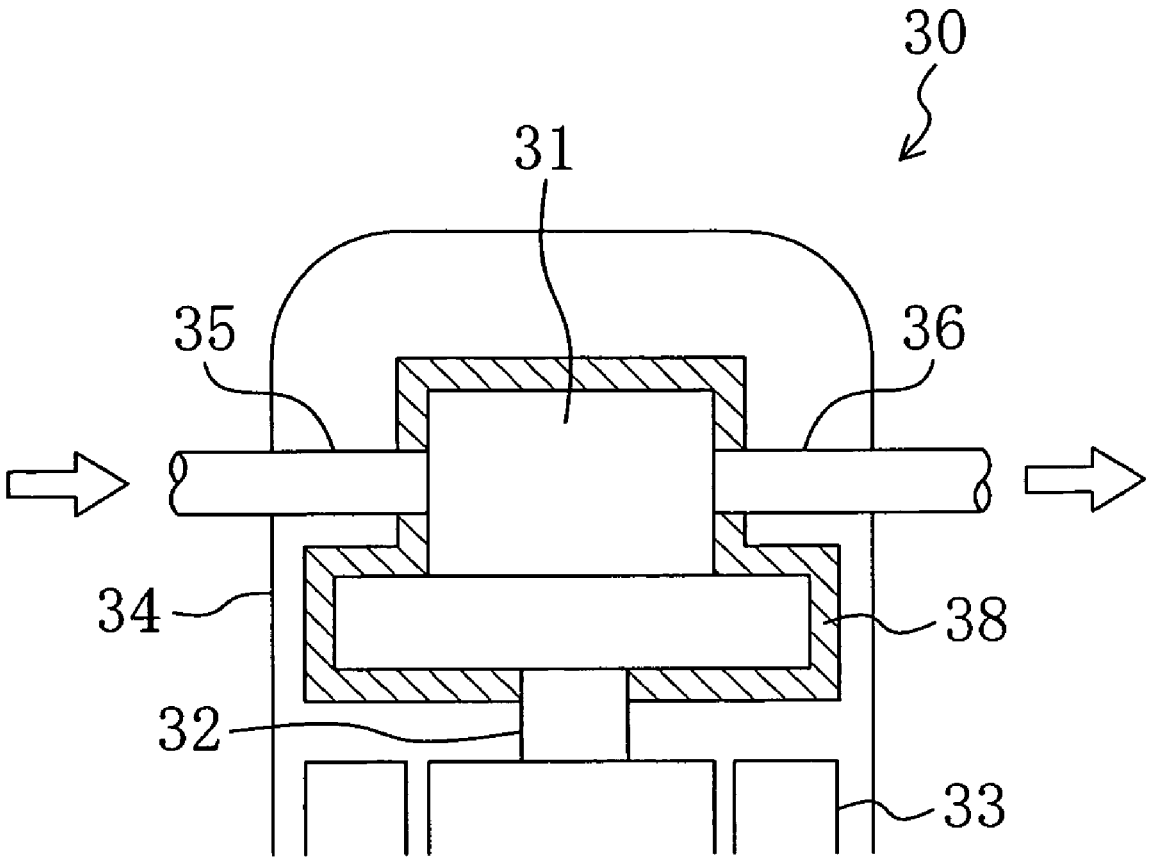
FIG. 39 is an enlarged view of a main part of an expander in a fourth modified example of the other embodiment.

In each of the above embodiments, the expansion mechanism (31) in the expander casing (34) may be surrounded by a thermal insulation material (38), as shown in FIG. 39.

As described above, heat invasion from outside to the refrigerant passing through the expansion mechanism (31) reduces, by the amount of the invading heat, the absorption amount of the heat of the refrigerant in a heat exchanger functioning as an evaporator. In contrast, when the expansion mechanism (31) is surrounded by the thermal insulation material (38) as in the present modified example, the amount of heat invading the refrigerant passing through the expansion mechanism (31) can be reduced to allow the heat exchanger functioning as an evaporator to exert its performance fully.

Herein, in the case where the inner pressure of the expander casing (34) is the high pressure of the refrigeration cycle as in Embodiments 4 to 6, the atmospheric temperature in the expander casing (34) becomes high when compared with the case where the inner pressure of the expander casing (34) is the low pressure of the refrigeration cycle as in Embodiments 1 to 3. Accordingly, the present modified example is especially effective in the case where the inner pressure of the expander casing (34) is the high pressure of the refrigeration cycle as in Embodiments 4 to 6.

Fifth Modified Example

Although each of the compression mechanism (21) and the expansion mechanism (31) is composed of a rotary fluid machinery in each of the above embodiments, the fluid machineries of the compression mechanism (21) and the expansion mechanism (31) are not limited thereto. For example, each of the compression mechanism (21) and the expansion mechanism (31) may be composed of a scroll fluid machinery. Alternatively, the compression mechanism (21) and the expansion mechanism (31) may be composed of fluid machineries of different types.

Sixth Modified Example

The oil supply paths formed in the drive shaft (22) of the compressor (20) and the output shaft (32) of the expander (30) compose the centrifugal pumps in each of the above embodiments, but a mechanical pump (a gear pump, a trochoid pump, or the like, for example) may be connected to the lower end of the drive shaft (11) or the output shaft (32) to drive the mechanical pump by the drive shaft (22) or the output shaft (32) for oil supply to the compression mechanism (21) or the expansion mechanism (31).

In the case where the inner pressure of the expander casing (34) is the low pressure of the refrigeration cycle as in Embodiments 1 to 3, the pressure of the refrigerator oil reserved in the expander casing (34) is lower than that of the refrigerant flowing into the expansion mechanism (31) to invite difficulty in securing a sufficient amount of oil supply to the expansion mechanism (31) only by the centrifugal pump. As well, in the case where the compressor (20) is of low pressure dome type as in Embodiments 4 and 5, it may be hard to secure a sufficient amount of oil supply to the compression mechanism (21) by only the centrifugal pump. Therefore, it is preferable to provide an additional oil supply pump of mechanical type on one of the compressor (20) and the expander (30) whichever has a casing (24, 34) of which inner pressure is the low pressure of the refrigeration cycle.

The above embodiments are mere essentially preferable examples and are not intended to limit the present invention and applicable objects and use thereof.

Industrial Applicability

As described above, the present invention is useful in refrigerating apparatuses including a refrigerant circuit in which a compressor and an expander are provided.

The invention claimed is:

1. A refrigerating apparatus including a refrigerant circuit to which a compressor and an expander are connected and performing a refrigeration cycle by circulating refrigerant in the refrigerant circuit, comprising:

in the compressor, a compression mechanism for sucking and compressing the refrigerant; a compressor casing for housing the compression mechanism; and an oil supply mechanism for supplying lubricant oil from an oil reservoir in the compressor casing to the compression mechanism;

in the expander, an expansion mechanism for expanding the refrigerant flowing therein to generate motive power; an expander casing for housing the expansion mechanism; and an oil supply mechanism for supplying the lubricant oil from an oil reservoir in the expander to the expansion mechanism, one of the compressor casing and the expander casing being at high pressure of the refrigeration cycle while another one of the compressor casing and the expander casing being at low pressure of the refrigeration cycle;

an oil distribution path which connects the compressor casing and the expander casing for allowing the lubricant oil to flow between the oil reservoir in the compressor casing and the oil reservoir in the expander casing; and a control valve which is provided in the oil distribution path, and adjusts a flow state of the lubricant oil in the oil distribution path.

2. The refrigerating apparatus of claim 1, further comprising:

an oil level detector for detecting an oil level in the oil reservoir in the compressor casing or an oil level in the oil reservoir in the expander casing, wherein; opening of the control valve is controlled on the basis of an output signal of the oil level detector.

3. The refrigerating apparatus of claim 1, wherein the compression mechanism compresses the refrigerant sucked directly from outside of the compressor casing and discharge it into the compressor casing, and the refrigerant circuit includes a low-pressure side communication path for allowing a pipe connected to a suction side of the compressor and an internal space of the expander casing to communicate with each other.

4. The refrigerating apparatus of claim 1, wherein the compression mechanism compresses the refrigerant sucked directly from outside of the compressor casing and discharge it into the compressor casing, and the refrigerant circuit includes: a low-pressure side introduction path for introducing part or all of low-pressure refrigerant flowing toward a suction side of the compressor into an internal space of the expander casing; and a low-pressure side leading path for supplying the low-pressure refrigerant to the compressor by leading the low-pressure refrigerant from the internal space of the expander casing.

5. The refrigerating apparatus of claim 4, wherein a generator driven by the expansion mechanism is housed in the expander casing to partition the internal space of the expander casing, one of spaces partitioned by the generator being connected to the low-pressure side introduction path while the other one of the spaces being connected to the low-pressure side leading path in the internal space of the expander casing.

6. The refrigerating apparatus of claim 5, wherein the generator partitions transversely the internal space of the expander casing, a space under the generator being connected to the low-pressure side introduction path while a space above the generator being connected to the low-pressure side leading path in the internal space of the expander casing.

7. The refrigerating apparatus of claim 3 or 4, wherein the refrigerant circuit includes: an oil separator arranged on an outflow side of the expander for separating the refrigerant and the lubricant oil from each other; and an oil return path for supplying the lubricant oil from the oil separator to the compressor casing.

8. The refrigerating apparatus of claim 3 or 4, wherein the refrigerant circuit includes: an oil separator arranged on an outflow side of the expander for separating the refrigerant and the lubricant oil from each other; and an oil return path for supplying the lubricant oil from the oil separator to the expander casing.

9. The refrigerating apparatus of claim 3 or 4, further comprising:

an oil cooling heat exchanger for cooling by heat exchanging the lubricant oil flowing in the oil distribution path with the low-pressure refrigerant sucked to the compressor.

10. The refrigerating apparatus of claim 1, wherein the compression mechanism compresses the refrigerant sucked from the compressor casing and discharge it directly outside the compressor casing, and the refrigerant circuit includes: a high-pressure side communication path for allowing a pipe connected to a discharge side of the compressor and an internal space of the expander casing to communicate with each other; an oil separator arranged on the discharge side of the compressor for separating the refrigerant and the lubricant oil from each other; and an oil return path for supplying the lubricant oil from the oil separator to the expander casing.

11. The refrigerating apparatus of claim 1, wherein the compression mechanism compresses the refrigerant sucked from the compressor casing and discharge it directly outside the compressor casing, and the refrigerant circuit includes: a high-pressure side introduction path for introducing part or all of high-pressure refrigerant discharged from the compressor into an internal space of the expander casing; and a high-pressure side leading path for leading the high-pressure refrigerant from the internal space of the expander casing.

12. The refrigerating apparatus of claim 11, wherein a generator driven by the expansion mechanism is housed in the expander casing to partition the internal space of the expander casing, one of spaces partitioned by the generator being connected to the high-pressure side introduction path while the other one of the spaces being connected to the high-pressure side leading path in the internal space of the expander casing.

13. The refrigerating apparatus of claim 12, wherein the generator partitions transversely the internal space of the expander casing, a space under the generator being connected to the high-pressure side introduction path while a space above the generator being connected to the high-pressure side leading path in the internal space of the expander casing.

14. The refrigerating apparatus of any one of claims 3, 4, and 11, wherein the refrigerant circuit includes: an oil separator arranged on a discharge side of the compressor for separating the refrigerant and the lubricant oil from each other; and an oil return pipe for supplying the lubricant oil from the oil separator to the compressor casing.

15. The refrigerating apparatus of any one of claims 3, 4, and 11, wherein the refrigerant circuit includes: an oil separator arranged on a discharge side of the compressor for separating the refrigerant and the lubricant oil from each other; and an oil return pipe for supplying the lubricant oil from the oil separator to the expander casing.

16. The refrigerating apparatus of any one of claims 3, 4, and 11, wherein the refrigerant circuit includes: an oil separator arranged on a suction side of the compressor for separating the refrigerant and the lubricant oil from each other; and an oil return pipe for supplying the lubricant oil from the oil separator to the expander casing.

17. The refrigerating apparatus of claim 1, wherein the oil distribution path is connected to a lower part of the compressor casing and a lower part of the expander casing.

18. The refrigerating apparatus of claim 1, wherein one end of the oil distribution path is opened to an internal space of the compressor casing, and the other end of the oil distribution path is opened to an internal space of the expander casing.

* * * * *